US011754364B2

(12) United States Patent
Summers et al.

(10) Patent No.: US 11,754,364 B2
(45) Date of Patent: Sep. 12, 2023

(54) ARROW REST MOUNTING SYSTEM ENABLING SLIDE-BASED POSITION ADJUSTMENT

(71) Applicant: Daniel A. Summers, Alpine, WY (US)

(72) Inventors: Daniel A. Summers, Alpine, WY (US); Kevin S. Fry, Madison Heights, VA (US); Jonathan M. Loomis, Lynchburg, VA (US)

(73) Assignee: Daniel A. Summers, Monroe, VA (US)

( * ) Notice: Subject to any disclaimer, the term of this patent is extended or adjusted under 35 U.S.C. 154(b) by 0 days.

(21) Appl. No.: 17/463,285

(22) Filed: Aug. 31, 2021

(65) Prior Publication Data

US 2021/0404764 A1 Dec. 30, 2021

Related U.S. Application Data

(63) Continuation of application No. 16/729,626, filed on Dec. 30, 2019, now Pat. No. 11,105,581, which is a continuation of application No. 16/143,944, filed on Sep. 27, 2018, now Pat. No. 10,539,390, which is a continuation of application No. 15/446,696, filed on Mar. 1, 2017, now Pat. No. 10,088,264.

(60) Provisional application No. 62/301,819, filed on Mar. 1, 2016.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS 3,212,190 A * 10/1965 Larson ..... F41G 1/467 33/402
3,318,298 A * 5/1967 Bear ..... F41B 5/143 124/44.5
3,574,944 A * 4/1971 Reynolds ..... F41G 1/467 33/265
3,757,764 A * 9/1973 Ikeya ..... F41B 5/143 124/44.5
3,787,984 A * 1/1974 Bear ..... F41G 1/467 33/265

(Continued)

OTHER PUBLICATIONS

Ripcord X-Factor; Ripcord Arrow Rest; on or before Sep. 23, 2015; retrieved from the Internet: <http://ripcordarrowrest.com/ripcord-xfactor> , 4 pages.

(Continued)

*Primary Examiner* — John A Ricci
(74) *Attorney, Agent, or Firm* — Barclay Damon LLP

(57) ABSTRACT

An arrow rest mounting system is disclosed. The system, in an embodiment, comprises a main body configured to be coupled to an archery bow and an arm extending along an arm axis and configured to be supported by the main body. The arm comprises one or more main body engagement surfaces configured to engage the main body to at least partially surround the arm on the main body. The arm further comprises an arrow rest support configured to support an arrow rest. The arm is configured to be adjustably slid relative to the main body along the arm axis.

20 Claims, 49 Drawing Sheets

(56) References Cited

U.S. PATENT DOCUMENTS 3,918,428 A * 11/1975 Wilson ..... F41B 5/143 124/44.5
4,287,868 A * 9/1981 Schiff ..... F41B 5/143 124/44.5
4,476,846 A * 10/1984 Carville ..... F41B 5/143 124/44.5
4,542,731 A * 9/1985 Quartino ..... F41B 5/143 124/44.5
4,596,229 A * 6/1986 Bell ..... F41B 5/14 33/506
4,907,566 A * 3/1990 Klein ..... F41B 5/1438 124/44.5
5,062,407 A * 11/1991 Newbold ..... F41B 5/143 124/44.5
5,070,855 A * 12/1991 Troncoso ..... F41B 5/143 124/44.5
5,117,803 A * 6/1992 Johnson ..... F41B 5/143 124/44.5
5,161,514 A * 11/1992 Cary ..... F41B 5/143 124/44.5
5,285,764 A * 2/1994 Mertens ..... F41B 5/1438 124/44.5
5,372,119 A * 12/1994 Kidney ..... F41B 5/143 124/44.5
5,379,746 A * 1/1995 Sappington ..... F41G 1/467 124/87
5,383,441 A * 1/1995 Lightcap, Jr. ..... F41B 5/143 124/44.5
5,394,858 A * 3/1995 Karolian ..... F41B 5/143 124/44.5
5,526,800 A * 6/1996 Christian ..... F41B 5/143 124/44.5
5,533,494 A * 7/1996 Sacco ..... F41B 5/143 124/44.5
5,601,069 A * 2/1997 Clark ..... F41B 5/1438 124/44.5
5,722,175 A * 3/1998 Slates ..... F41G 1/467 124/87
5,944,005 A * 8/1999 Schiff ..... F41B 5/143 124/44.5
5,960,779 A * 10/1999 Jessee ..... F41B 5/143 124/44.5
6,178,959 B1 * 1/2001 Troncoso, Jr. ..... F41B 5/143 124/44.5
6,202,635 B1 * 3/2001 Evans ..... F41B 5/143 124/44.5
6,363,924 B1 * 4/2002 Adams, Jr. ..... F41B 5/143 124/44.5
6,430,822 B1 * 8/2002 Slates ..... F41G 1/467 124/87
6,557,541 B2 * 5/2003 Pinto, Jr. ..... F41B 5/143 124/44.5
7,409,950 B2 * 8/2008 Ellig ..... F41B 5/143 124/44.5
8,701,643 B2 * 4/2014 Ellig ..... F41B 5/1438 124/44.5
8,752,536 B2 * 6/2014 Sims ..... F41B 5/143 124/44.5
8,939,137 B2 * 1/2015 Hunt ..... F41B 5/143 124/44.5
8,967,131 B2 * 3/2015 Hunt ..... F41B 5/143 124/44.5
9,151,567 B1 * 10/2015 Estridge ..... F41B 5/143
9,285,181 B2 * 3/2016 Green ..... F41B 5/143
10,088,264 B2 * 10/2018 Summers ..... F41B 5/143
10,539,390 B2 * 1/2020 Summers ..... F41B 5/143
11,105,581 B2 * 8/2021 Summers ..... F41B 5/143

OTHER PUBLICATIONS

Hamskea Full Capture VersaRest; Hamskea Archery Solutions; on or before Sep. 23, 2015; retrieved from the Internet <http://ripcordarrowrest.com/ripcord-xfactor>; 1 page.

* cited by examiner

ARROW REST MOUNTING SYSTEM ENABLING SLIDE-BASED POSITION ADJUSTMENT

CROSS-REFERENCE TO RELATED APPLICATIONS

This application is a continuation of, and claims the benefit and priority of, U.S. patent application Ser. No. 16/729,626 filed on Dec. 30, 2019, which is a continuation of U.S. patent application Ser. No. 16/143,944 filed on Sep. 27, 2018, now U.S. Pat. No. 10,539,390, which is a continuation of U.S. patent application Ser. No. 15/446,696, now U.S. Pat. No. 10,088,264, filed on Mar. 1, 2017, and claims the benefit and priority of, U.S. Provisional Patent Application No. 62/301,819 filed on Mar. 1, 2016. The entire contents of such applications are hereby incorporated by reference.

BACKGROUND

An arrow rest is an accessory or component of an archery bow. The arrow rest supports the arrow at a desired position before the archer shoots. The settings for the exact position of the arrow rest can be very important to archers. With the rise in high performance features of bows, there is a growing demand to enable archers to fine tune these settings for the arrow rest.

The known arrow rest is used with a bracket. The bracket has an elongated slot. The archer inserts a screw through the slot to secure the bracket to a preexisting hole in the side of the bow. This known arrow rest has several disadvantages. It is difficult to control the adjustment of the position of the arrow rest after it is installed. For example, the archer may wish to move the arrow rest so that it is closer to the archer or further in front of the archer. To do so, the archer must first loosen the screw. Next, the user must pull or push the bracket as the screw moves rearward or forward within the slot. During this process, the bracket can undesirably rotate or pivot relative to the bow riser. This can alter the angular orientation of the arrow rest, resulting in misalignment. Consequently, such an attempt to adjust the fore-aft position of the arrow rest can impair the fine-tuned setting for the angular orientation of the arrow rest.

Additionally, the known arrow rest relies on a manual, push-pull approach for adjustment. The variability in the user's hand steadiness and hand force can make it difficult to make repeatable, fine adjustments to the fore-aft position of the arrow rest. Furthermore, the position of the known arrow rest on the bow can be unintentionally changed or misaligned due to forces encountered during use or transport of the bow. If the arrow rest's bracket is temporarily removed for transport, for example, there is no known way to reliably and repeatably reattach the bracket at it original, fine-tuned position on the bow. Accordingly, the known arrow rest is not conveniently, reliably, accurately, or repeatably attachable to bows. This decreases the utility and performance of arrow rests and bows for the archers.

The foregoing background describes some, but not necessarily all, of the problems, disadvantages, and shortcomings related to bow accessories, including arrow rests.

SUMMARY

An arrow rest mounting system is disclosed. The system, in an embodiment, includes a body configured to be coupled to an archery bow and an arm configured to be moveably coupled to the body. The arm includes an arrow rest support. The system has a position adjuster configured to cause a slide movement of the arm relative to the body.

In an embodiment, an arrow rest mounting system is disclosed. The arrow rest mounting system includes a body including a bow engager configured to be coupled to an archery bow and an arm engager. The archery bow is configured to be aimed at a target, wherein a portion of the target extends in a target plane. The mounting system additionally includes an arm moveably coupled to the arm engager. The arm is configured to slidably cooperate with the arm engager. The arm includes an arrow rest support configured to support an arrow rest.

A position adjuster is operatively coupled to the arm. When the bow engager is coupled to the archery bow, the position adjuster is configured to cause a slide movement of the arm relative to the arm engager. The arm engager and the arm include a plurality of slide guides configured to cooperate to direct the slide movement along an axis. The axis intersects with the target plane when the bow engager is coupled to the archery bow and the archery bow is aimed at the target. The slide guides are configured to inhibit rotation of the arm relative to the archery bow during the slide movement.

In another embodiment, an arrow rest mounting system is described. The mounting system includes a body and an arm configured to be moveably coupled to the body. The arm is configured to slidably cooperate with the body and includes an arrow rest support configured to support an arrow rest. A position adjuster is operatively coupled to the arm. When the body is coupled to the archery bow, the position adjuster is configured to cause a slide movement of the arm relative to the body.

In yet another embodiment, a method for manufacturing an arrow rest mounting system is described. The method includes structuring a body so that the body is configured to: (a) be mounted to an archery bow; and (b) define a first slide guide. The method further includes structuring an arm so that the arm is configured to: (a) support an arrow rest; (b) slidably cooperate with the body; and (c) define a second slide guide. The method additionally includes structuring a position adjuster so that: (a) the position adjuster is configured to be operatively coupled to the arm; and (b) the position adjuster is configured to cause a slide movement of the arm relative to the body so that the slide movement involves a cooperation of the first and second slide guides.

Additional features and advantages of the present disclosure are described in, and will be apparent from, the following Brief Description of the Drawings and Detailed Description.

DETAILED DESCRIPTION

Figure 1:
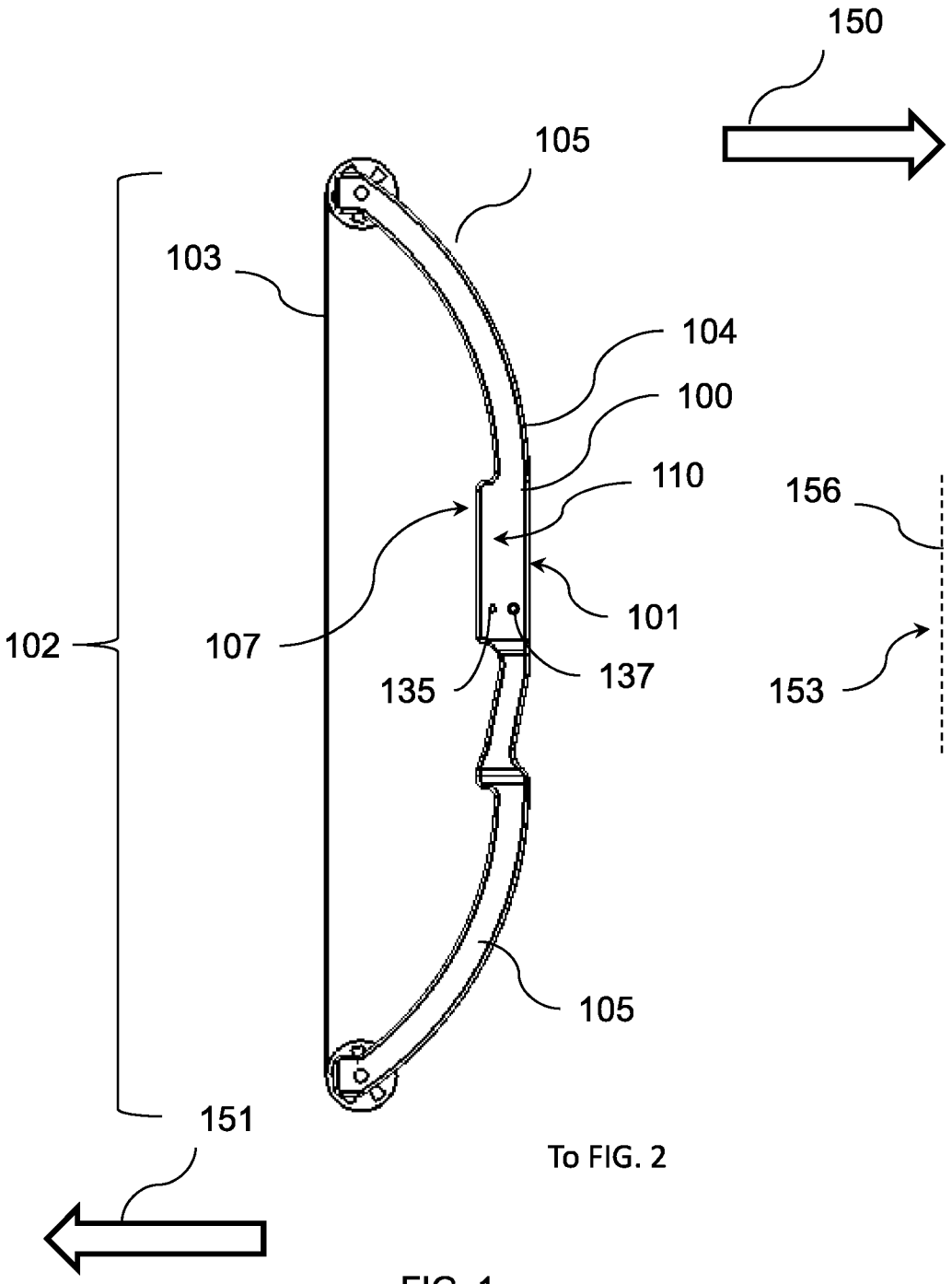
FIG. 1 is a side view of an embodiment of an archery bow.
Figure 2:
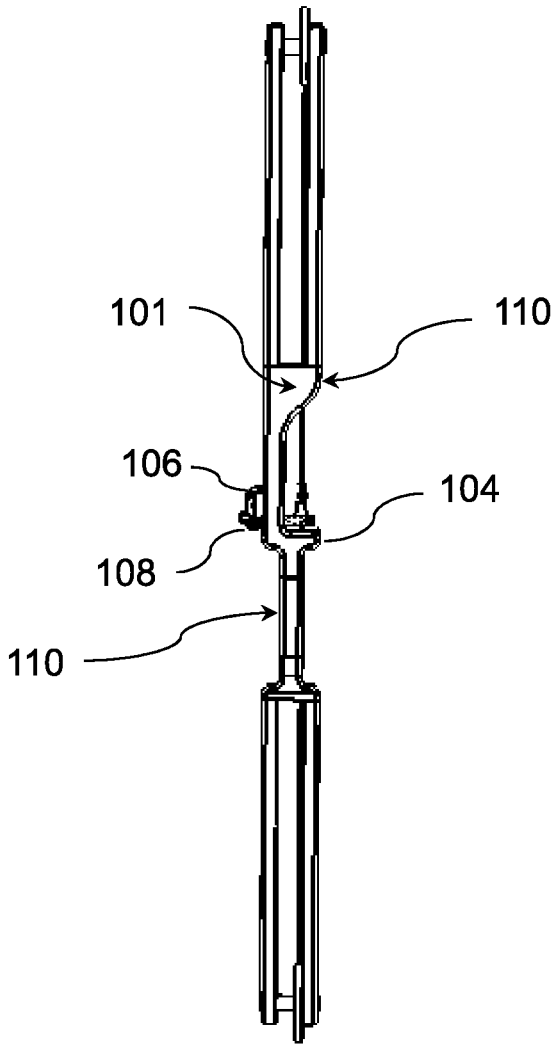
FIG. 2 is front view of the archery bow of FIG. 1 having an embodiment of an arrow rest coupled to the bow riser by an embodiment of a mounting system.

As illustrated in FIGS. 1-4, in one embodiment, an archery bow 102 includes a bowstring 103 coupled to limbs 105. The limbs 105 are coupled to a riser 104. A bow accessory or accessory, such as an arrow rest 106, can be attached or coupled to the bow riser 104 via an accessory mount or accessory mounting system, such as the arrow rest mounting system 108.

Figure 4:
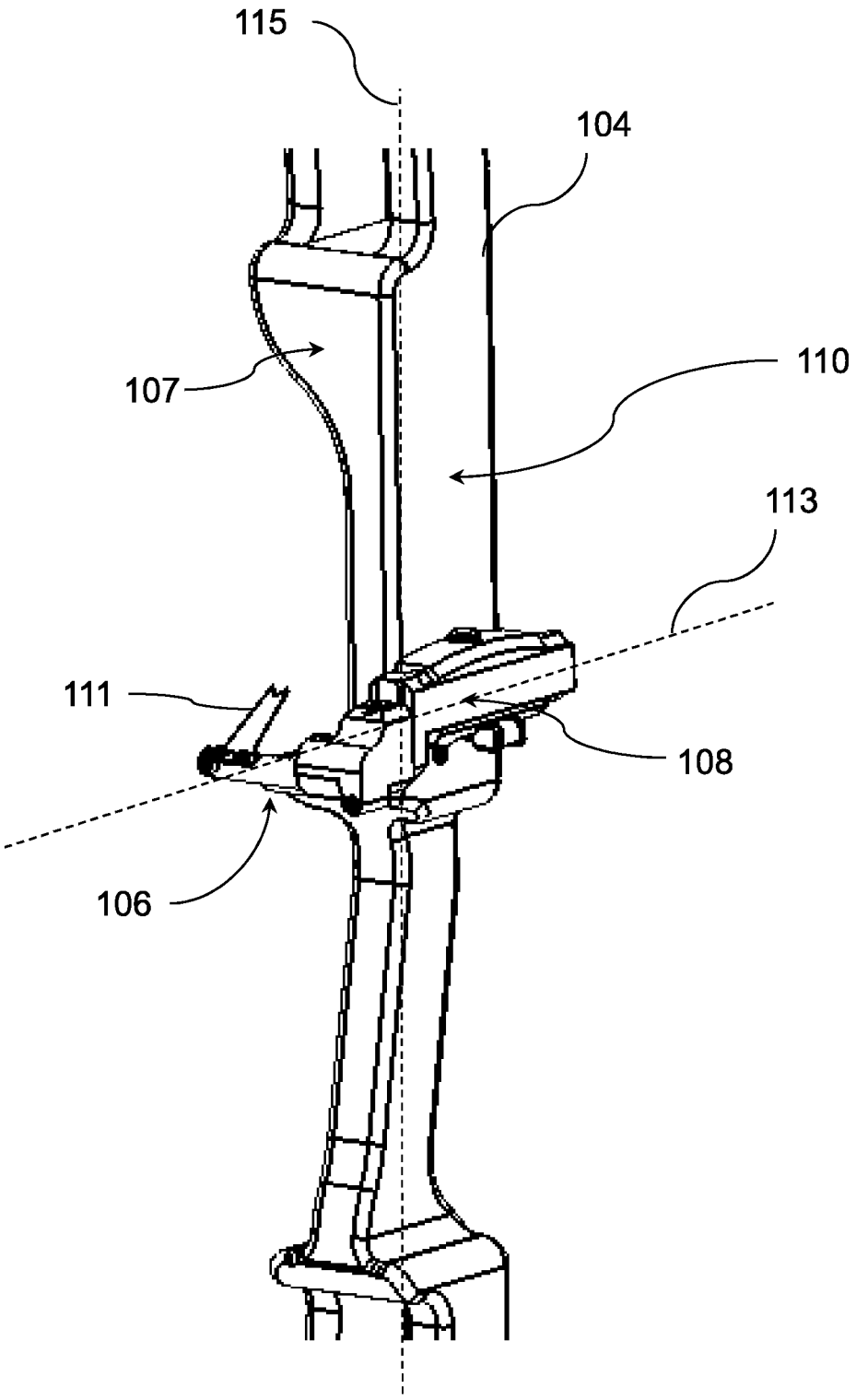
FIG. 4 is an enlarged view of the archery bow of FIG. 3, showing the arrow rest and mounting system coupled to the archery bow.

Referring to FIG. 1, when the bow 102 is positioned for operation, the front face 100 of the bow 102 faces in a forward or shooting direction 150 toward a target 153 that extends upright in a target plane 156. The rear face 107 of the bow 102 is positioned facing the archer, in a rearward direction 151 opposite the shooting direction 150. The riser 104 additionally includes a plurality of side surfaces 110. As shown in FIG. 4, in an example, the arrow rest mounting system 108 can be coupled to a side surface 110 of the bow riser 104.

Figure 3:
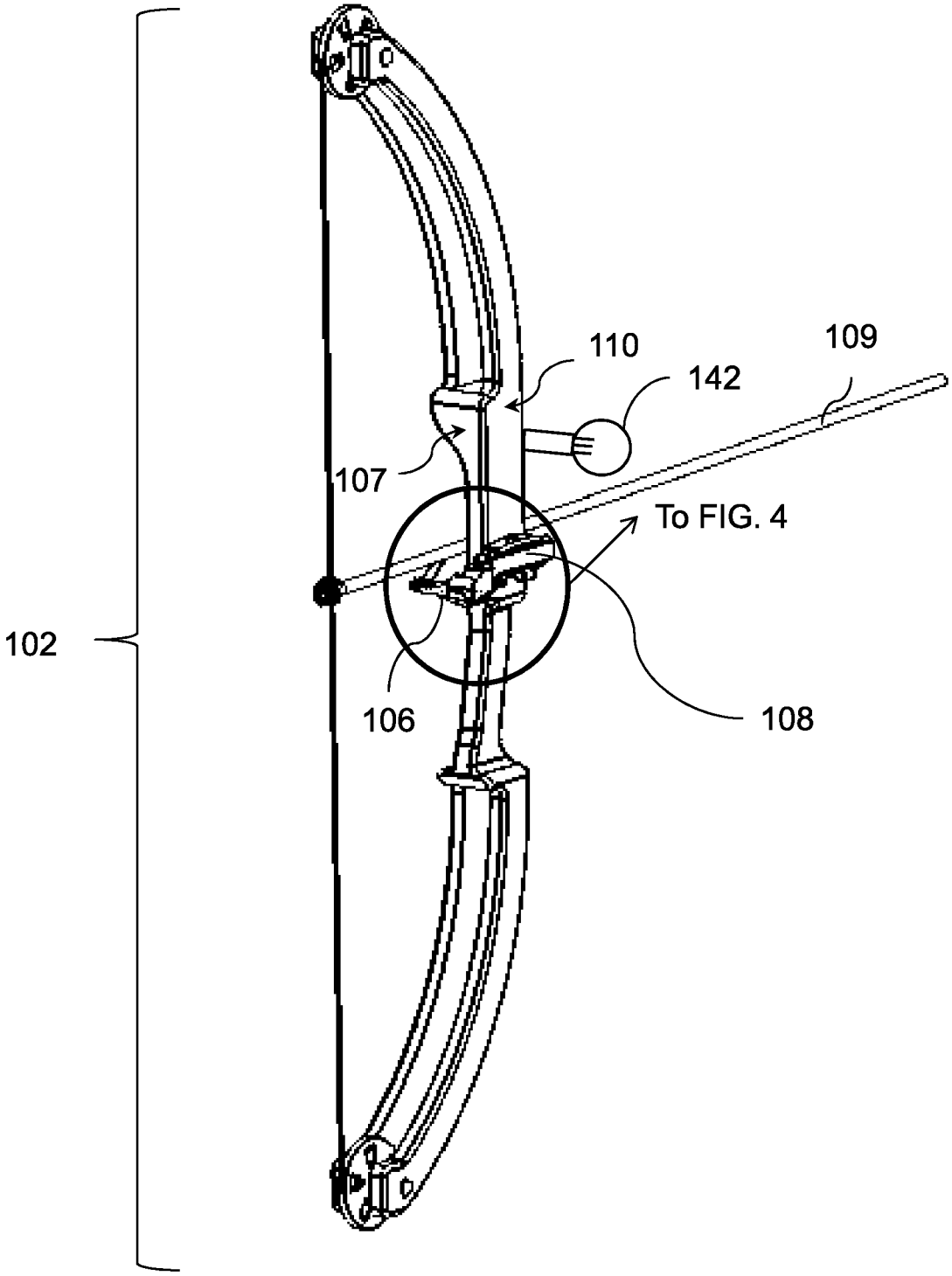
FIG. 3 is rear isometric view of the archery bow of FIG. 2.

In an example illustrated in FIGS. 3-4, the arrow rest 106 is coupled to the arrow rest mounting system 108 such that the arrow holder 111 holds the arrow 109 to direct the arrow 109 toward the target. The arrow 109 extends in an arrow plane that intersects with the target plane 156. In this embodiment, when the arrow rest mounting system 108 is coupled to the riser 104 and the bow 102 is in the operational, upright or vertical position, the arrow rest 106 is offset to the right or left of the arrow rest mounting system 108. This offset position locates the arrow rest 106 into the user's field of vision or aiming zone to facilitate shooting.

Figure 5:
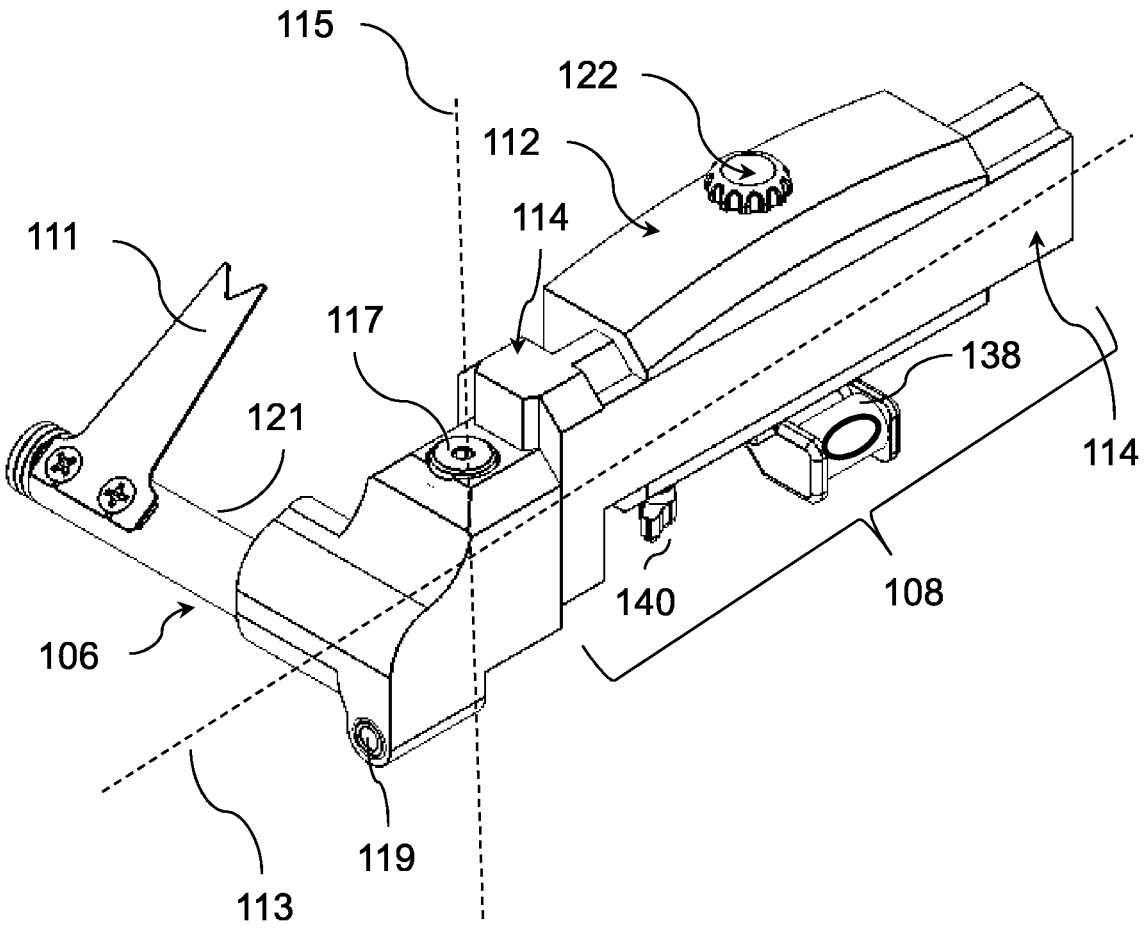
FIG. 5 is an isometric view of an embodiment of an arrow rest mounting system.
Figure 8:
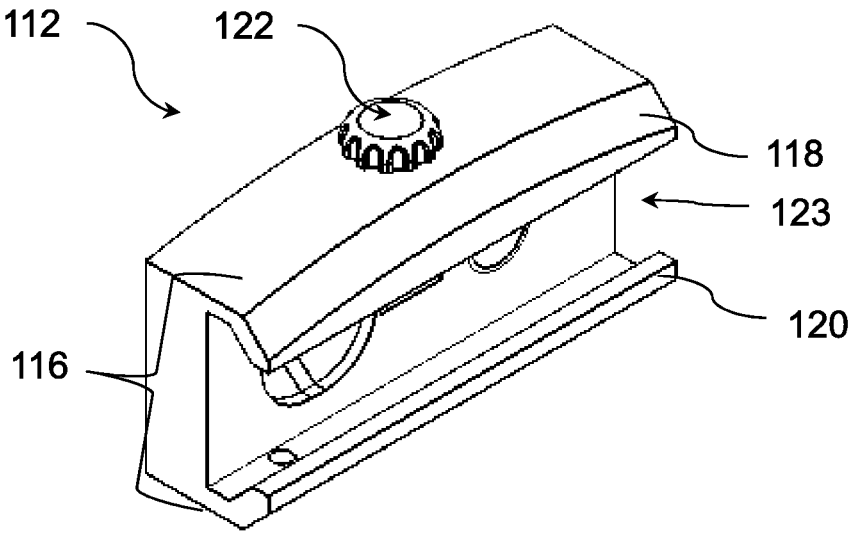
FIG. 8 is an isometric view of an embodiment of a main body of the arrow rest mounting system of FIGS. 5-7.
Figure 9:
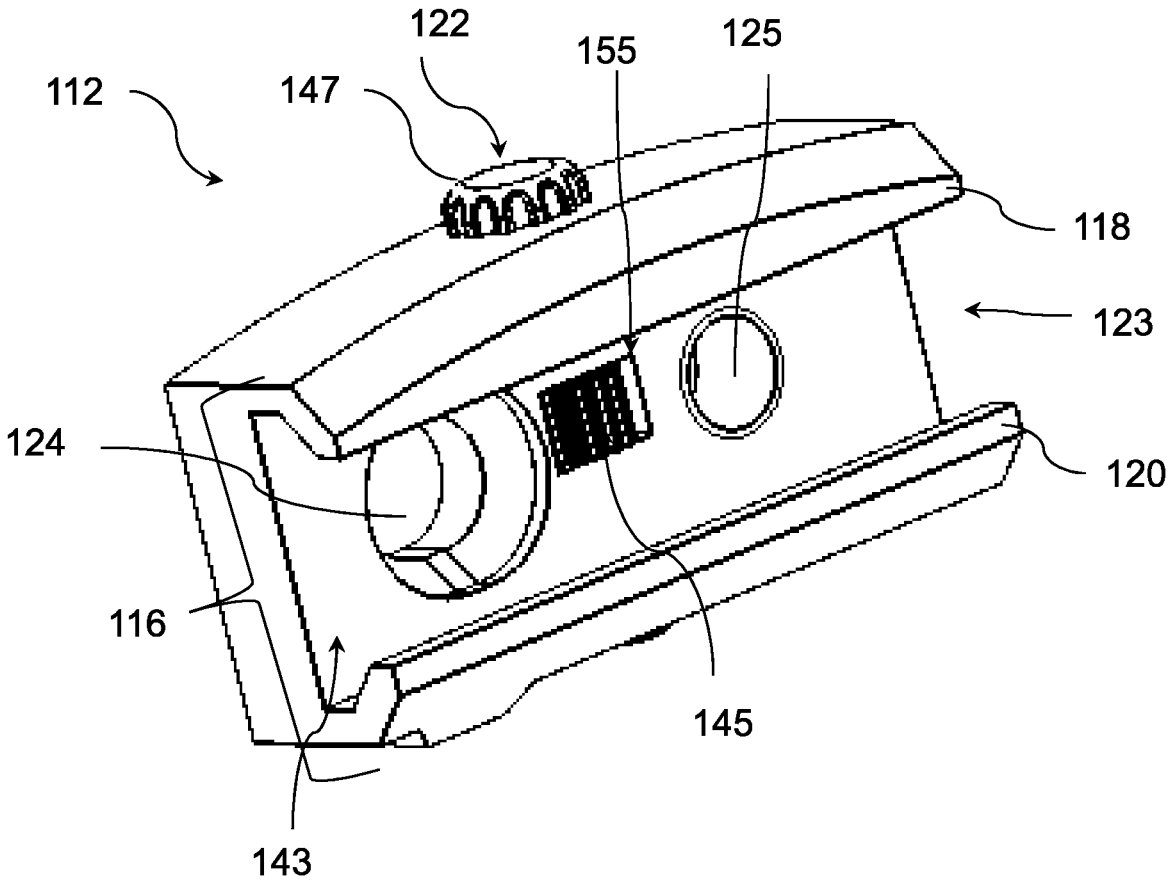
FIG. 9 is another isometric view of the main body of FIG. 8.
Figure 10:
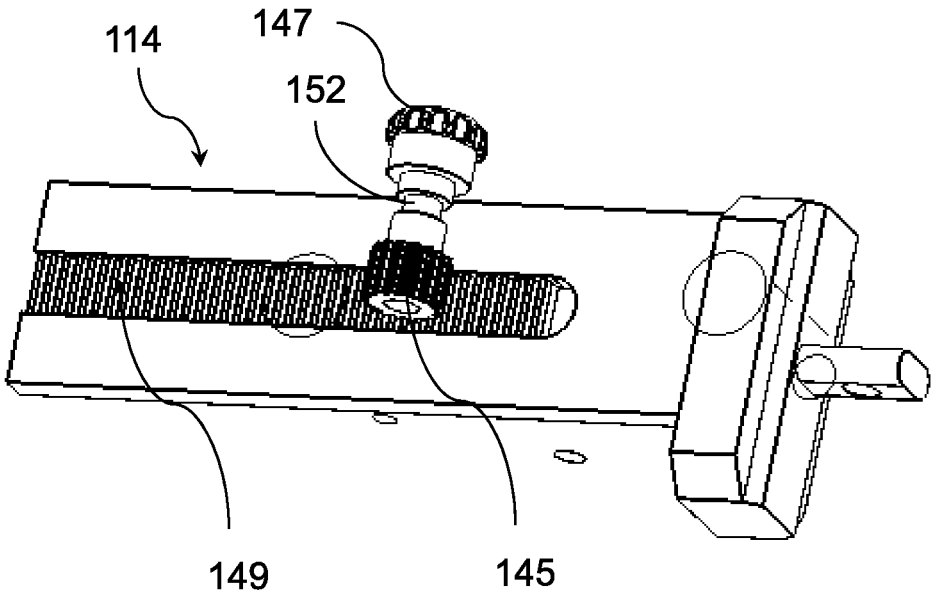
FIG. 10 is an isometric view of an embodiment of an arm of the arrow rest mounting system of FIGS. 5-7.

Referring to FIG. 5, in an embodiment, the arrow rest mounting system 108 includes a body or main body 112 and an arm 114. The main body 112 is configured to mount and couple to the side surface 110 of the bow riser 104. Referring to FIGS. 8-10, in an embodiment, the main body 112 includes an arm engager 116 that engages and receives the arm 114. In an example, the arm engager 116 movably or slidably engages, and cooperates with, the arm 114, and the arm engager 116 includes a first slide guide or first lip 118 and a second slide guide or second lip 120 that collectively act to retain, guide and hold the arm 114. Lip 118 is downwardly tapered, and lip 120 is upwardly tapered. The tapering of the lips 118, 120 enables the arm engager 116 to retain and guide the arm 114 in its fore-aft movement along the main body axis 113 (FIGS. 4-5), which generally extends in directions 150 and 151 when the arrow rest mounting system 108 is coupled to the riser 104 and intersects with the target plane 156 when the archery bow 102 is aimed at the target 153. In addition, the first lip 118 and second lip 120 inhibit rotation of the arm 114 relative to the archery bow 102 during fore-aft slide movement of the arm 114. As illustrated in FIGS. 9-10, the arm engager 116 includes an arm engagement surface 143 which defines a gear slot 155 configured to expose a pinion or driver gear 145 of driver 122 as described below. As further described below, the driver gear 145 engages with the gear rack 149 of the arm 114.

In an example, the main body 112 additionally includes a position adjuster or driver 122 that adjusts the fore-aft position of the arm 114 relative to the main body 112. The driver 122 includes a rotatable hand grasp or knob 147 coupled to a driver shaft 152 which, in turn, is coupled to the driver gear 145. The pinion or driver gear 145 engages with the arm gear rack 149 of the arm 144 (FIG. 10), as described below. When the user rotates the knob 147, the pinion or driver gear 145 engages with the arm 114 so as to drive the arm 114. Depending upon whether the knob 147 is rotated clockwise or counterclockwise, the arm 114 moves in the forward or fore direction 150 or in the rearward or aft direction 151 along the fore-aft or main body axis 113 (FIG. 4).

In an example, the driver 122 performs an incremental or micro mechanized adjustment of the arm 114 along fore-aft or main body axis 113 (FIGS. 4-5). The degree of incremental control is based on the size and configuration of the gear teeth members of the driver gear 145 and the arm gear rack 149. Due to this incremental adjustment, the arm 114, and the arrow rest 106 coupled to the arm 114, can be precisely positioned in a mechanized, measured and controlled fashion. In an embodiment, before performing such mechanized adjustment, the user can perform a macro manual adjustment to the position of the arrow rest 106 by grasping and manually pushing or pulling the arm 114 relative to the arm engager 116. In an embodiment, the driver 122 includes one or more springs coupled to the driver shaft. The springs urge the driver 122 in a predisposed position or assist in securing the driver 122 in a finalized position set by the user.

In an embodiment, the driver 122 includes an electrically-powered actuator operable to automatically or semi-automatically move the pinion or driver gear 145. Depending upon the embodiment, such actuator can include a motor or an electromagnetic device. In addition, such actuator includes a battery operable to provide electrical power. In an embodiment, such an electrical driver 122 has a microprocessor coupled to a transceiver or antenna operable to wirelessly send and receive signals with communication or control devices, such as smart phones. In such embodiment, the present disclosure includes a smart phone software application enabling the user to input desired settings for the fore-aft and/or vertical positions of the arrow rest mounting system 108 relative to the bow 102. When the user inputs a command through the smart phone software application, such as Rest Position A, the processor causes the driver 122 to automatically bring the arrow rest mounting system 108 to the position associated with Rest Position A.

Figure 6:
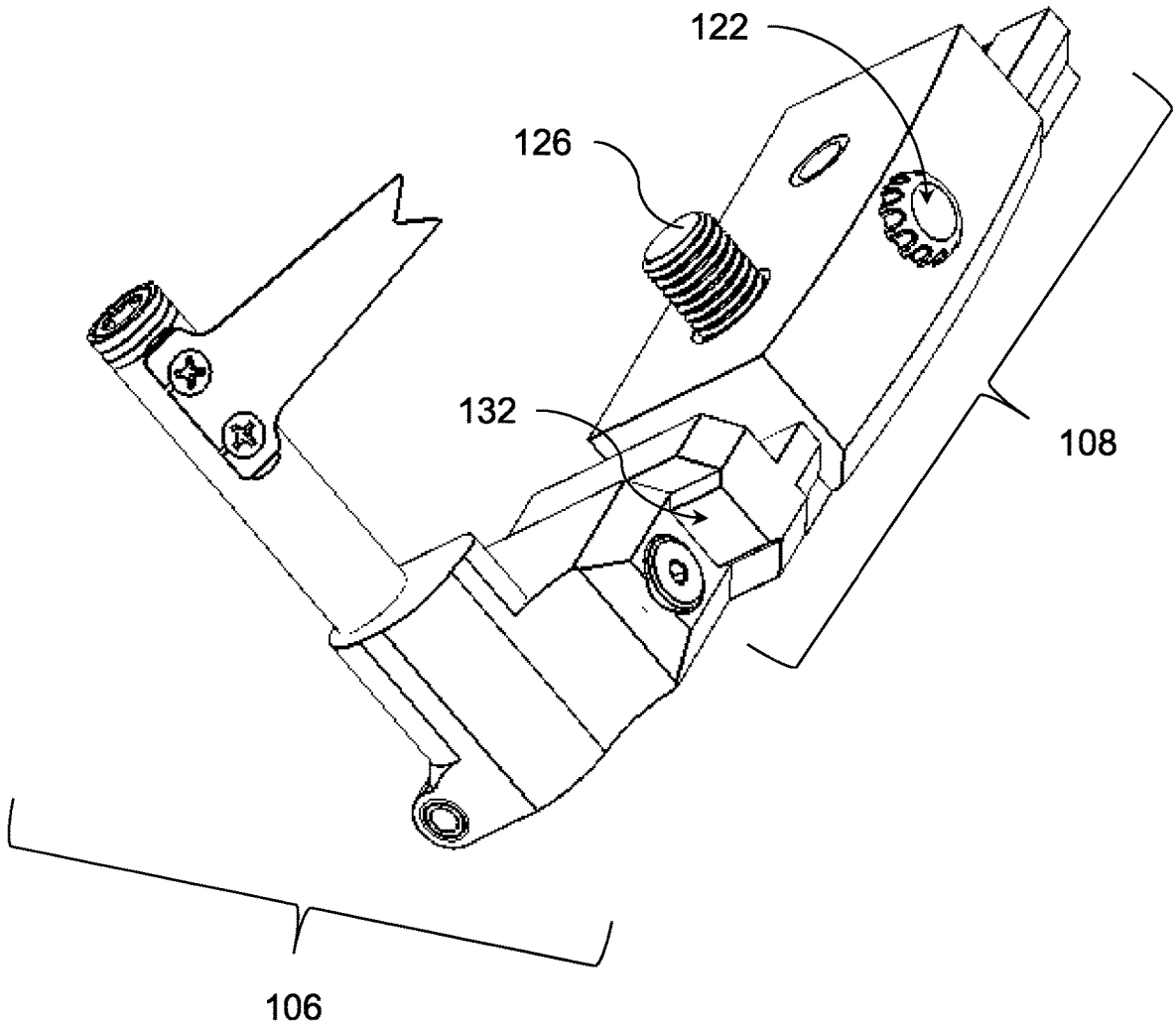
FIG. 6 is a top isometric view of the arrow rest mounting system of FIG. 5

In an embodiment illustrated in FIGS. 6 and 9, the main body 112 includes or defines an opening or a mounting bore 124 that penetrates through the main body 112 perpendicular to the arm engagement surface 143. The mounting bore 124 can receive a screw, bolt or other fastener 126 (FIG. 6) for coupling the main body 112 to the bow riser 104. For example, the mounting bore 124 can be a threaded or non-threaded bore, and the fastener 126 can be a threaded fastener, such as a screw. In the embodiment where the mounting bore 124 is non-threaded, and the associated mounting hole 135 in the bow 102 (FIG. 1) is threaded.

In an embodiment illustrated in FIG. 9, the main body 112 also includes or defines an opening or pivot-stopping bore 125 that penetrates through the main body 112 perpendicular to the arm engagement surface 143. The pivot-stopping bore 125 is configured to receive a pin, screw, set screw, bolt or other suitable fastener (not shown). During installation, the user inserts fastener 126 (FIG. 6) through mounting bore 124 and screws fastener 126 into the mounting hole 135 (FIG. 1) of the bow 102. Next, the user inserts a fastener such as a set screw (not shown) through the pivot-stopping bore 125 (FIG. 6) and screws it into the threaded bore 125. Eventually, the set screw presses against the side 110 of the bow 102 to help fixedly secure the main body 112 on the bow 102. In an alternate embodiment, the user can insert a screw through a non-threaded bore 125 until entering into a supplemental threaded hole 137 (FIG. 1) of the bow 102. The user can tighten such screw to help fixedly secure the main body 112 to bow 102. Based on this multi-fastener approach, the main body 112 retains its fixed angular position, without pivoting, relative to the bow 102.

It should be appreciated that: (a) the mounting bore 124 can be non-threaded, slot-shaped, elongated or otherwise substantially larger than the screw fastener 126; or (b) the pivot-stopping bore 125 can be non-threaded, slot-shaped, elongated or otherwise substantially larger than the fastener that it receives. This configuration can enable the user to insert the fasteners and rotate the main body 112 to the desired angular position before fully tightening the fasteners. In doing so, the user can refer to the leveler 138 (FIG. 5). For example, the user may desire to set an angular position wherein the main body axis 113 of the main body 112 is perpendicular to a vertical axis 115 (FIG. 5). The vertical axis 115 extends substantially along the longitudinal axis of the riser 104. In another example, the user may desire to set an angular position wherein main body axis 113 of the main body 112 is oriented at an angle of one hundred degrees relative to the vertical axis 115. Once set and tightened at the desired angle, the main body axis 113 is fixed relative to the vertical axis 115.

Figure 11:
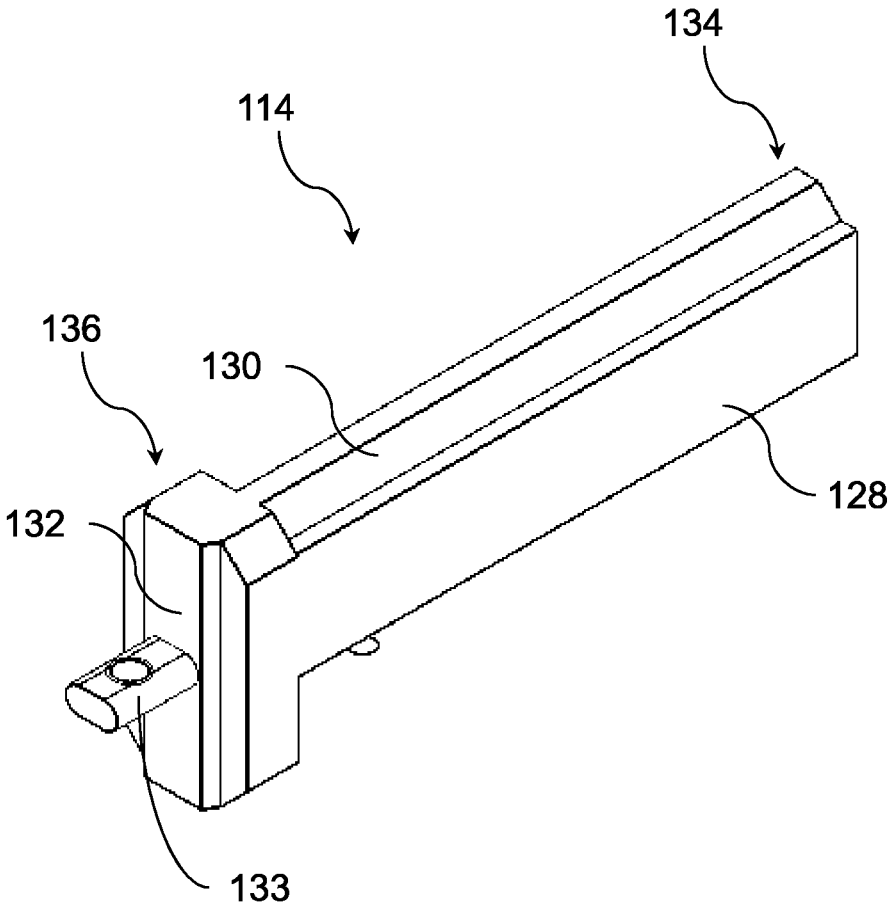
FIG. 11 is another isometric view of the arm of FIG. 10.
Figure 12:
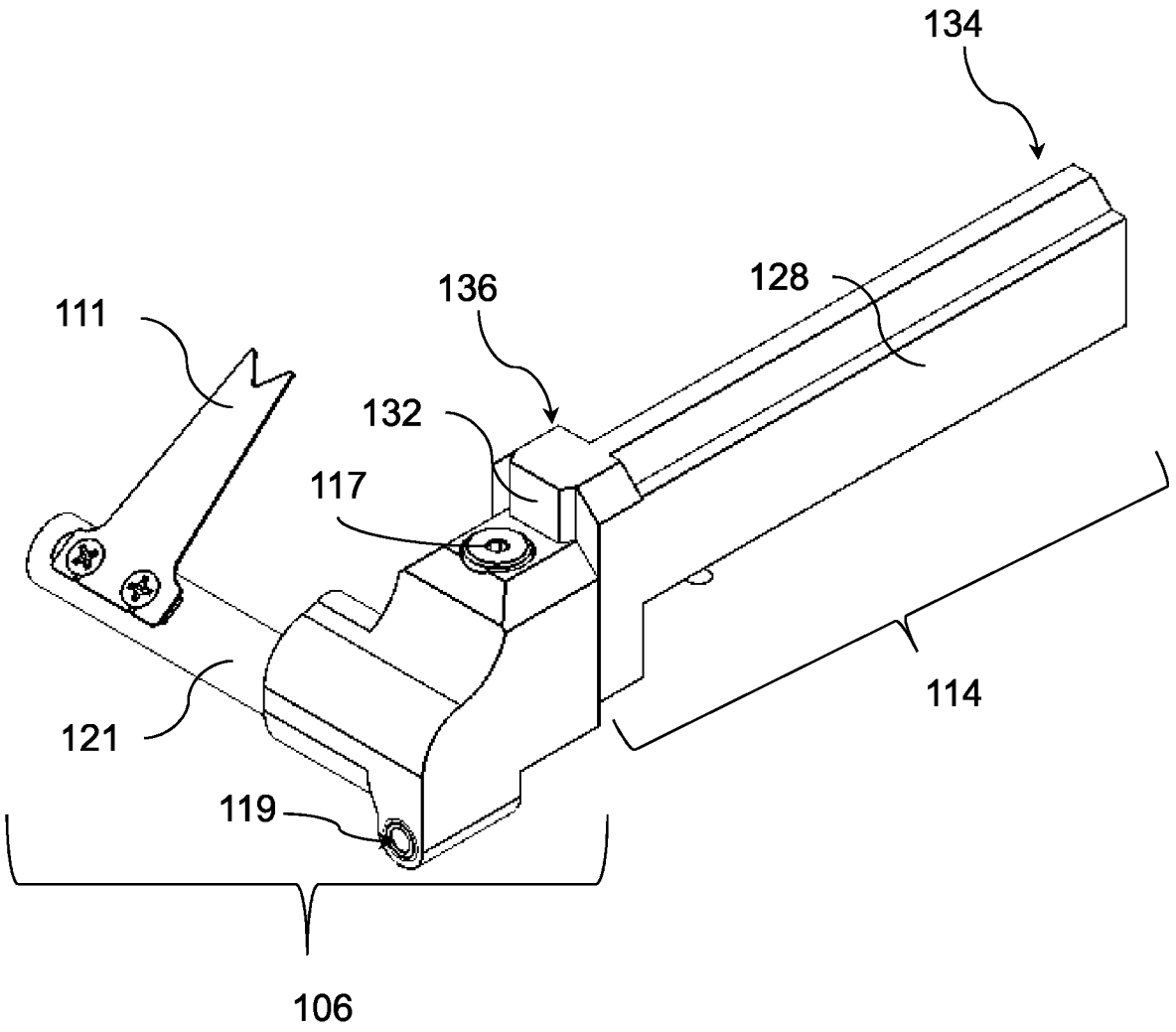
FIG. 12 is an isometric view of the arm of FIGS. 10-11, showing an embodiment of an arrow rest coupled thereto.

Referring to FIGS. 11-12, the arm 114 includes an arm structure 128. In an example, the arm structure 128 includes a main body engagement surface 130. For example, the main body engagement surface 130 can be shaped to engage the first and second lip 118, 120 in order to engage the arm engager 116 (FIG. 8). By engaging the first and second lips 118, 120, the arm 114 is held by, and slidably engages, the arm engager 116. In an example, a first end 134 of the arm structure 128 is inserted into the arm cavity 123 (FIG. 8) defined by the lips 118, 120 of the main body 112. In response to the driving force of driver 122, the arm structure 128 moves in a fore-aft direction along main body axis 113 relative to the main body 112.

Referring to FIGS. 11-12, the arm 114 also includes an arrow rest support 132 connected to the arm structure 128. In an example, the arrow rest support 132 is connected to a second end 136 of the arm structure 128. The arrow rest 106 can be coupled to the arrow rest support 132 in any suitable manner. For example, the arrow rest support 132 can receive a fastener (not shown) that couples the arrow rest 106 to the arrow rest support 132. In another example, the arrow rest 106 is coupled to a coupler or projection 133 extending from the arrow rest support 132.

As illustrated in FIGS. 5 and 12, in an embodiment, the arrow rest 106 includes a vertical position adjuster 117. By rotating or otherwise operating the vertical position adjuster 117, the user can change the up/down or vertical position of the arrow rest 106 relative to the arm 114. In operation, the vertical position adjuster 117 causes the arrow rest 106 to move along the vertical axis 115. Also, the arrow rest 106 includes a rest shaft adjuster 119 coupled to the arrow holder 111. The rest shaft adjuster 119 is operable to adjust the rotational position of the rest shaft 121. The rest shaft adjuster 119 enables the user to adjust the angle at which the arrow holder 111 extends relative to a vertical axis or target plane 156 (FIG. 1). In an embodiment, the rest shaft adjuster 119 also enables the user to adjust the level of resistance conveyed by the rest shaft 121 in response to a forward shooting force of the arrow 109.

Figure 7:
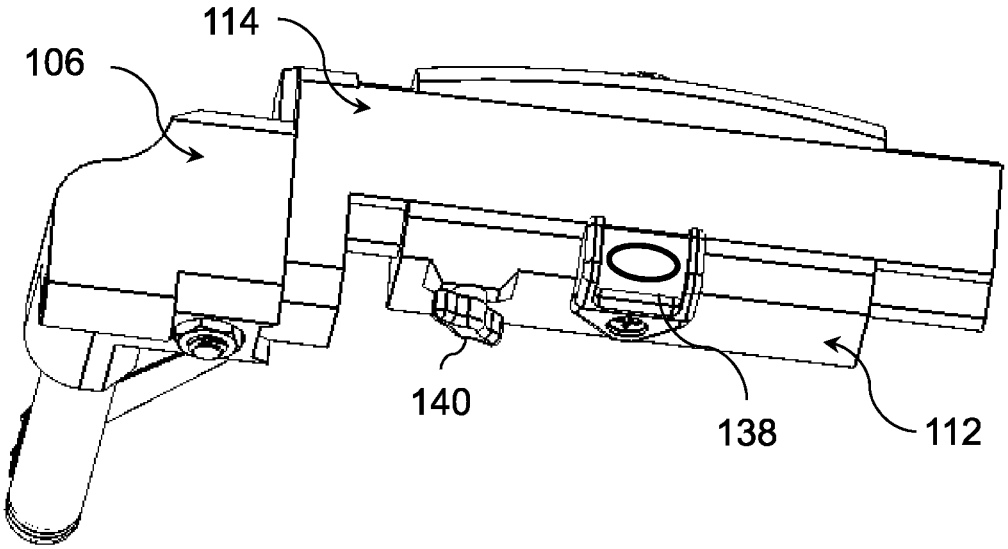
FIG. 7 is bottom view of the arrow rest mounting system of FIGS. 5-6.

Referring back to FIGS. 5 and 7, a level indicator 138, such as a bubble level indicator, can be coupled to the mounting system 108. In an example, the level indicator 138 is coupled to the main body 112 to facilitate the angular positioning of the main body 112 on the bow riser 104. Additionally, in an example, the main body 112 includes a position retainer or locking device 140 (FIG. 5), such as a latch or wing nut, for locking the arm 114 in position relative to the main body 112. The locking device 140 enables the user to secure the arm 114 in the desired fore-aft position after having used the driver 122 to reach the desired fore-aft position on main body axis 113. Accordingly, the locking device 140 prevents or reduces fore-aft misalignment due to future vibrations or forces caused by shooting or transport of the bow 102.

As described above, the main body 112 is coupled to the bow riser 104, and the arm 114 engages the arm engager 116 of the main body 112. When the bow 102 is not in use, such as held in storage or being shipped, the arm 114 can be fully disengaged from the arm engager 116. At that point, the arm 114, whether or not coupled to the arrow rest 106, can be transported or stored separately from the bow 102. In this example, the main body 112 remains coupled to the bow 102, thus preserving the adjusted, desired angular position of the main body 112 relative to the bow 102. When the bow 102 is again used, the user inserts the arm 114 into the main body 112. At that point, the arm 114, when engaged with the main body 112, is automatically set at the desired, original angular position setting relative to the vertical axis 115 or longitudinal axis of the bow 102. For example, if the user had previously mounted the main body 112 so that its fore-aft or main body axis 113 is perpendicular to the vertical axis 115, the arm 114 would assume such same position, extending along such main body axis 113. If, in another example, the user had previously mounted the main body 112 so that its main body axis 113 is angled ninety-five degrees relative to the vertical axis 115, the arm 114 would assume such same angular position, extending along such angled main body axis 113.

By referring to the measurement markings described below, the user can return the arm 114 to the same fore-aft position along the main body axis 113 without the need to adjust the rotational or angular position of the arm 114 relative to the bow 102. Thus, the combined angular and fore-aft positions of the arrow rest mount 108, and thus the arrow rest 106, are reliably and conveniently repeatable.

During the shooting process, the bow 102 can be subject to torque acting along the longitudinal axis of the bow 102, causing an archery sight 142 (FIG. 3) to move in one direction and the arrow rest 106 to move in the opposite direction. This torque can negatively affect the use of the sight 142 and arrow rest 106, impairing shooting accuracy. Torque tuning can be employed to reduce or negate the effects of torque when operating the bow 102. For example, to compensate for such torque effects, the user can position the arrow rest 106 in the optimal position relative to the arrow sight 142, developing a "sweet spot" for the particular user. In this spot, or relative positioning between the sight 142 and rest 106, the torque-based movement of the arrow rest 106 and the archery sight 142 cancel each other out, thus reducing or negating the effects of torque on shooting accuracy.

The method for performing this adjustment includes mounting the arrow rest 106 to the bow riser 104 using the mounting system 108. The position of the arrow rest 106 is adjusted, such as incrementally adjusted with the position adjuster 122, along the main body axis 113 that extends toward a target of the archery bow 102 in a shooting direction 150. The archery sight 142 (FIG. 1) is also mounted to the bow riser 104 via an archery sight support. The position of the archery sight 142 is adjustable relative to a sight axis that extends toward the target when the archery sight support is mounted to the bow riser 104 and the bow 102 is aimed at the target. The position adjuster 122 adjusts the position of the arrow rest based on the position of the arm 114 relative to the position of the archery sight 142 until the preferred, "sweet spot" is reached. In an example, using the markings described below and the maintained, angular position of the main body 112 on the bow riser 104, the arrow rest 106 can be positioned (up/down and/or fore-aft) to reach the "sweet spot" during each shooting session without requiring potentially tedious, manual readjusting of all of the variable positions of the arrow rest 106 at the beginning of each session.

FIGS. 13-35 illustrate another embodiment of an arrow rest mounting system 160. The mounting system 160 includes a body 162 and an arm 164. The body 162 is configured to mount and couple to a side surface 110 of the archery bow 102 described above. Referring to FIGS. 21-30*c*, the body 162 includes a bow engagement surface 165 defining a bore 166 that receives a bow engager or fastener 168 to couple the body 162 to the bow 102.

Figure 21:
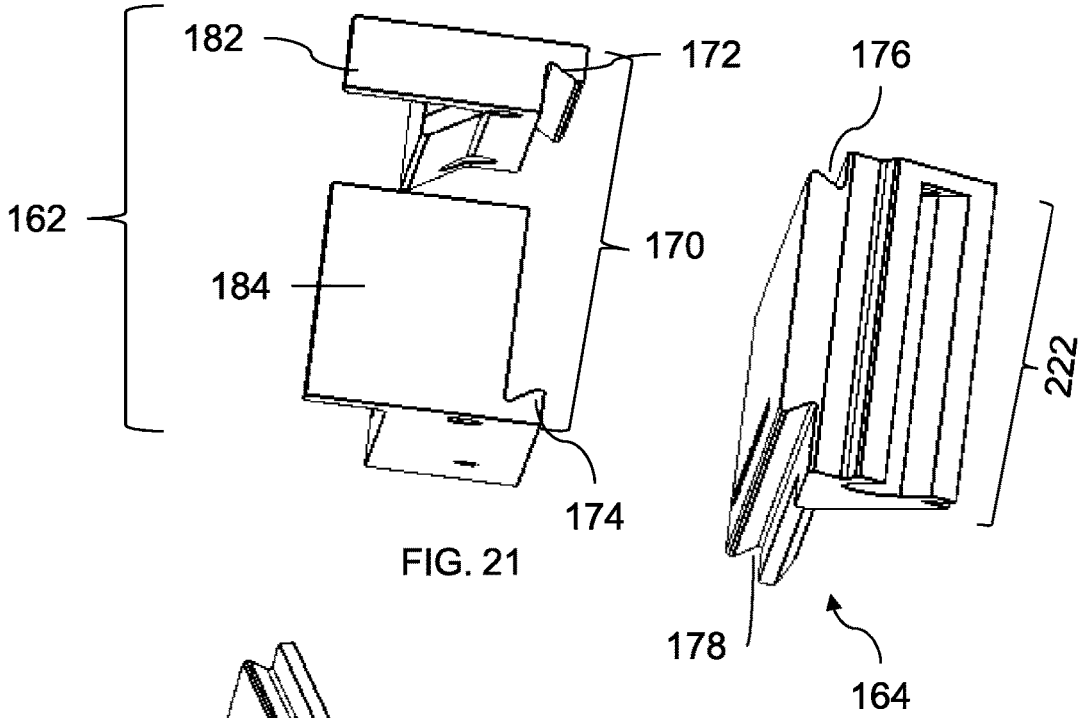
FIG. 21 is an exploded bottom isometric view of an embodiment of a body and arm of the arrow rest mounting system of FIGS. 13-17.
Figure 22:
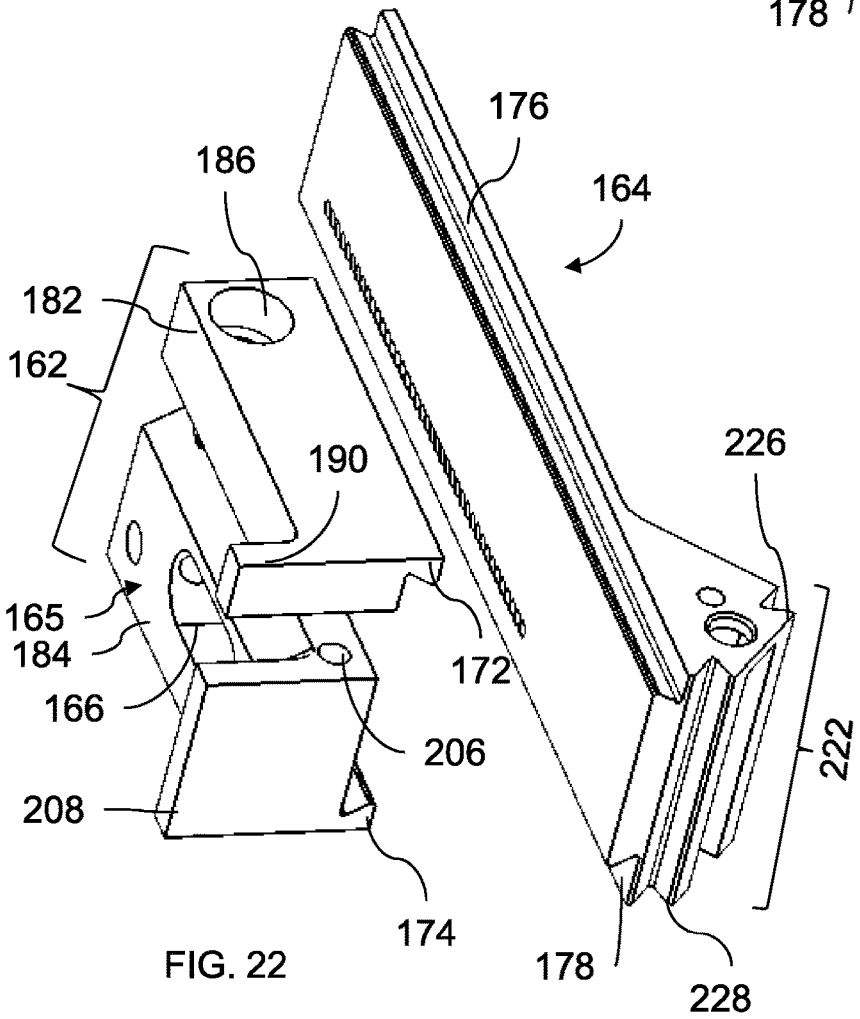
FIG. 22 is an exploded top isometric view of the body and arm of FIG. 21.
Figure 23:
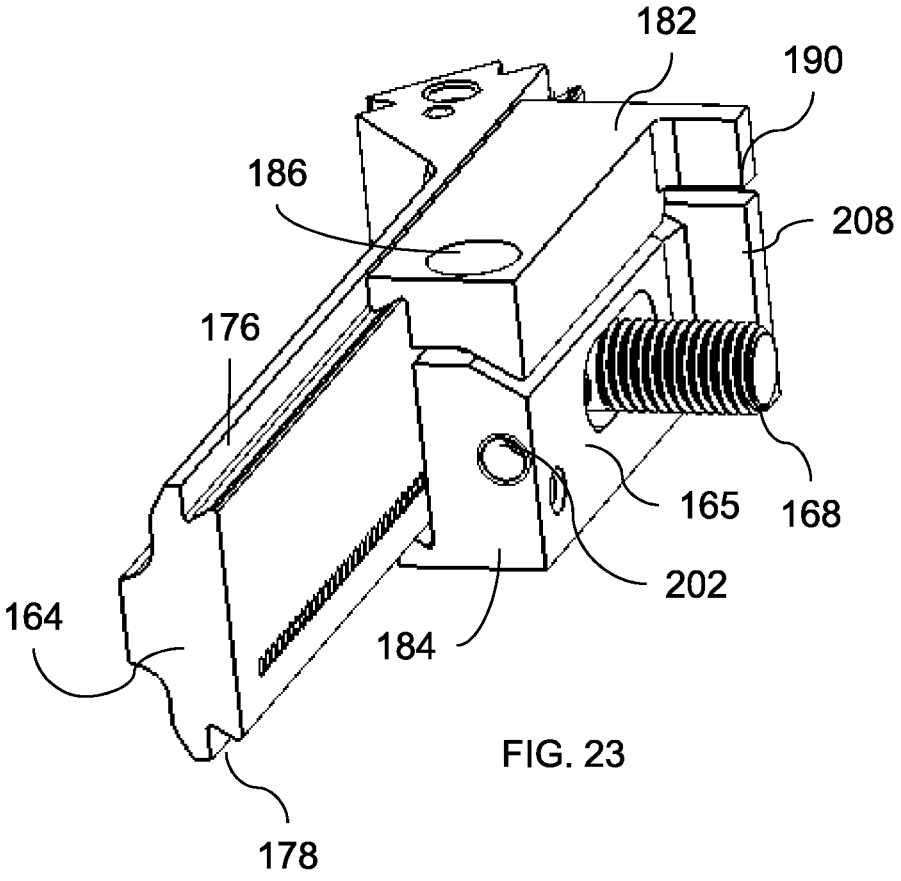
FIG. 23 is an isometric view of the body and arm of FIG. 22, shown assembled.
Figure 24:
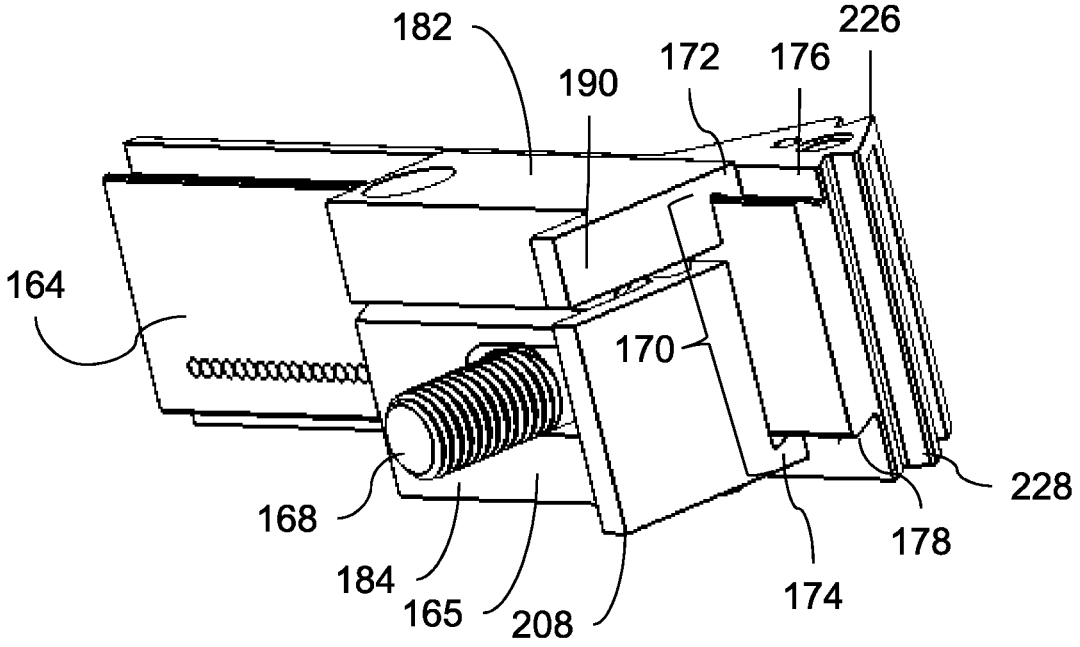
FIG. 24 is another isometric of the assembled body and arm of FIG. 23.
Figure 25:
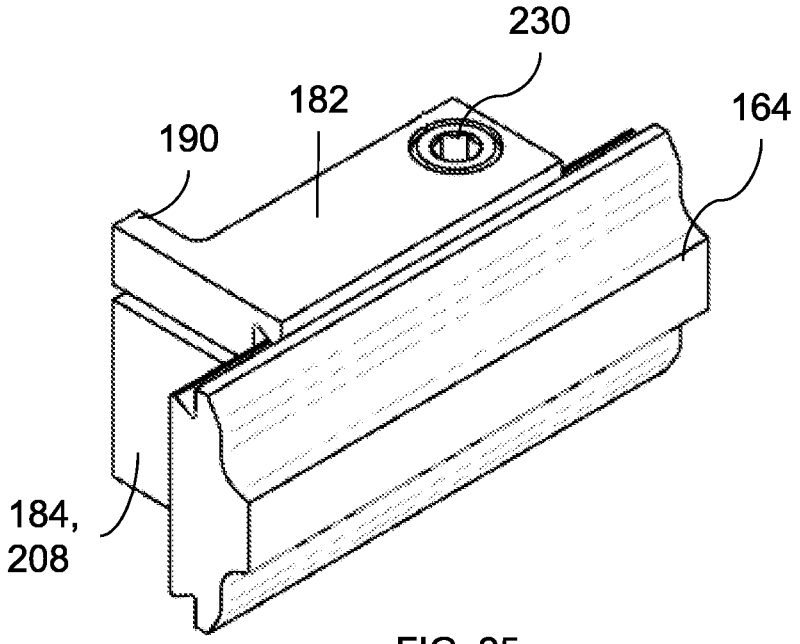
FIG. 25 is another isometric view of the assembled body and arm of FIGS. 23-24.

The body 162 includes a multi-part arm engager 170 that engages and receives the arm 164. In an example, the multi-part arm engager 170 movably or slidably engages, and cooperates with, the arm 164, and the multi-part arm engager 170 includes a first lip or first slide guide 172 and a second lip or second slide guide 174 that collectively act to retain, guide and hold the arm 164. As shown in FIGS. 21-23, the first slide guide 172 is downwardly tapered and shaped to be inserted into a first valley or track 176 of the arm 164. The second slide guide 174 is upwardly tapered and shaped to be inserted into a second valley or track 178 of the arm 164. The tapering of the slide guides 172, 174 enables the multi-part arm engager 170 to cooperate with the tracks 176, 178 of the arm 164 and retain and guide the arm 164 in its fore-aft movement along the main body axis 180 (FIG. 13), which intersects with the target plane 156 (FIG. 1) when the archery bow 102 is aimed at the target 153.

Figure 30A:
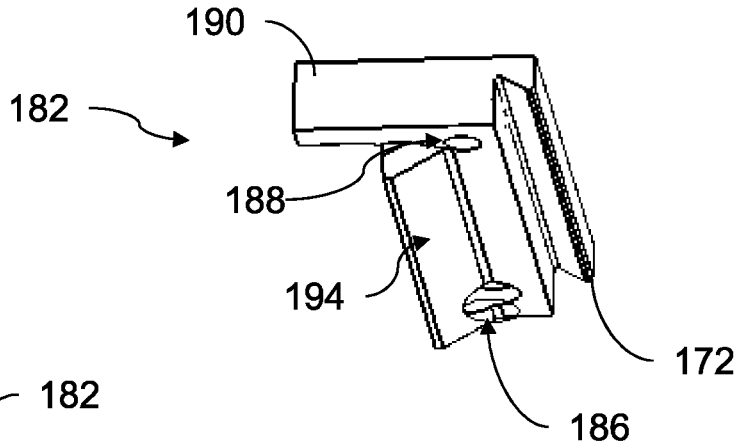
FIG. 30*a* is a bottom isometric view of an embodiment of a top body section.
Figure 30B:
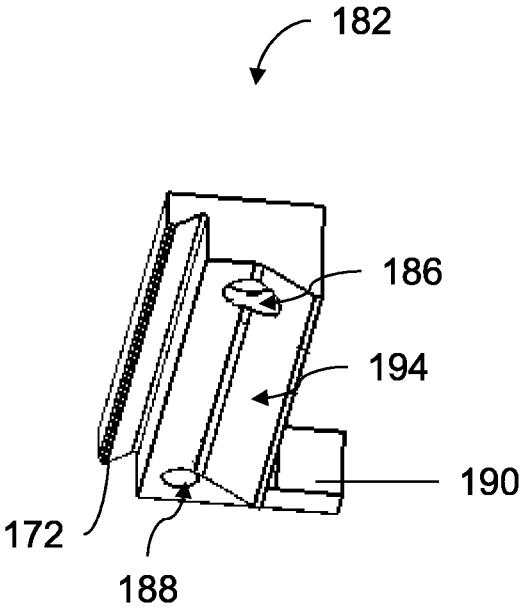
FIG. 30*b* is another bottom isometric view of the top body section of FIG. 30*a*.
Figure 30C:
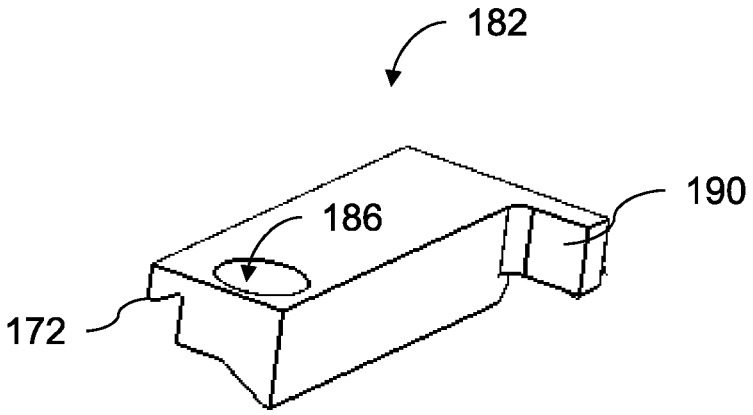
FIG. 30*c* is a top isometric view of the top body section of FIGS. 30*a*-30*b*.

In this embodiment, the body 162 includes a first body section 182 and a second body section 184. Referring to FIGS. 30*a*-30*c*, the first body section 182 includes the first slide guide 172. The first body section 182 has a first bore or opening 186 extending through the first body section 182 and a second bore 188 extending at least partially through the first body section 182, each extending substantially perpendicular to the body axis 180. A ledge or stabilizer 190 extends from the rear face 192 of the first body section 182. As will be further discussed below, the stabilizer 190 is configured to cooperate with the riser 104 of a bow 102 to prevent or inhibit rotation of the body 162. The bottom surface 194 of the first body section 182 is shaped to match and cooperate with a surface of the second body section 184.

Figure 29A:
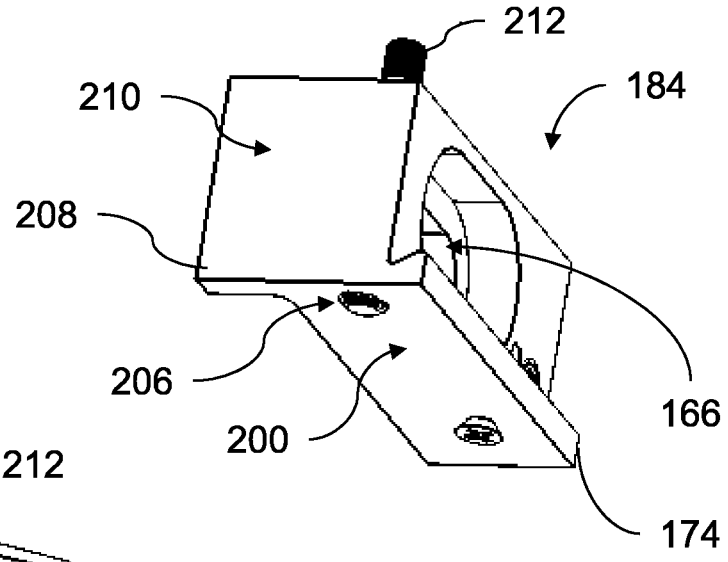
FIG. 29*a* is a bottom isometric view of an embodiment of a bottom body section and an alignment pin.
Figure 29B:
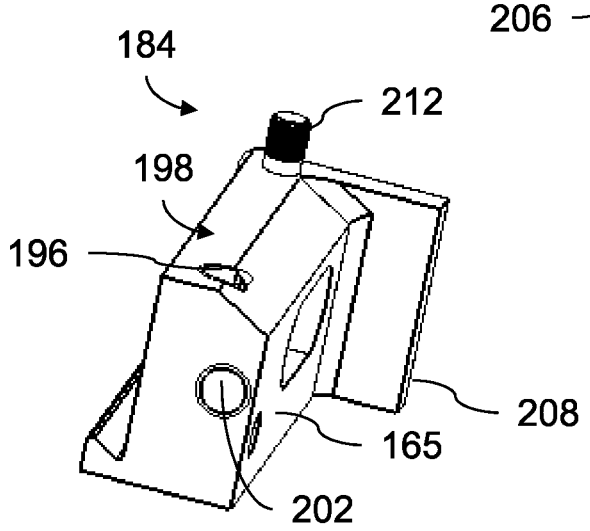
FIG. 29*b* is a top isometric view of the bottom body section and alignment pin of FIG. 29*a*.
Figure 29C:
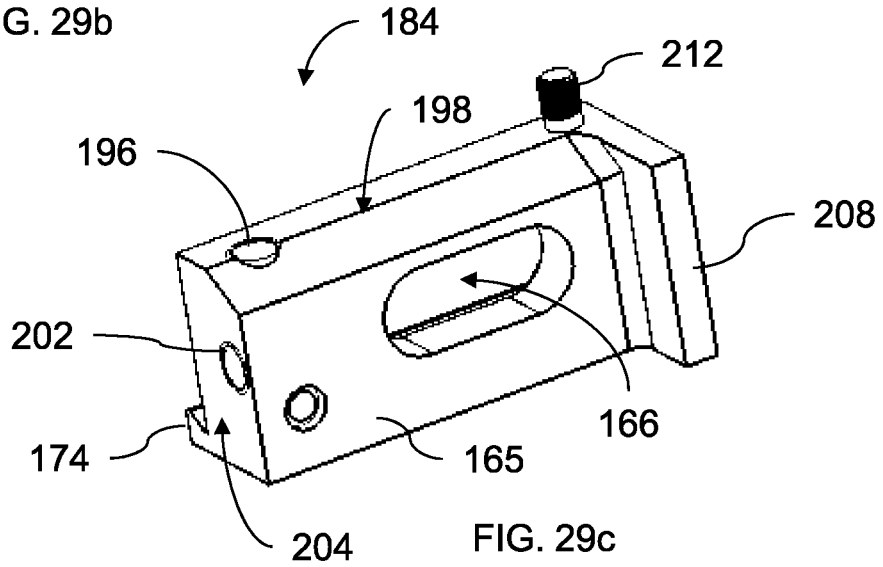
FIG. 29*c* is another top isometric view of the bottom body section and alignment pin of FIGS. 29*a*-29*b*.

Referring to FIGS. 29*a*-29*c*, the second body section 184 includes the second slide guide 174 and the bow engagement surface 165. In this embodiment, the bow engagement surface 165 defines the bore 166 or opening extending laterally through the second body section 184. Also, a vertical bore or opening 196 extends through the second body section 184 from the top surface 198 to the bottom surface 200. A horizontal bore or opening 202 extends partially through the second body section 184 from the front face or surface 204 of the second body section 184 to the bore 166. Another vertical bore 206 extends through the second body section 184 from the top surface 198 to the bottom surface 200. A ledge or stabilizer 208 extends from the rear face or surface 210 of the second body section 184. As will be further discussed below, an alignment pin 212 can be received or positioned in the vertical bore 206. The top surface 198 of the second body section 184 is shaped to correspond to the shape of the body surface 194 of the first body section 182.

Figure 13:
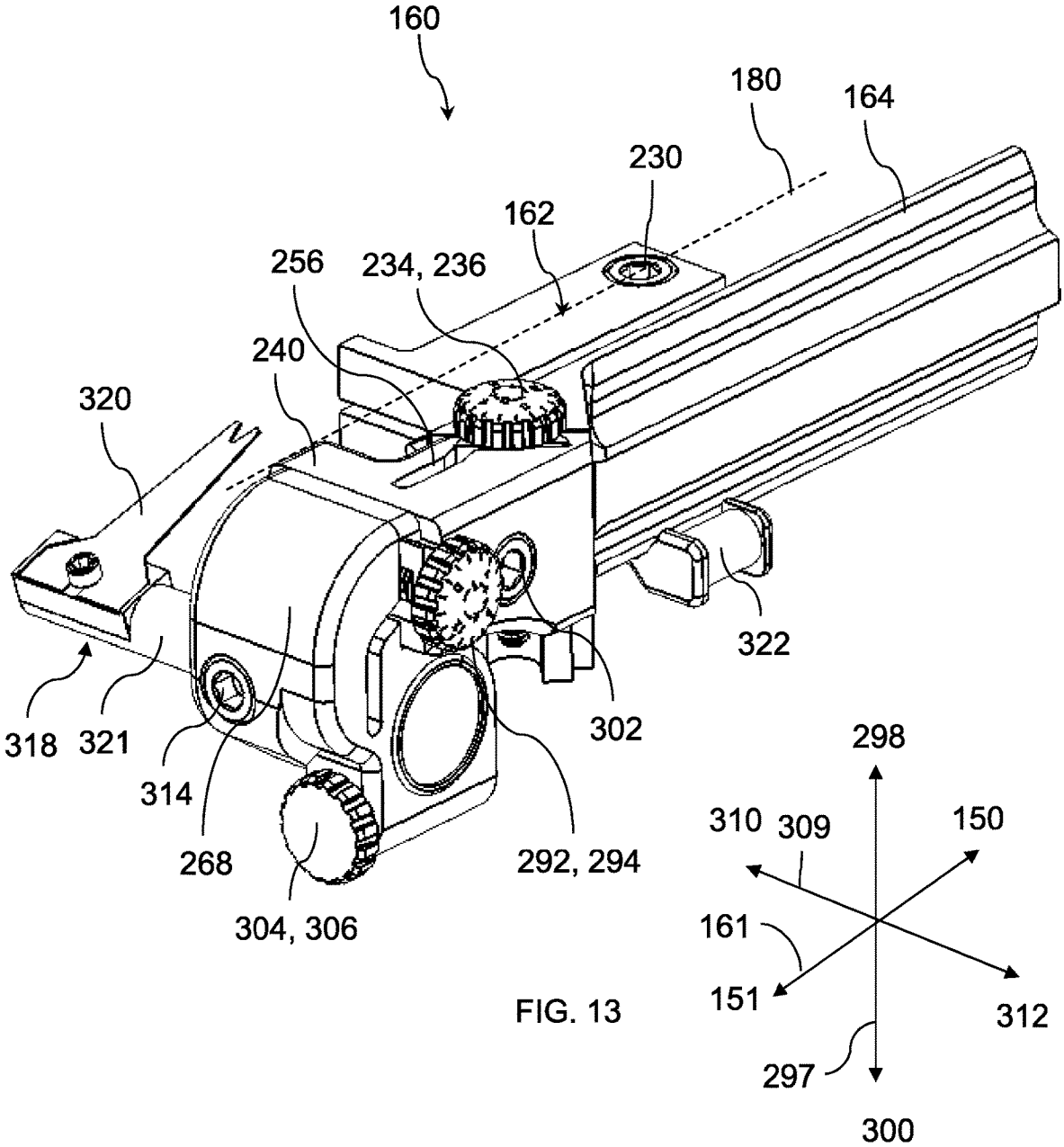
FIG. 13 is an isometric view of another embodiment of an arrow rest mounting system.
Figure 14:
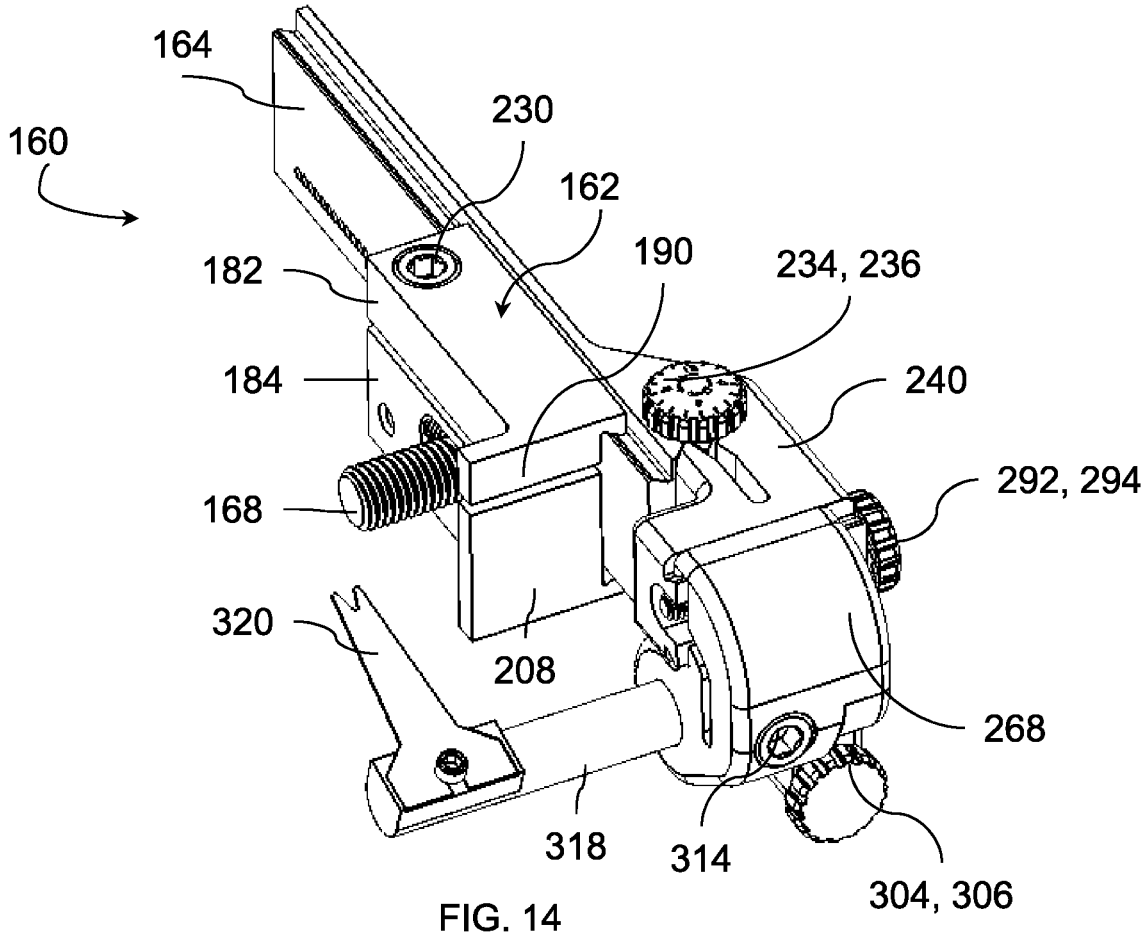
FIG. 14 is another isometric view of the arrow rest mounting system of FIG. 13.
Figure 15:
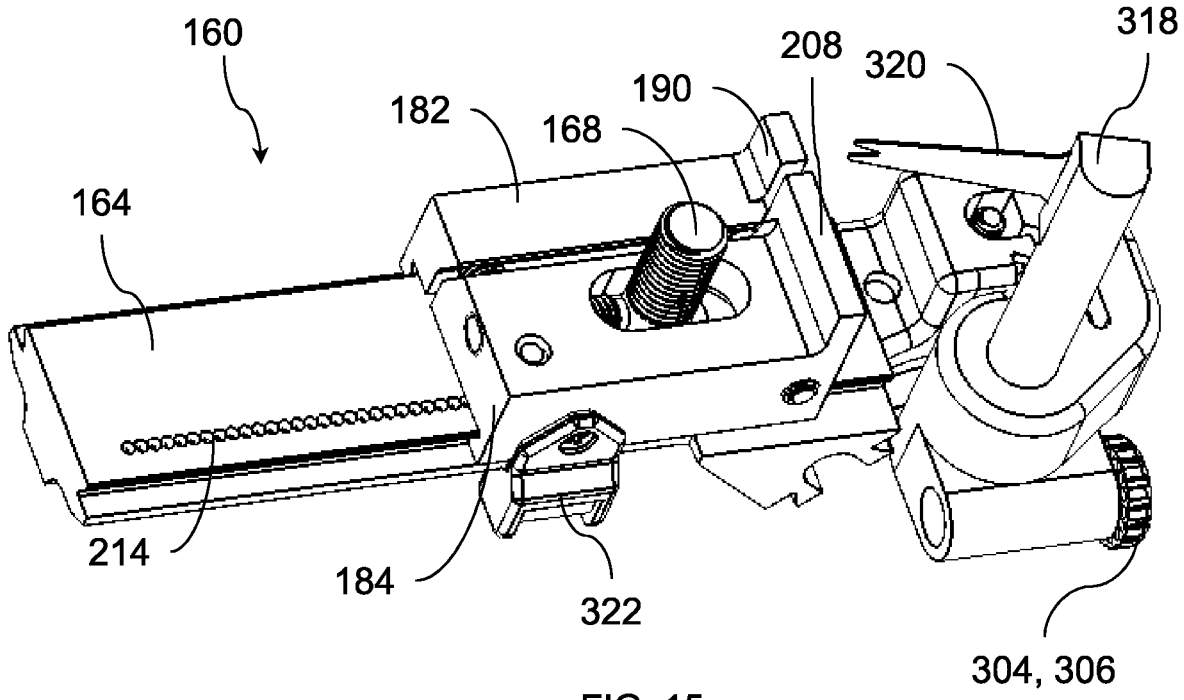
FIG. 15 is an isometric view of the arrow rest mounting system of FIGS. 13-14.
Figure 16:
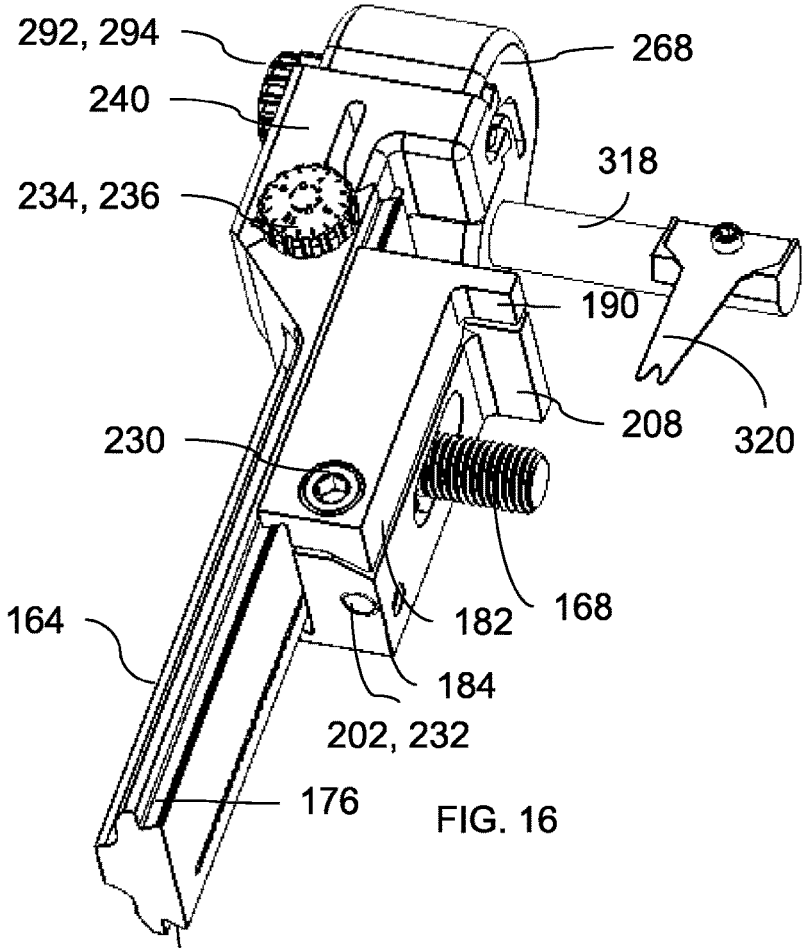
FIG. 16 is a top isometric view of the arrow rest mounting system of FIGS. 13-15.
Figure 17:
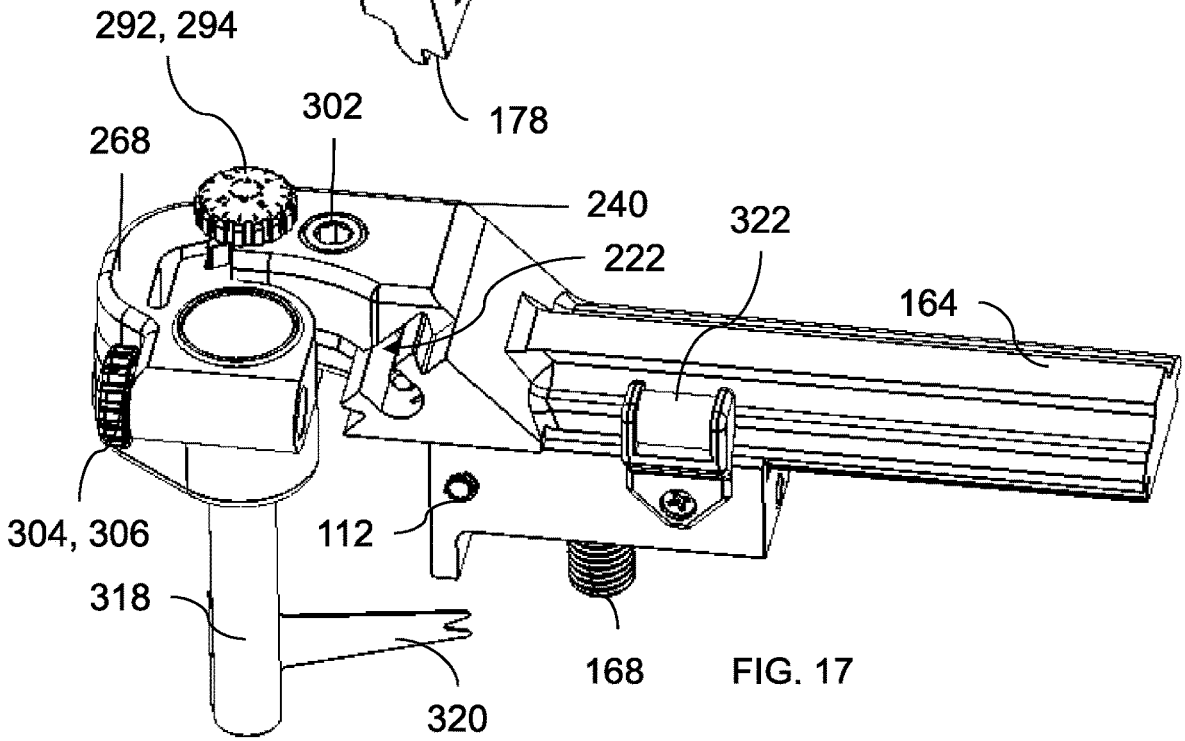
FIG. 17 is a bottom isometric view of the arrow rest mounting system of FIGS. 13-16.

Referring back to FIGS. 19*a*-19*d*, the arm 164 includes an arm structure 217 having the first valley 176 positioned in the top surface 218 and second valley 178 positioned in the bottom surface 220. The first and second valleys 174, 178 define a dovetail-shaped body engager or body engagement surface 219. As discussed above, the dovetail-shaped body engager 219 cooperates with the multi-part arm engager 170 to facilitate fore-aft, slide movement of the arm 164. The arm 164 can include a line of position setters 214 on a side surface 216. The position setters 214 can facilitate micro-adjustment of the arm 164 relative to the body 162. For example, each position setter 214 can define a cavity configured to receive a spring-activated pin (not shown) that is coupled to the body 162. Such pin can pop in and out of the position setters 214 to facilitate reaching a repeatable landing position along the body axis 180 (FIG. 13). In addition, a vertical adjustment surface 222 is coupled to a front face 224 of the arm 164. In this embodiment, the vertical adjustment surface 222 includes a first valley 226 and a second valley 228, which together form a male dovetail shape.

Figure 26:
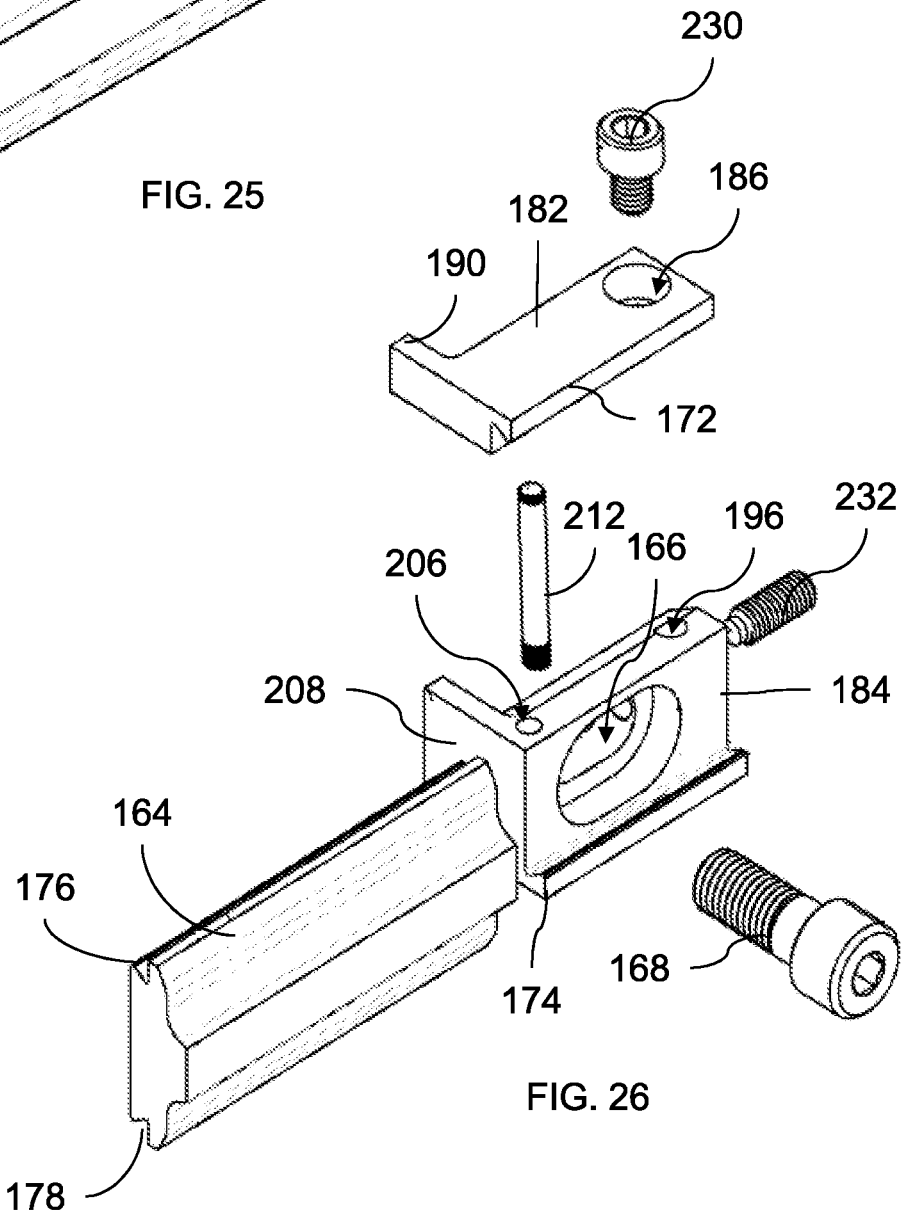
FIG. 26 is an exploded assembly view of the body and arm of FIG. 25.
Figure 27A:
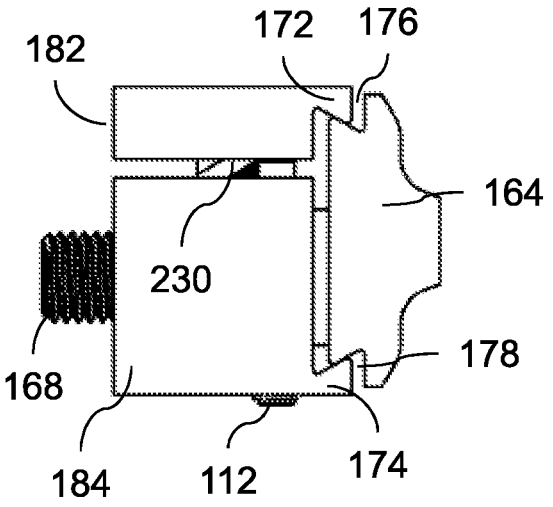
FIG. 27*a* is a rear view of the assembled body and arm of FIG. 25, shown in an unlocked condition.
Figure 27B:
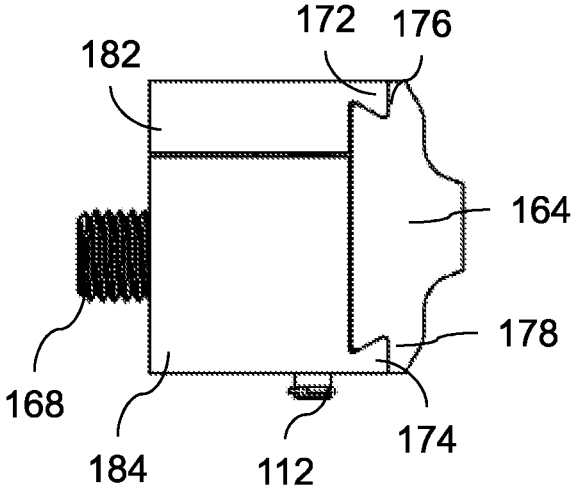
FIG. 27*b* is 27*b* is a rear view of the assembled body and arm of FIG. 27*a*, shown in a locked condition.
Figure 28A:
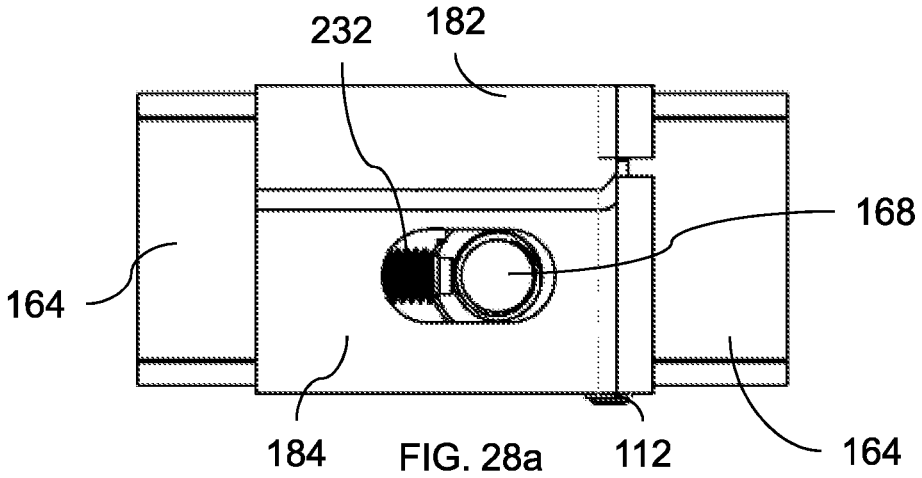
FIG. 28*a* is side view of the assembled body and arm of FIG. 25
Figure 28B:
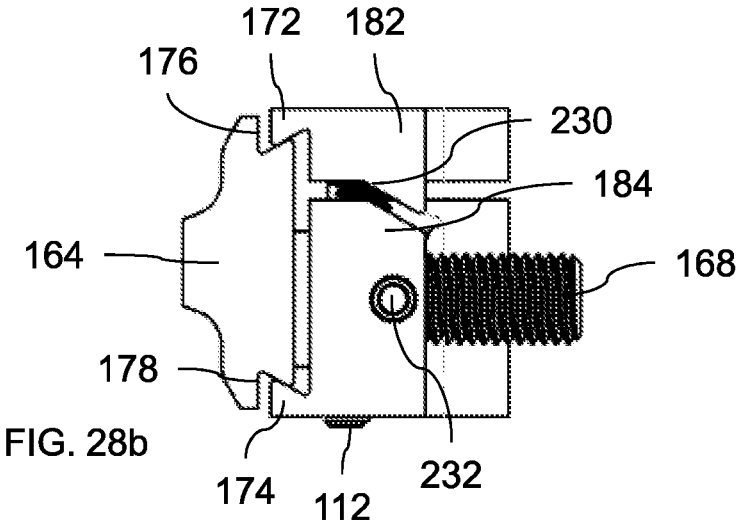
FIG. 28*b* is front view of the assembled body and arm of FIG. 28*a*.

Referring to FIG. 26, the bottom surface 192 of the first body section 182 corresponds to and mates with the top surface 198 of the second body section 184 so that the first and second body sections 182, 184 are stacked to form the multi-part body 162. A fastener 230 (FIG. 26), such as a screw or bolt, extends through the vertical bore 186 of the first body section 182 and the vertical bore 196 of the second body section 184 to lock the first and second body sections 182, 184 together. The alignment pin 212 extends through the vertical bore 206 of the second body section 184 and into the bore 188 (FIG. 30*b*) of the first body section 182 to prevent or inhibit rotation of the first and second body sections 182, 184 relative to each other. A second fastener 232, such as a set screw, is positioned within the bore 202 (FIG. 29*b*) of the second body section 184. When the second fastener 232 is advanced into the bore 202, the second fastener 232 contacts the bow engager 168 (FIGS. 28*a*-28*b*), inhibiting the bow engager 168 from rotating and further locking the bow engager 168 in place.

The arm 164 is positioned so that the first slide guide 172 and second slide guide 174 are retained in the first valley 176 and second valley 178, respectively, retaining the arm 164 in the arm engager 170. As further illustrated by FIGS. 27*a*-27*b*, as the fastener 230 advances through the threaded bore 196, the fastener 230 tightens or pulls the first body section 182 and second body section 184 together, which tightens or closes the multi-part arm engager 170 around the arm 164, changing the body 162 and arm 164 from an unlocked condition (FIG. 27*a*) to a locked condition (FIG. 27*b*) in which the 162 and arm 164 are locked together after the arm 164 has been slid to the desired position on the body axis 180.

Figure 18:
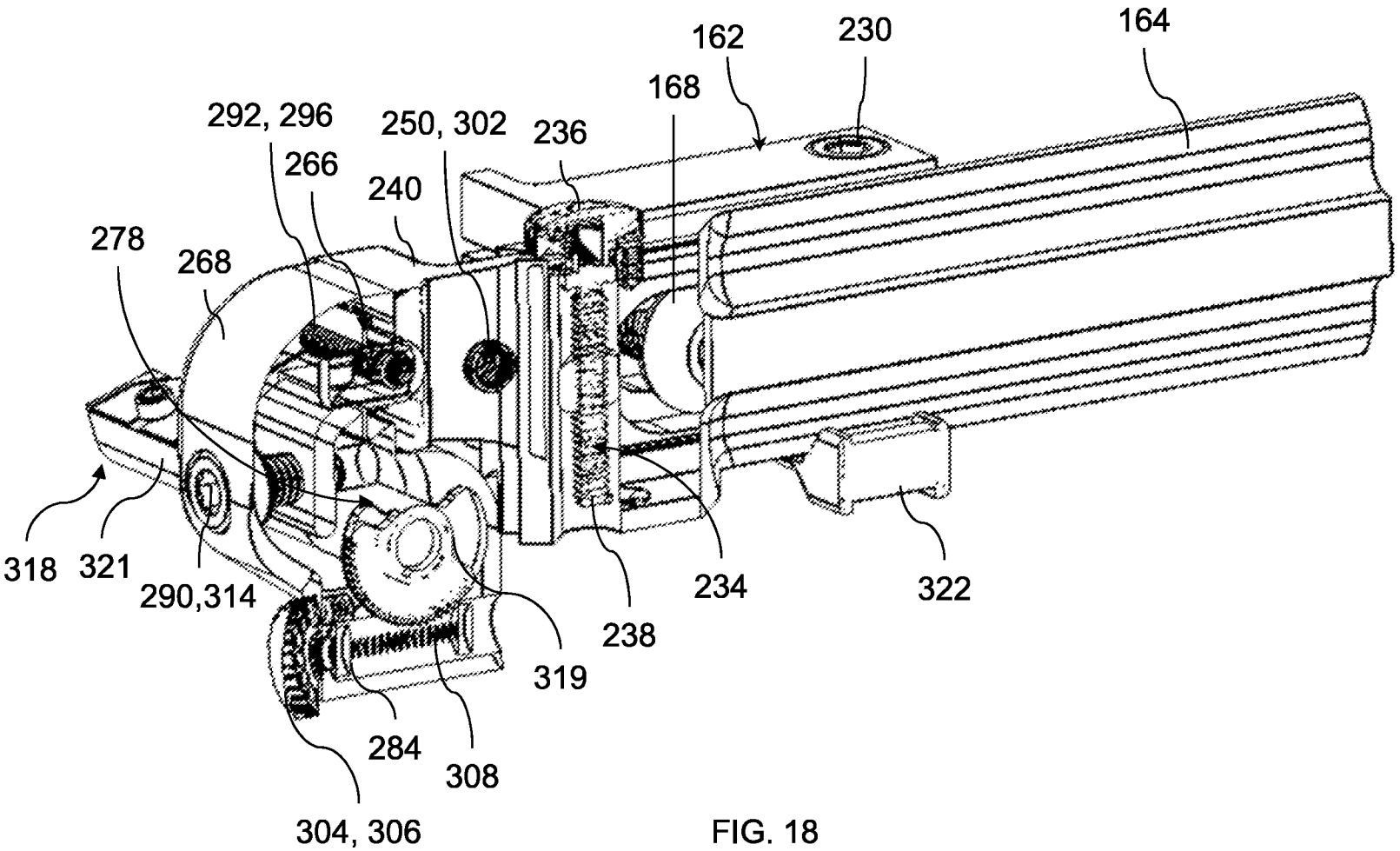
FIG. 18 is partial cutaway view of the arrow rest mounting system of FIGS. 13-17.
Figure 19A:
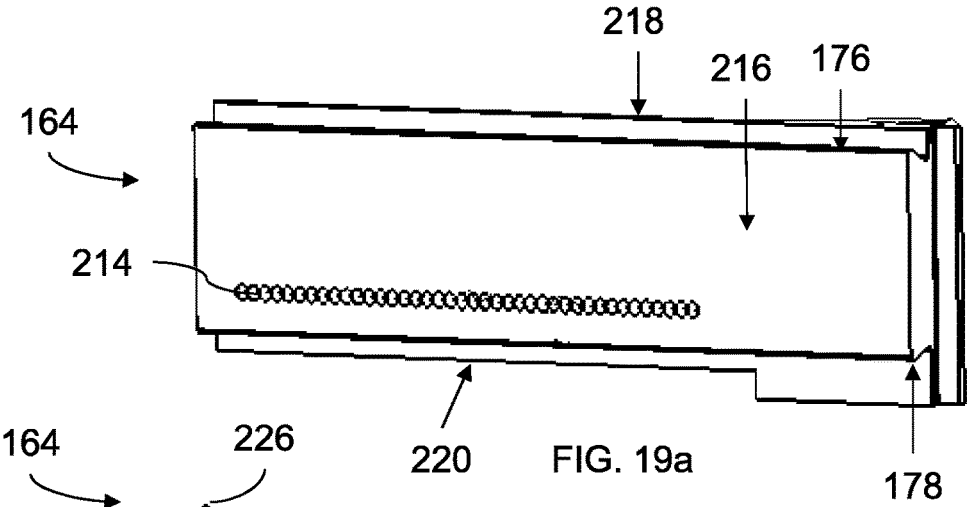
FIG. 19*a* is a side view of an embodiment of an arm.
Figure 19B:
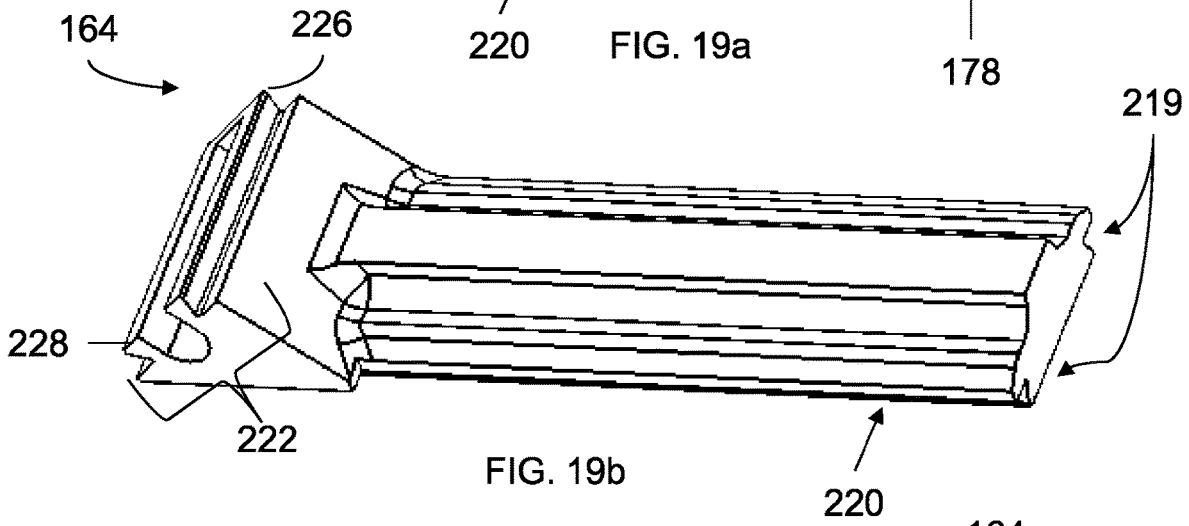
FIG. 19*b* is a bottom isometric view of the arm of FIG. 19.
Figure 19C:
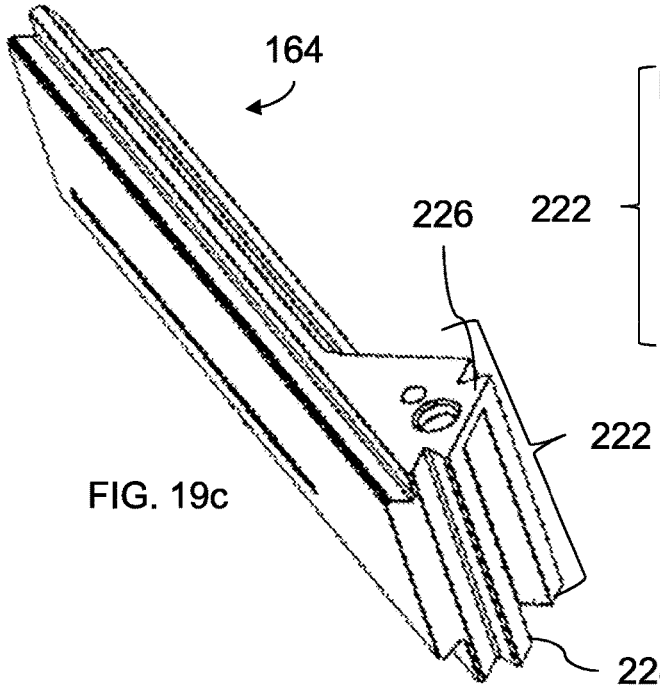
FIG. 19*c* is a top isometric view of the arm of FIGS. 19-20.
Figure 19D:
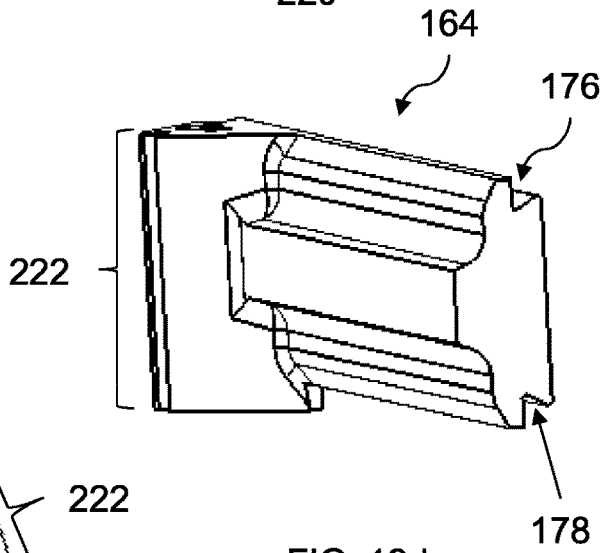
FIG. 19*d* is an isometric view of the arm of FIG. 22.
Figure 20:
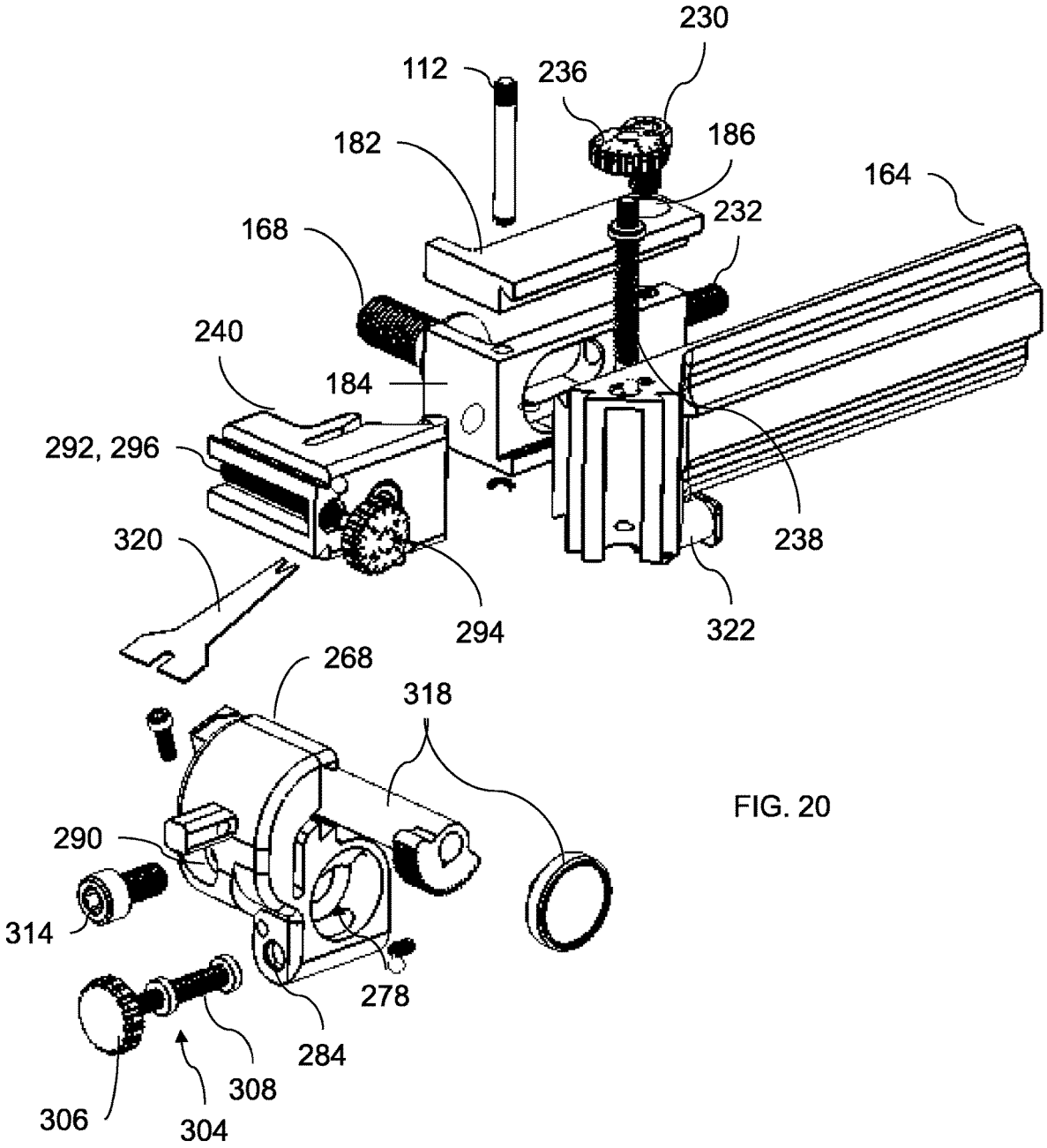
FIG. 20 is an exploded assembly view of the arrow rest mounting system of FIGS. 13-17.

Referring to FIG. 18, the arrow rest mounting system 160 includes a fore-aft position adjuster 234 that enables controlled, slide-based adjustment of the fore-aft position of the arm 164 relative to the body 162 along the body axis 180. The fore-aft position adjuster 234 includes a rotatable hand grasp or knob 236 coupled to a drive shaft 238. While the drive shaft 238 is positioned within the arm 164, at least part of the drive shaft 238 is exposed or accessible. The exposed or accessible part (not shown) of the drive shaft 238 is coupled to a drive gear or horizontal gear track (not shown) which, in turn, is coupled to the body 162. When the user rotates the knob 236, the drive shaft 238 engages the gear track causing the drive shaft 238 and the arm 164 to slide along the body axis 180 relative to the body 162. Depending upon whether the knob 235 is rotated clockwise or counterclockwise, the arm 164 moves in the forward direction 150 or in the rearward direction 151 along the body axis 180 (FIG. 13). Further operation of an embodiment of the fore-aft position adjuster 234 is described above with regard to the mounting system 108.

Figure 31A:
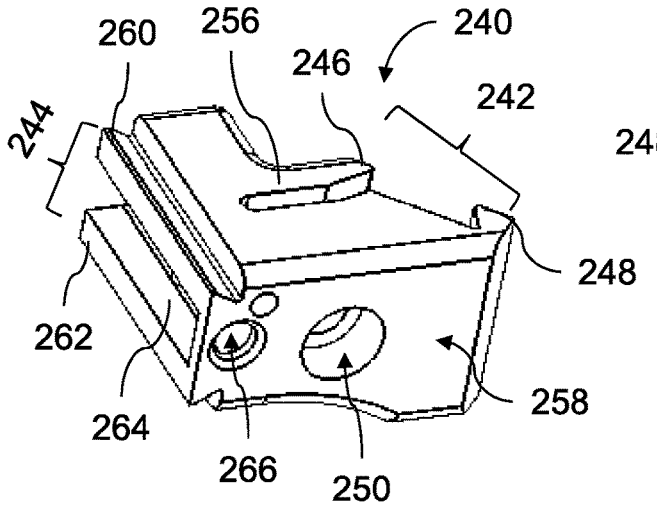
FIG. 31*a* is an isometric view of an embodiment of a first adjustment body.
Figure 31B:
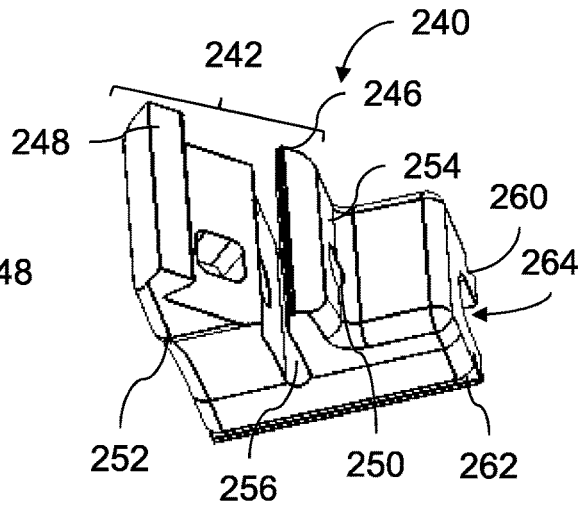
FIG. 31*b* is another isometric view of the first adjustment body of FIG. 31*a*.

Referring back to FIGS. 13-17, a supplemental adjustment structure 240 is coupled to the vertical adjustment surface 222 of the arm 164. As illustrated by FIGS. 31*a*-31*b*, the supplemental adjustment structure 240 includes a vertical adjustment surface 242 and a lateral adjustment surface 244. The vertical adjustment surface 242 includes a first lip 246 at the end of a first body extension 252 and a second lip 248 at the end of a second body extension 254 separated from the first body extension by a slit or opening 256, which together define a female dovetail shape. The vertical adjustment surface 242 is configured to receive and slidably retain the vertical adjustment surface 222 of the arm 164. A first bore 250 extends through a side surface 258 of the supplemental adjustment structure 240 and through the first body extension 252 and the second body extension 254. The vertical adjustment surface 222 enables the user to adjust the vertical position of the arrow rest 320, as described below.

The lateral adjustment surface 244 includes a first valley 260 and a second valley 262, which together define a male dovetail shape. A channel 264 extends at least partially between the first valley 260 and the second valley 262. A second bore 266 extends through the side surface 258 into the channel 264. The lateral adjustment surface 244 enables the user to adjust the lateral position of the arrow rest 320, as described below.

Figure 32A:
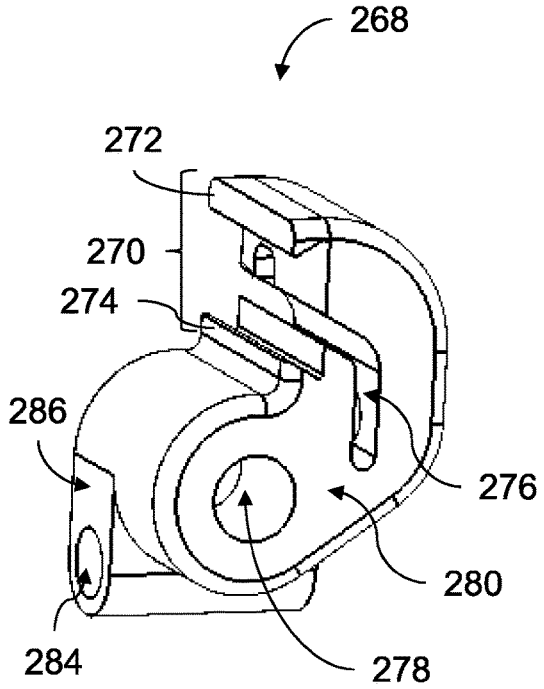
FIG. 32*a* is an isometric view of an embodiment of a second adjustment body.
Figure 32B:
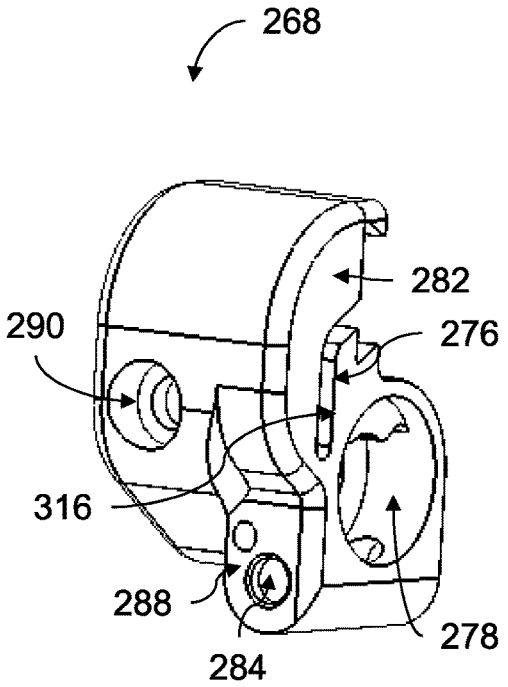
FIG. 32*b* is another isometric view of the second adjustment body of FIG. 32*a*.

Referring again to FIGS. 13-17, arrow rest support structure 268 is coupled to the supplemental adjustment structure 240. As illustrated by FIGS. 32*a*-32*b*, the arrow rest support structure 268 includes a lateral adjustment surface 270 that corresponds with and engages the lateral adjustment surface 244 of the supplemental adjustment structure 240. The lateral adjustment surface 270 includes a first lip 272 and a second lip 274, which define a female dovetail shape. The first valley 260 and second valley 262 (FIGS. 31*a*-311*b*) receive the first lip 272 and second lip 274 to receive the male dovetail shape in the female dovetail shape and slidably engage the lateral adjustment surfaces 264, 270. A groove 276 extends into the arrow rest support structure 268 between the first lip 272 and second lip 274. A first bore 278 extends through the arrow rest support structure 268 between the side surfaces 280, 282. A second bore 284 extends through the arrow rest support structure 268 from the front surface 286 to the rear surface 288. A third bore 290 extends partially through the arrow rest support structure 268 from the rear surface 288 to the groove 276.

Referring to FIGS. 13 and 18, a lateral position adjuster 292, including a knob 294 and a drive shaft 296 coupled to driver gear (not shown), is positioned in the bore 266. When the user rotates the knob 294, the driver gear drives the supplemental adjustment structure 240 to slidably move laterally relative to the arm 164 along lateral axis 309 (FIG. 13). Depending upon whether the knob 294 is rotated clockwise or counterclockwise, the supplemental adjustment structure 240 moves in inward direction 310 (FIG. 13) or in the outward direction 312.

Referring to FIG. 31*b*, a fastener 302 is positioned in the bore 250 to enable the user to adjust the vertical or up/down position of the supplemental adjustment structure 240 relative to the body 162. To adjust the up/down position, the user can unscrew the fastener 302. At that point, the first and second extensions 252, 254 flex apart from each other, widening the slit 256. Then, the user can slide the supplemental adjustment structure 240 upward or downward along up/down axis 297 (FIG. 13) relative to the body 162. When the fastener 302 is tightened, the first and second extensions 252, 254 are pulled together, narrowing the slit 256. The narrowing of the slit 256 tightens the first and second extensions 252, 254, and thus the first and second lips 246, 248, around the vertical adjustment surface 222 of the arm 164, locking the relative positions of the vertical adjustment surfaces 222, 242. In an alternate embodiment (not shown), the supplemental adjustment structure 240 includes a knob coupled to a drive shaft for adjusting the up/down position of the supplemental adjustment structure 240 relative to the body 162. Such embodiment has components and elements similar to that of the fore-aft position adjuster 234.

An angular adjuster 304, including a knob 306 and drive shaft 308 coupled to a drive gear 319 (FIG. 18), is positioned in the bore 284. When the user rotates the knob 306, the drive shaft 308 causes the drive gear 319 to rotate. The drive gear 319, which is coupled to the arrow rest shaft 321, causes the shaft 321 to rotate clockwise or counterclockwise. Accordingly, the turning the knob 306, the user can adjust the angular setting of the arrow rest 320. Once the user reaches the desired angular position, the user can tighten fastener or locking member 314. The locking member 314 contacts and applies a force to the arrow rest shaft 321 to fix the arrow rest shaft 321 is the desired position.

As shown, the arrow rest support 318 extends through the bore 278, and the arrow rest 320 is coupled to the arrow rest support 318. The various adjustment surfaces described above allow the arrow rest support 318 to be adjusted: (a) in a fore-aft direction along fore-aft axis 161 (FIG. 13); (b) vertically or up/down along up/down axis 297 (FIG. 13); (c) laterally along lateral axis 309 (FIG. 13); and (d) angularly about the axis extending through the arrow rest shaft 321 (FIG. 13). The body 162, arm 164, supplemental adjustment structure 240, and arrow rest support structure 268 can include various markings or position indicators (not shown) to facilitate positioning relative to each other, and to facilitate reproduction of set positions. As described above with regard to the mounting system 108, these adjustments can be macro, micro, or a combination thereof. Referring back to FIGS. 13-17, a level indicator 322, such as a bubble level indicator, can be coupled to the mounting system 160.

Figure 33:
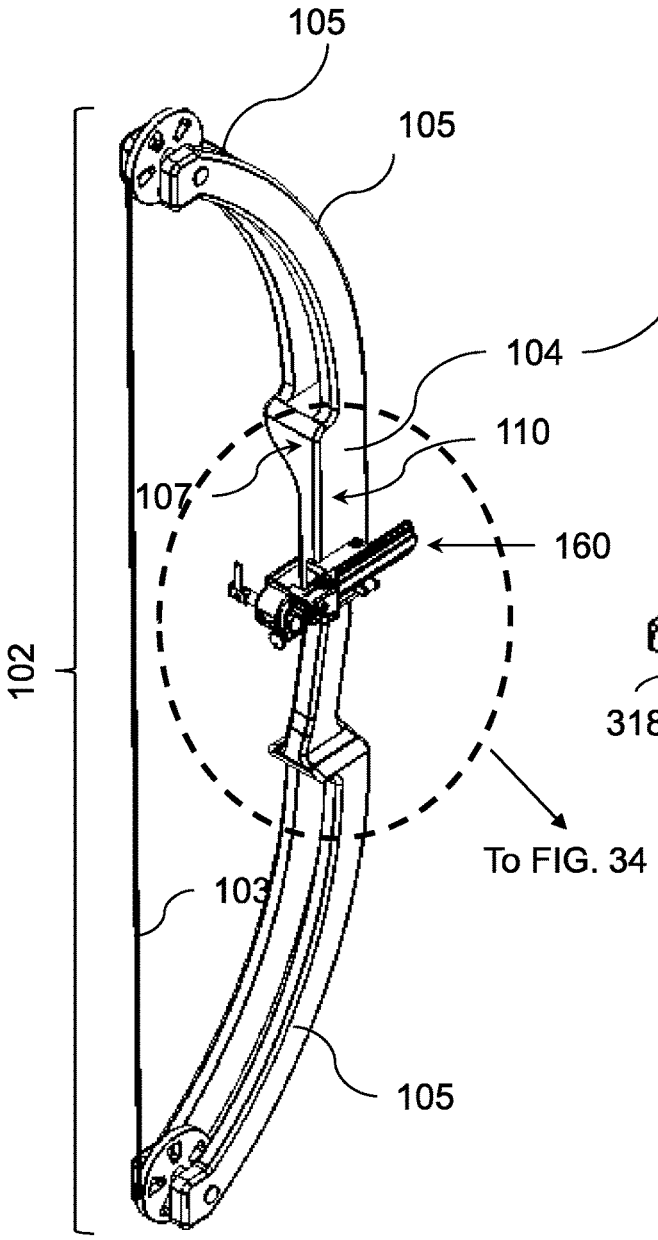
FIG. 33 is an illustration of an archery bow having the arrow rest mounting system of FIGS. 13-17 mounted thereon.
Figure 34:
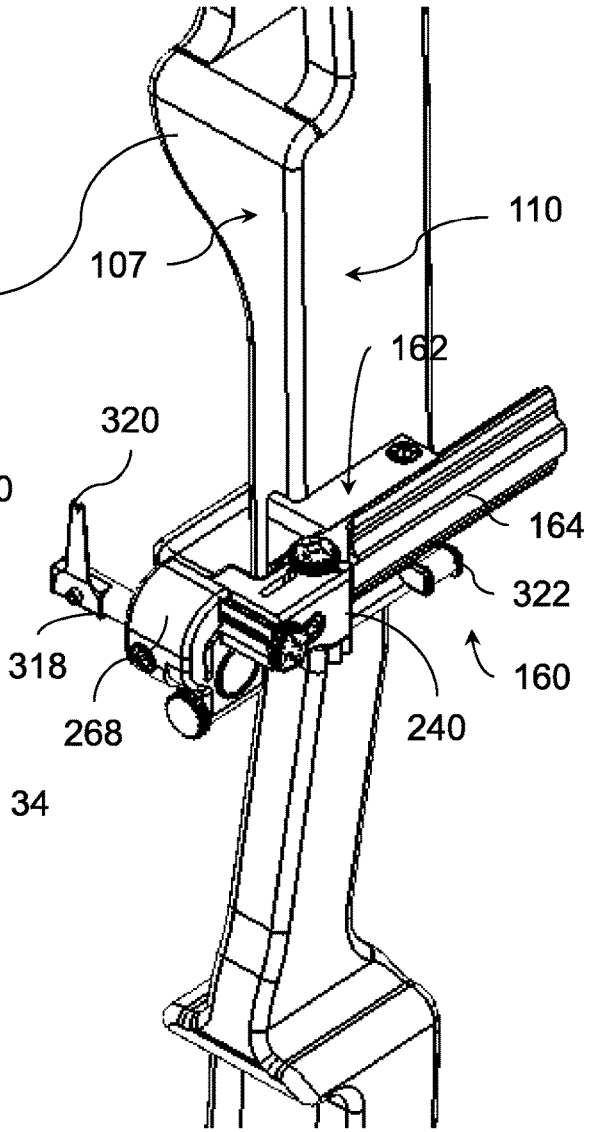
FIG. 34 is an enlarged view of FIG. 33.
Figure 35:
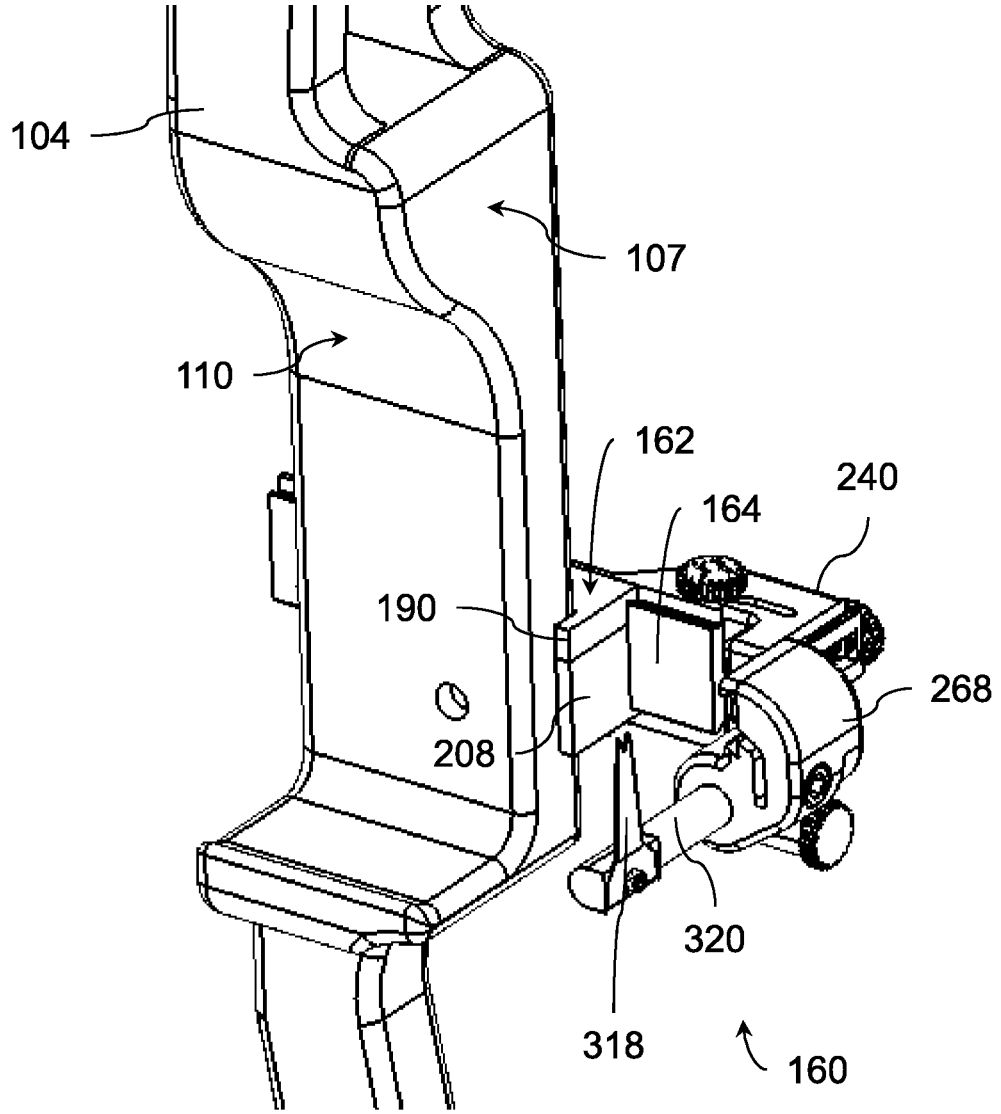
FIG. 35 is an another enlarged view of the arrow rest mounting system of FIGS. 13-17 mounted to an archery bow.
Figure 36:
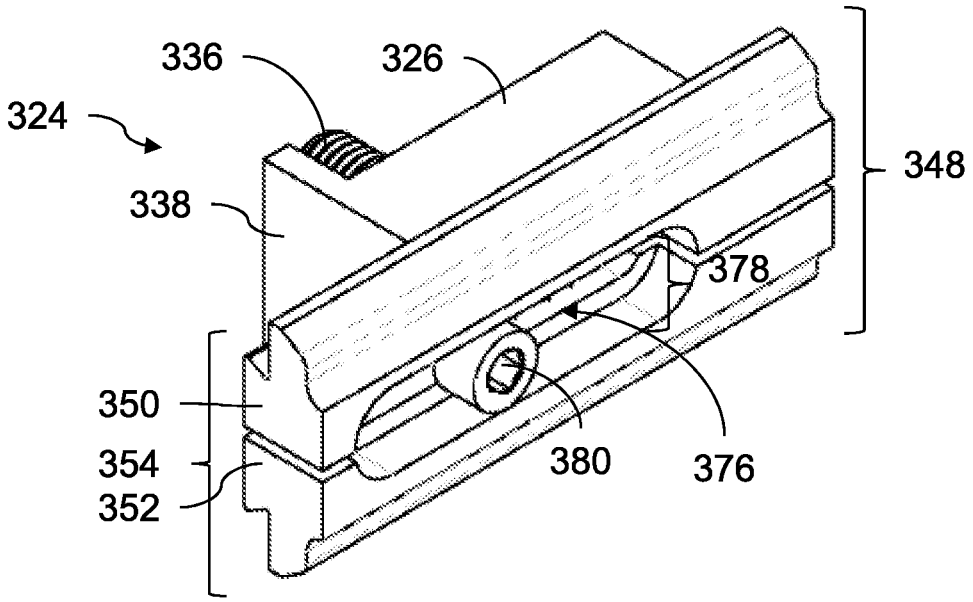
FIG. 36 is a isometric view of an embodiment of a body arm assembly.
Figure 37:
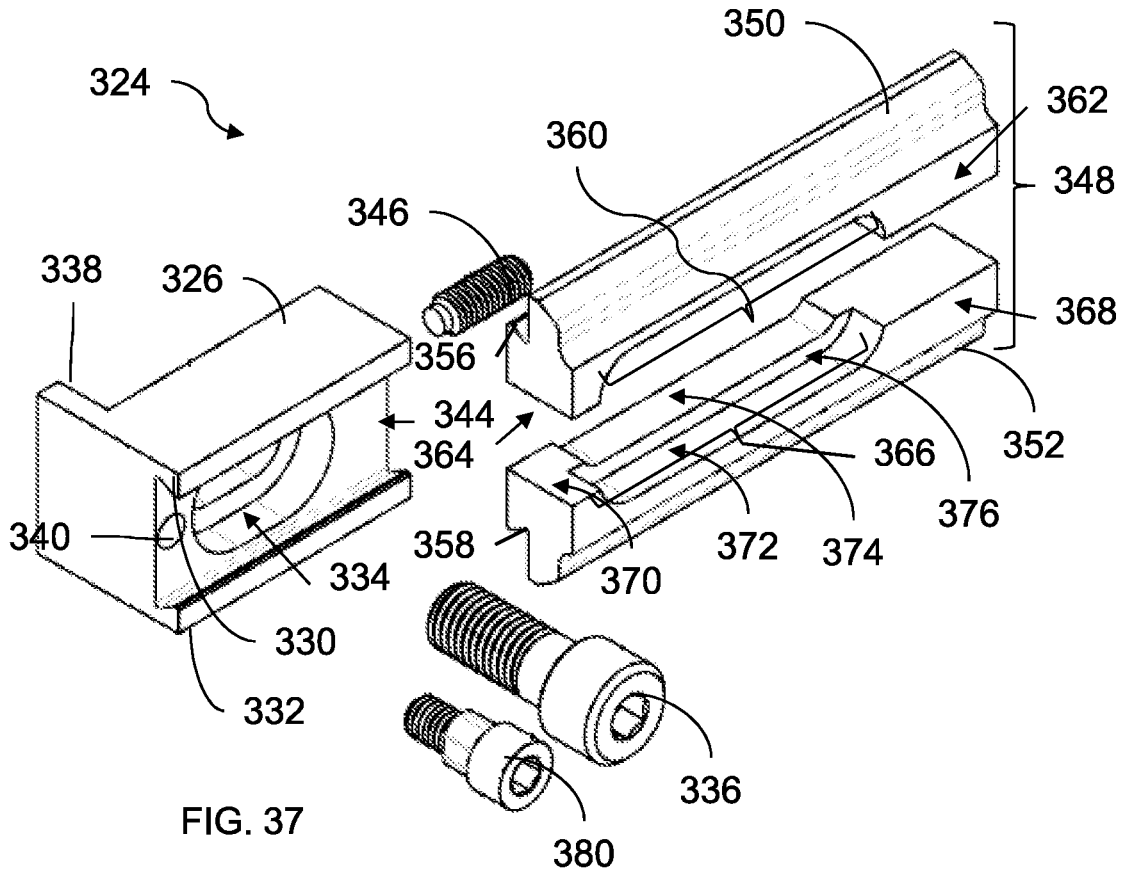
FIG. 37 is an exploded assembly view of the body arm assembly of FIG. 36.
Figure 38A:
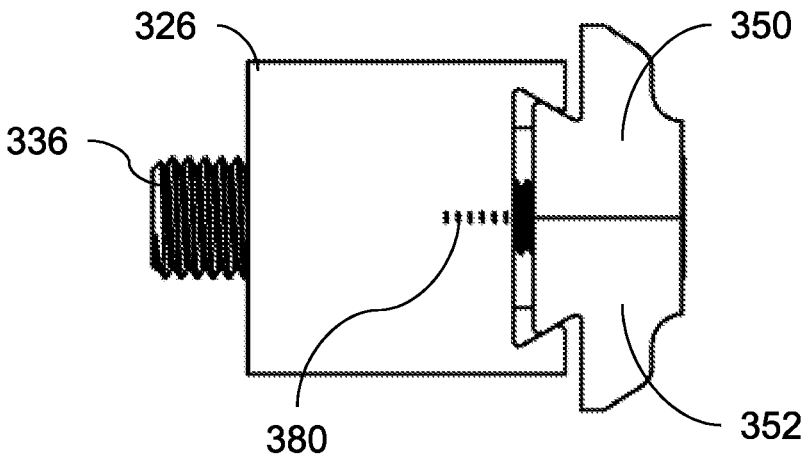
FIG. 38*a* is front view of the body arm assembly of FIGS. 36-37, showing an unlocked condition.
Figure 38B:
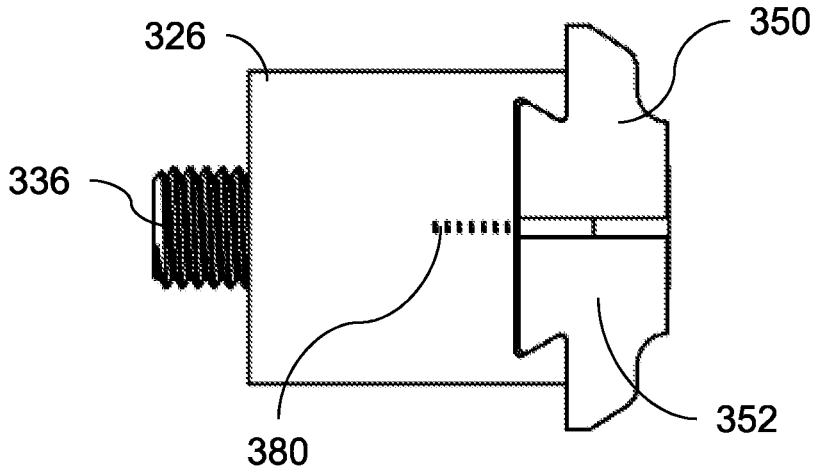
FIG. 38*b* is front view of the body arm assembly of FIG. 38*a*, showing a locked condition.

Referring to FIGS. 33-35, the body 162 is coupled to the riser 104 of an archery bow 102. In this embodiment, the body 162 is positioned against the side surface 110 of the riser 104, with the bow engager 168 extending into the riser 104. The ledges or stabilizers 190, 208 hook around and contact the rear face or surface 107 of the riser to prevent or inhibit rotation of the body 162 relative to the riser 104.

FIGS. 36-38*b* illustrate another embodiment of a body-arm assembly 324. In this embodiment, the body 326 includes an arm engager 328 having a first lip or first slide guide 330 and a second lip or second slide guide 332. The body 326 also has a bow engagement surface 334, configured to receive a bow engager 336, and a ledge or stabilizer 338 extending from the body 326 and configured to prevent rotation of the body 326 relative to a bow riser. A bore 340 extends a least partially through a side surface 342 of the body 326. A second bore (not shown) extends through the body 324 from the front surface 344 to the bow engagement surface 334. A set screw 346 is positionable within the second bore to prevent rotation of the bow engager 336.

The arm 348 includes a first arm section 350 and a second arm section 352. The arm 348 includes a body engagement surface 354 formed by a first valley or track 356 on the first arm section 350 and a second valley or track 358 on the second arm section 352. The first arm section 350 defines a first inset section 360 extending from a side surface 362 and bottom surface 364 partially through the first arm section 350 and defining two levels within the first inset section 360. The second arm section 352 defines a second inset section 366 extending from a side surface 368 and top surface 370 partially through the second arm section 352 and defining a first inset level 372 and a second inset level 374. The second inset level 374 defines a ledge or back surface 376 of the second inset section 366. Together, the first inset section 360 and second inset section 366 define a track 378.

The body engagement surface 354 is configured to be received in the arm engager 328 to retain the arm 348 in the body 326. A fastener 380, such as a bolt, extends through the track 378 into the bore 340. When the fastener 380 is tightened, the fastener 380 applies a force against the first and sect inset sections 360, 366, causing the first and second arm section 350, 352 to separate and apply a force to the first and second slide guides 330, 332. The application of the force causes the arm 348 to move from an unlocked condition (FIG. 38*a*) to a locked condition (FIG. 38*b*), locking the position of the arm 348 relative to the body 326.

FIGS. 39-46 illustrate another embodiment of an arrow rest mounting system 382. As illustrated by FIGS. 39-42, the mounting system 382 includes an arm 384, a first arrow rest support section 386, a second arrow rest support section 388, a third arrow rest support section 390, and an arrow rest 392. With reference to FIGS. 43*a*-43*b*, the arm 384 includes an arm structure 385 having a bow engagement surface 395 defining a bore 394 configured to receive a coupler (not shown), such as a fastener or bolt. In an embodiment, the bow engagement surface 394 can receive multiple couplers to prevent rotation of the arm 384 relative to the riser 104, or the bow engagement surface 395 can receive a single coupler. The arm structure 385 additionally includes a body engagement surface 396 that has a first valley 398 and a second valley 400 that together define a male dovetail shape. As will be further discussed below, the arm structure 385 can have position markings or indicators 402.

Figure 44A:
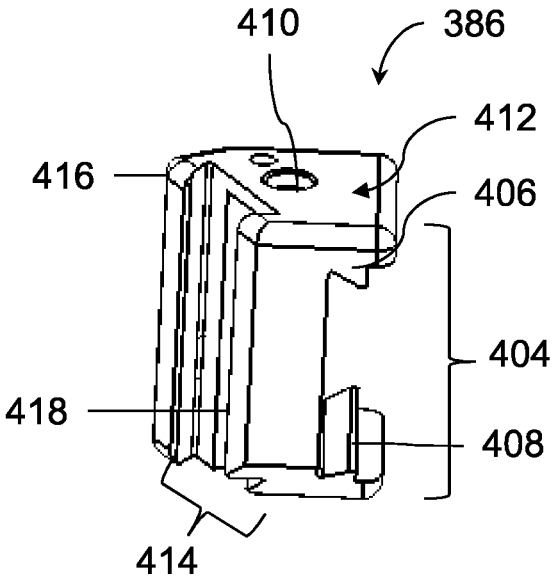
FIG. 44*a* is an isometric view of an embodiment of a first adjustment body for the arrow rest mounting system of FIGS. 39-42.
Figure 44B:
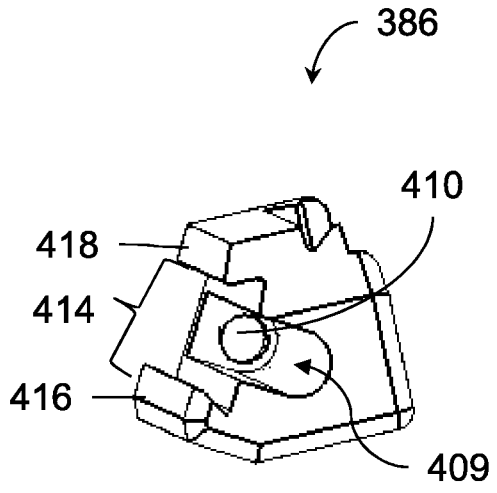
FIG. 44*b* is another isometric view of the first adjustment body of FIG. 44*a*.
Figure 44C:
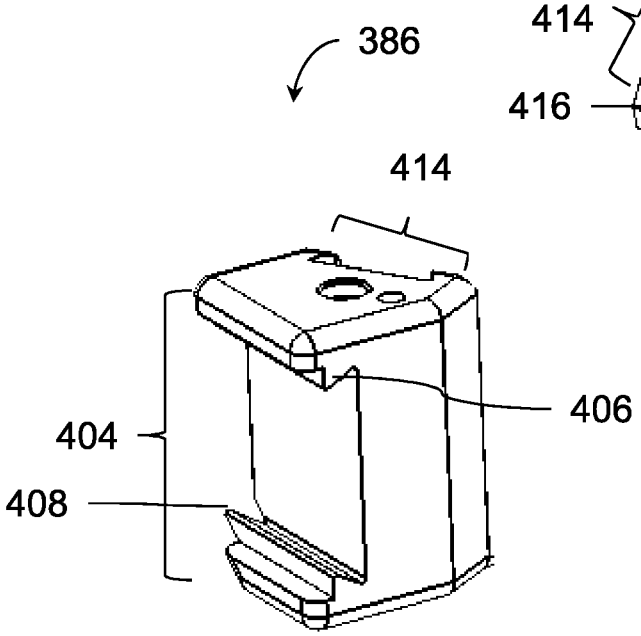
FIG. 44*c* is another isometric view of the first adjustment body of FIGS. 44*a*-44*b*.

Referring to FIGS. 44*a*-44*c*, the first arrow rest support section 386 includes an arm engagement surface 404 defining a first tapered lip 406 and a second tapered lip 408. The first tapered lip 406 and second tapered lip 408 are configured to be received in the first valley 398 and second valley 400 of the arm 384 to retain the arm 384 in the first arrow rest support section 386. A channel 409 extends partially into the body between the first lip 406 and the second lip 408. A bore 410 extends at least partially through the first arrow rest support section 386 from the top surface 412 and into the channel 409. A vertical adjustment surface 414 is positioned opposite the arm engagement surface 404. The vertical adjustment surface 414 includes a first lip 416 and a second lip 418, which together define a female dovetail shape.

Figure 45A:
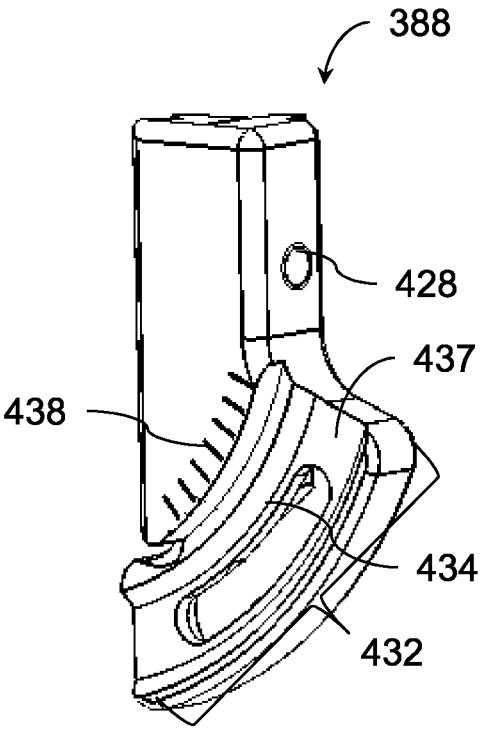
FIG. 45*a* is an isometric view of an embodiment of a second adjustment body for the arrow rest mounting system of FIGS. 39-42.
Figure 45B:
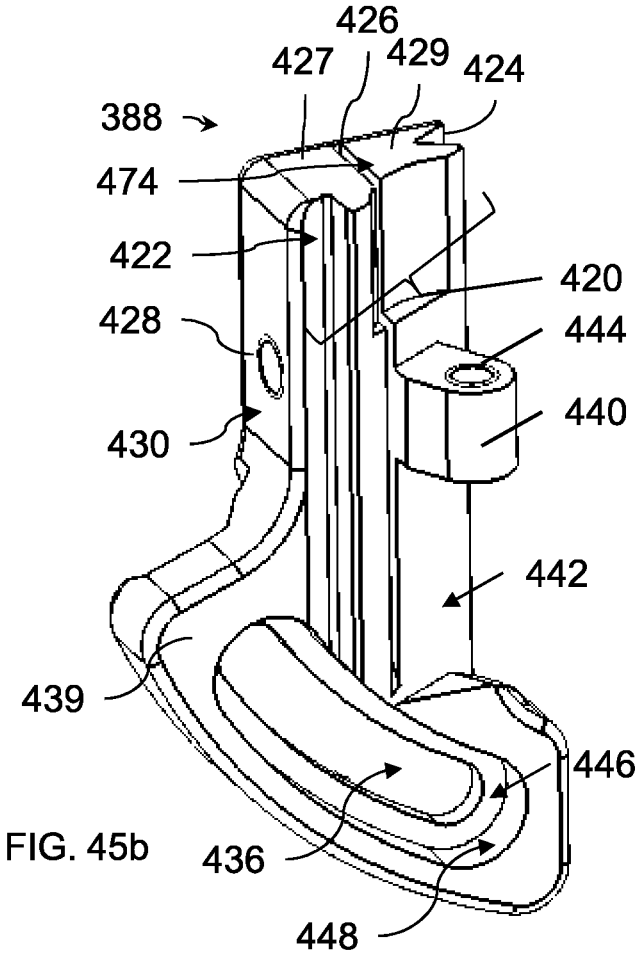
FIG. 45*b* is another isometric view of the second adjustment body of FIG. 45*a*.

Referring to FIGS. 45*a*-45*b*, the second arrow rest support section 388 includes a vertical adjustment surface 420. The vertical adjustment surface 420 includes a first valley 422 and a second valley 424 and a groove 426 extending vertically through a portion of the second arrow rest support section 388 between the first valley 422 and the second valley 424 and dividing the upper portion of the second arrow rest support section 388 into a first body portion 427 and a second body portion 429. The first valley 422 and second valley 424 together define a male dovetail shape that corresponds to the female dovetail shape of the vertical adjustment surface 414 of the first arrow rest support section 386. A body extension 440 protrudes or extends from a side surface 442 of the second body portion 429 between the second valley 424 and the groove 426. A bore or opening 444 extends through the body extension, extending along same direction as the groove 426. A bore or opening 428 extends through the second arrow rest support section 388 from a rear surface 430 to the groove 426.

An angular adjustment surface 432 extends from the bottom of the second arrow rest support section 388. The angular adjust surface 432 defines an angular adjustment track 434 and a curved or arc-shaped opening 436 positioned within the angular adjustment track 434 and extending through the second arrow rest support section 388 from side surface 437 to side surface 439. An inner ledge 446 extends around the inner surface 448 of the curved opening 436. A plurality of angular position markings or indicators 438 extend on the side surface 434 along the angular adjustment surface 432.

Figure 46:
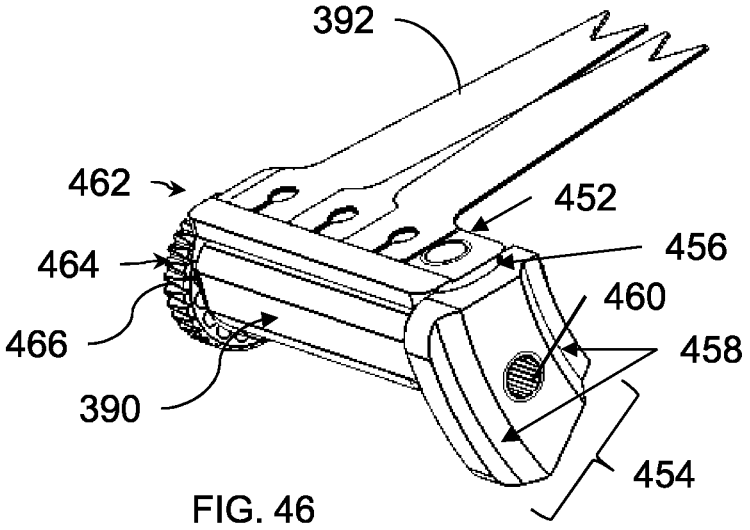
FIG. 46 is an isometric view of an embodiment of an arrow rest assembly for the arrow rest mounting system of FIGS. 39-42.

Referring to FIG. 46, the arrow rest support includes a support body 450. The arrow rest 392 couples to a top surface 452 of the support body 450. An angular adjustment surface 454 extends from a side surface 456 of the support body 450. The angular adjustment surface 454 defines an angular track 458 that corresponds to the angular track 434 of the second arrow rest support section 388. A bore 462 extends through the support body 450 from side surface 456 to side surface 462. A position adjuster 464, has a grasp or knob 466 coupled to a shaft (not shown) that extends through the bore 462 from side surface 462 to the side surface 456.

Referring again to FIGS. 39-42, the angular adjustment track 458 of the third arrow rest support section 390 is positioned within the angular adjustment track 434 of the second arrow rest support section 388 with the shaft of adjuster 464 extending through the bore 460 and through the curved opening 436. A retaining member (not shown) rests in the opening 436 against the ledge 446 to retain the angular adjustment track 458 of the third arrow rest support section 390 within the angular adjustment track 434 of the second arrow rest support section 388. The incremental rotation of the knob 466 causes the third arrow rest support section 390 to move along the arc path defined by the angular adjustment surface 432. This produces two adjustments—an adjustment of the angular position of the arrow rest 392 and an adjustment of the up/down or vertical position of the arrow rest 392.

Figure 39:
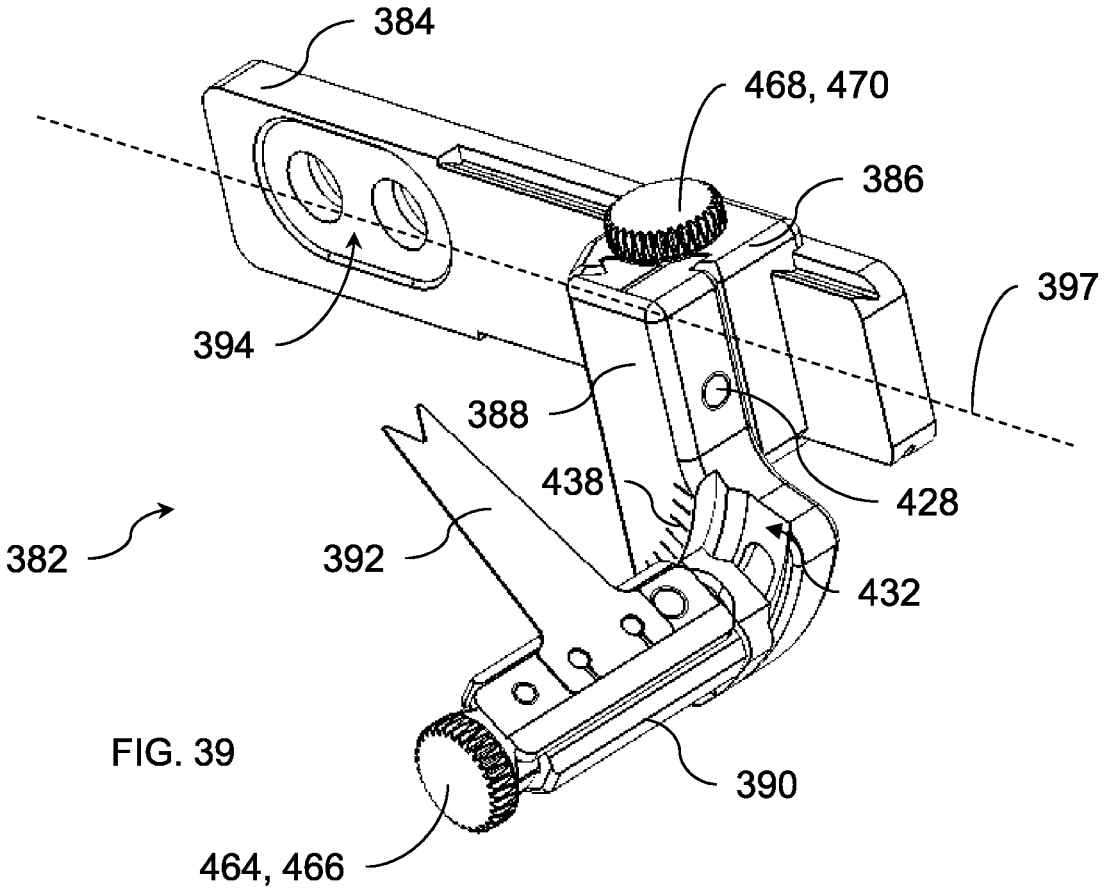
FIG. 39 is an isometric view of an embodiment of an arrow rest mounting system.
Figure 40:
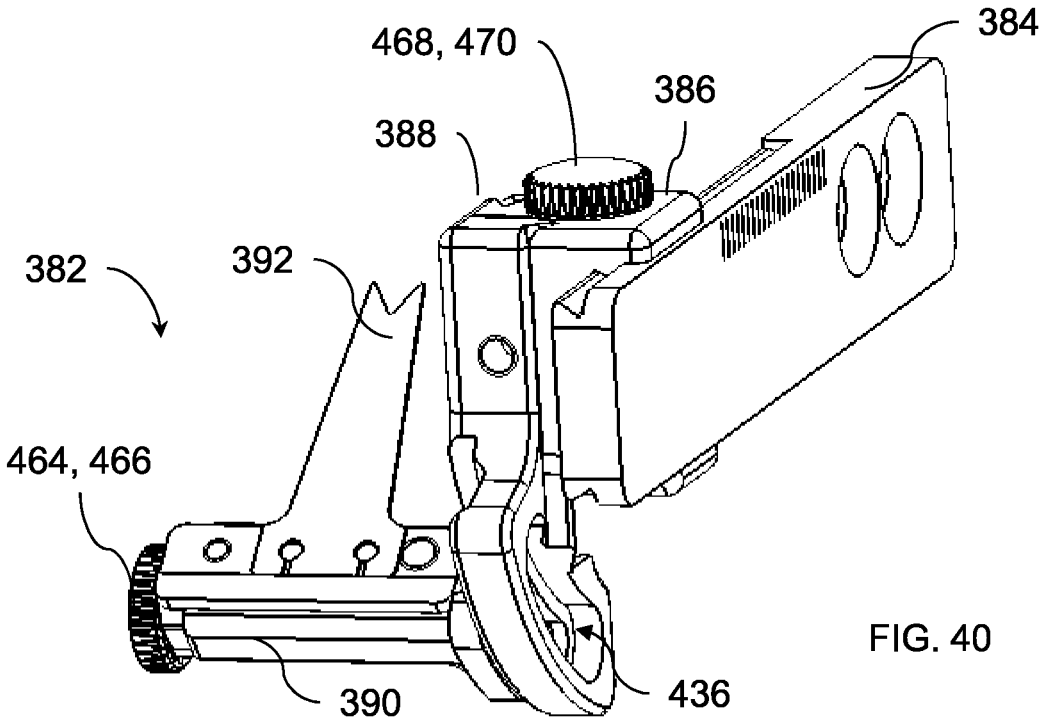
FIG. 40 is another isometric view of the arrow rest mounting system of FIG. 39.
Figure 41:
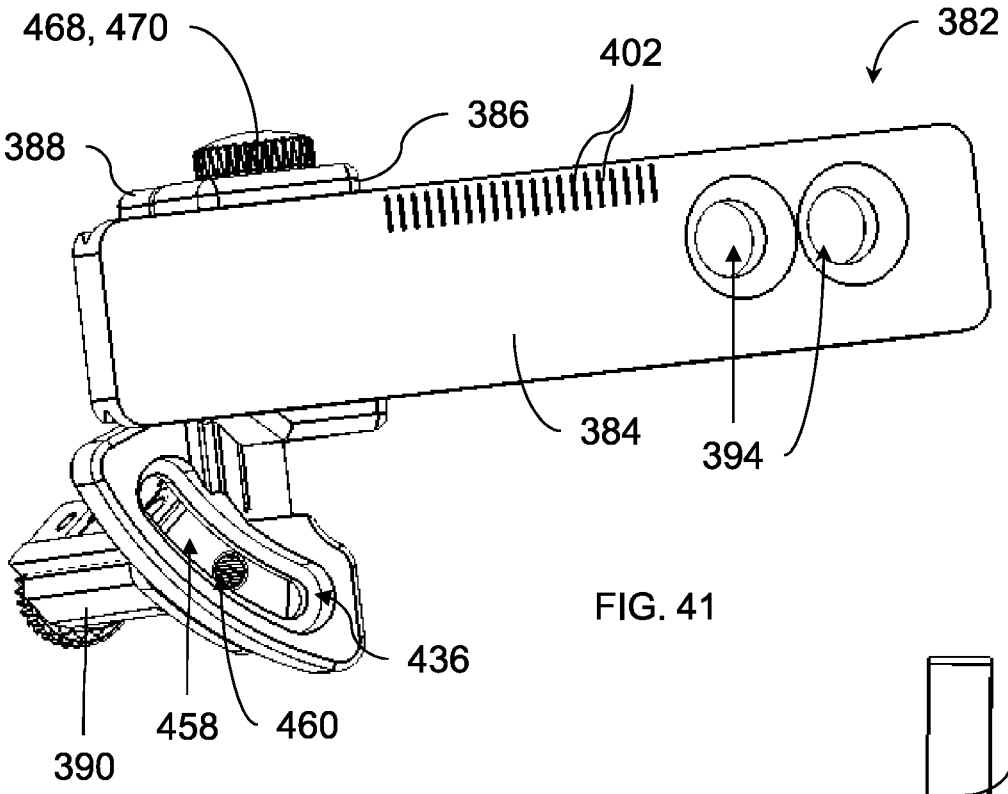
FIG. 41 is another isometric view of the arrow rest mounting system of FIGS. 39-40.
Figure 42:
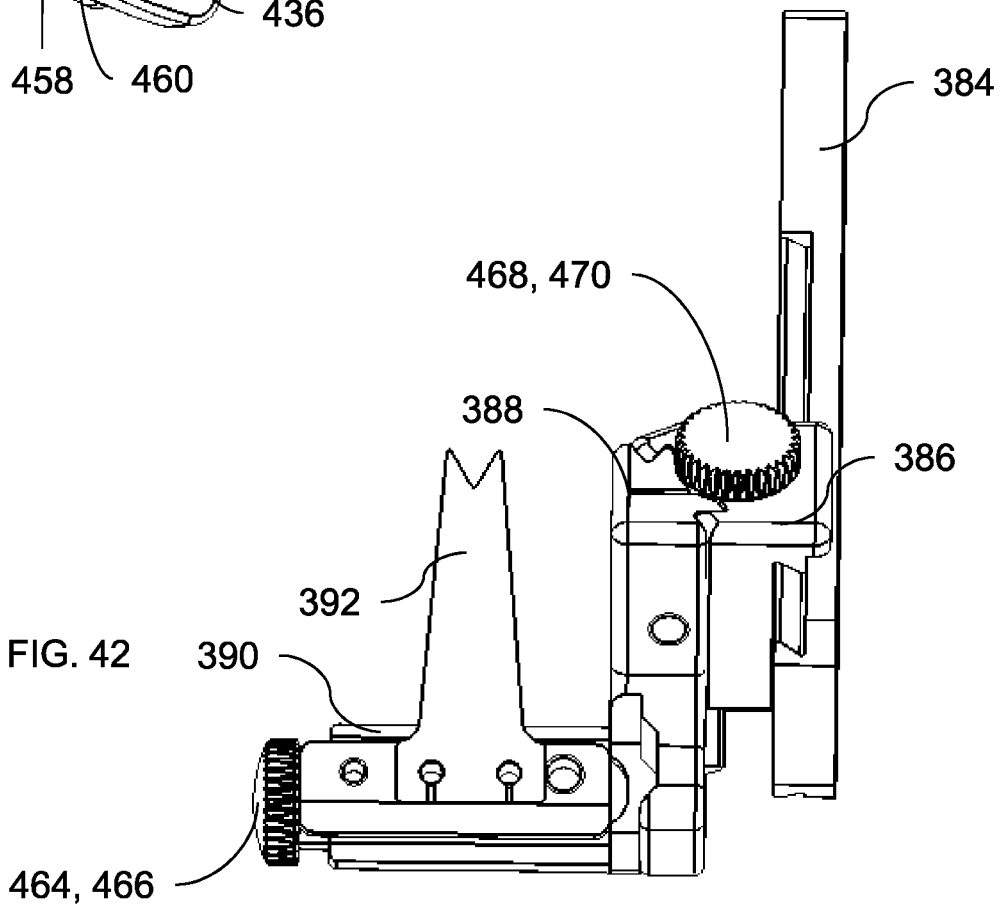
FIG. 42 is a top view of the arrow rest mounting system of FIGS. 39-41.
Figure 43A:
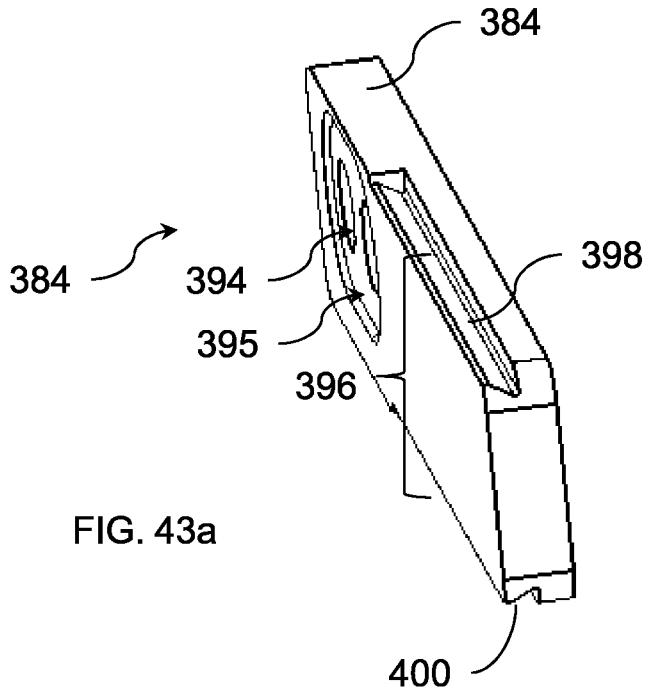
FIG. 43*a* is top isometric view of an embodiment of an arm for the arrow rest mounting system of FIGS. 39-42.
Figure 43B:
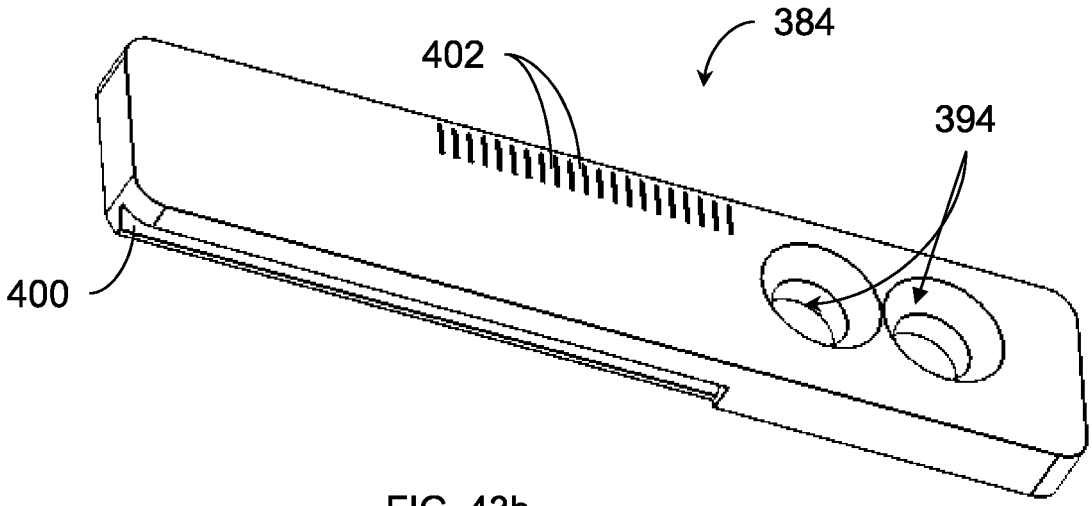
FIG. 43*b* is a bottom isometric view of the arm of FIG. 43*a*.

The vertical adjustment surface 420 of the second arrow rest support section 388 is received and slidably engages the vertical adjustment surface 414 of the first arrow rest support section 386. In engaging the vertical adjustment surfaces 414, 420, the lips 416, 418 of the vertical adjustment surface 414 are positioned within the valleys 422, 424 of the vertical adjust surface 420. In addition, the body extension 440 is positioned within the channel 409 with the bore 410 and the bore 444 aligned. A fore-aft position adjuster 468, having a knob 470 and a shaft (not shown), extends through the bores 410, 444. Rotating the knob 470 causes the first and second arrow rest support sections 386, 388 to slide in a fore-aft direction along arm axis 397 (FIG. 39).

By untightening fastener 472, the user can adjust the up/down position of the relative to the first and second arrow rest support sections 386, 388 relative to the arm 384. The fastener 472 extends through the bore 428. When the fastener 472 advances into the bore 428, the fastener 472 contacts and applies a force to an inner surface 474 of the second body portion 429 that defines the groove 426. The application of the force causes the groove to widen or expand, causing the first body portion 427 and second body portion 429 to apply a force to the first lip 416 and second lip 418 and lock the position of the second arrow rest support section 388 relative to the first arrow rest support section 386.

The arm engagement surface 404 engages the body engagement surface 396 to slidably retain the arm 384. In this embodiment, the first and second lips 406, 408 are positioned in the first and second valleys 398, 400, enabling the arm 384 to slide relative to the first arrow rest support section 386.

FIGS. 47-54*b* illustrate yet another embodiment of an arrow rest mounting system 476. As illustrated in FIGS. 47-50, the mounting system 476 includes a body 478, an arm 480, a first adjustment structure 482, a second adjustment structure 484, an arrow rest support 486, and an arrow rest 488. Referring to FIGS. 51*a*-51*b*, the arm 480 includes an arm structure 490 having a body engagement surface 492. The body engagement surface 492 includes a first valley 494 and a second valley 496 that together define a male dovetail shape. A plurality of position indicators 498 are positioned along a side surface 500 of the arm structure 490. A plurality of visual position indicators or markings 499 extend along a top surface 501 of the arm structure 490 to facilitate positioning of the arm 480 by a user.

A vertical adjustment surface 502 is positioned at the rear face 504 of the arm structure 490. The vertical adjustment surface 502 includes a first lip 506 and a second lip 508. A channel 510 extends at least partially through the arm structure 490 between and extending along the first lip 506 and the second lip 508. A bore 512 extends through a bottom surface 514 of the arm structure 490 into the channel 510.

Figure 52A:
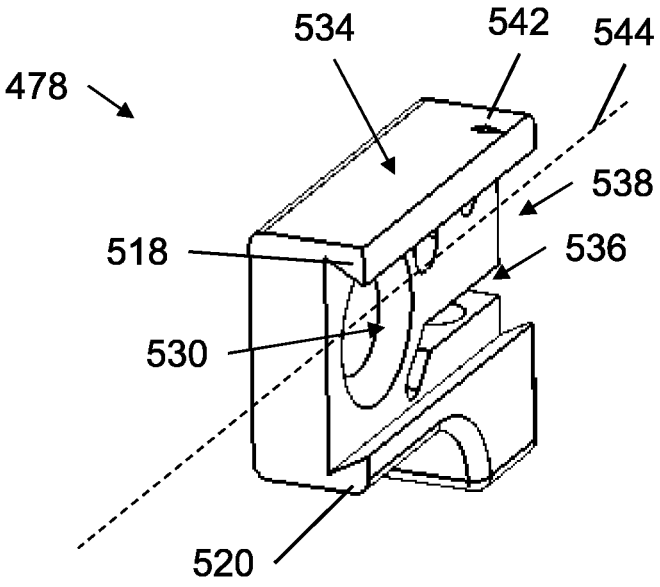
FIG. 52*a* is an isometric view of a body of the arrow rest mounting system of FIGS. 47-49.
Figure 52B:
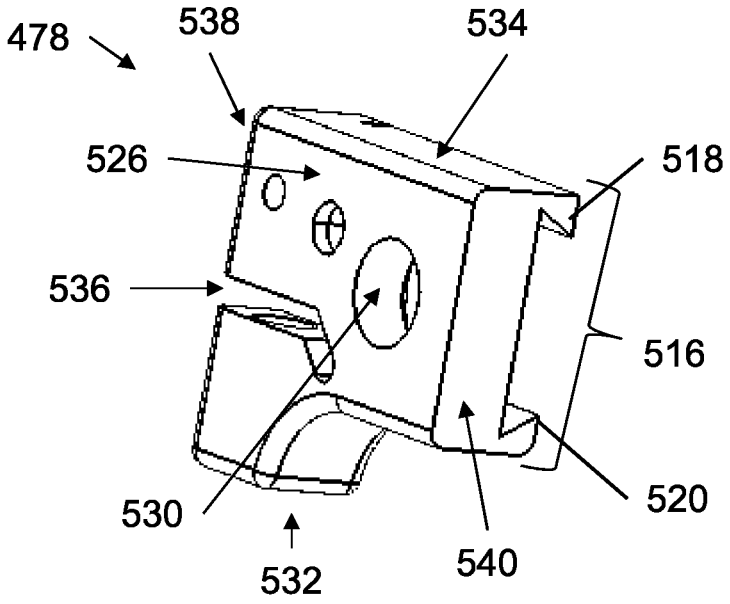
FIG. 52*b* is another isometric view of the body of FIG. 52*a*.

Referring to FIGS. 52*a*-52*b*, the body 478 includes an arm engager or arm engagement surface 516 having a tapered first lip or slide guide 518 and a tapered second lip or slide guide 520. A bow engagement surface 522, illustrated here as a bore extending through the body 478 from side surface, is configured to receive a bow engager 528 (FIG. 47), such as a fastener. A bore 530 extends at least partially through the body 478 from the bottom surface 532 toward the top surface 534. A groove 536 extends partially through the body 478 from the front surface 538 toward the rear surface 540 along a body axis 544. A position marking 542 can be positioned on the top surface 534. A first bore or opening 555 extends through the first body portion 554 from the side surface 576.

Figure 53A:
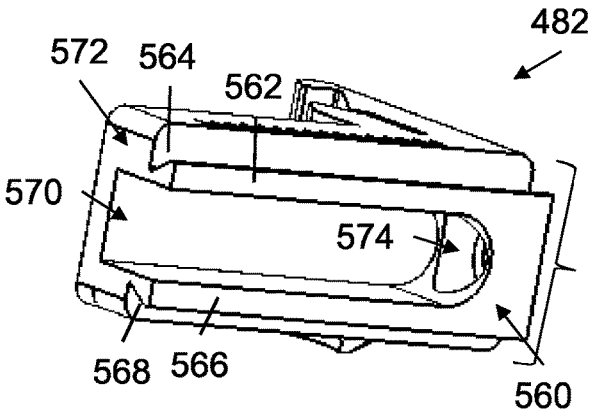
FIG. 53*a* is an isometric view of an embodiment of a first adjustment body of the arrow rest mounting system of FIGS. 47-49.
Figure 53B:
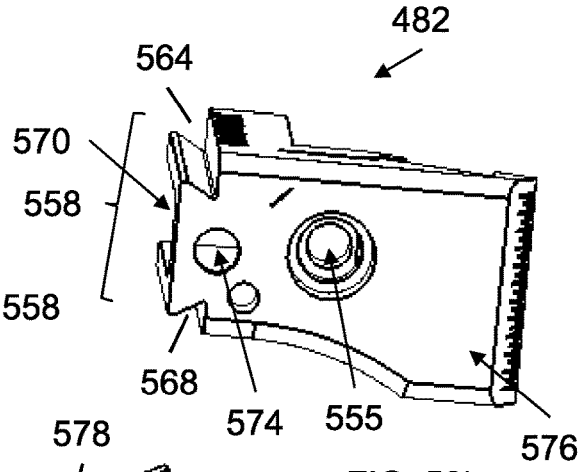
FIG. 53*b* is another isometric view of the first adjustment body of FIG. 53*a*.
Figure 53C:
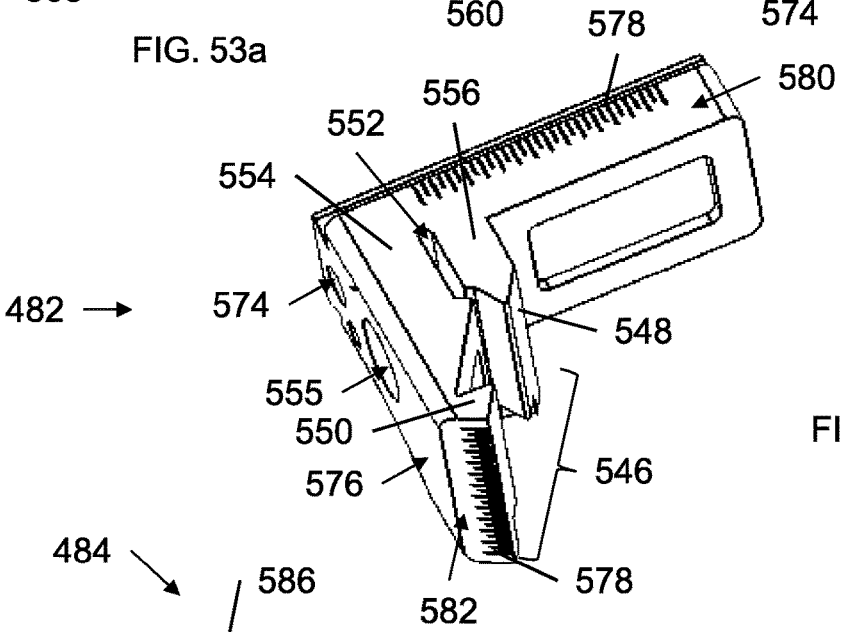
FIG. 53*c* is another isometric view of the first adjustment body of FIGS. 53*a*-53*b*.

Referring to FIGS. 53*a*-53*c*, the first adjustment structure 482 includes a vertical adjustment surface 546 having a first lip or slide guide 548 and a second lip or slide guide 550 that define a female dovetail shape. A groove or slit 552 extends into the first adjustment structure 482 between the first slide guide 548 and the second slide guide 550, defining a first body portion 554 and a second body portion 556. A fore-aft adjustment surface 558 extends along the rear surface 560 of the first adjustment structure 482. The fore-aft adjustment surface 558 includes a first leg 562 defining a first valley 564 and a second leg 566 defining a second valley 568. The first and second valley 564, 568 define a male dovetail shape. A channel 570 extends partially through the first adjustment structure 482 from a side surface 572 along the first and second valleys 564, 568. A bore 574 extends through the side surface 576 into the channel 570. A plurality of position markings 578 can extend along the top surface 580 and along a side surface 582.

Figure 54A:
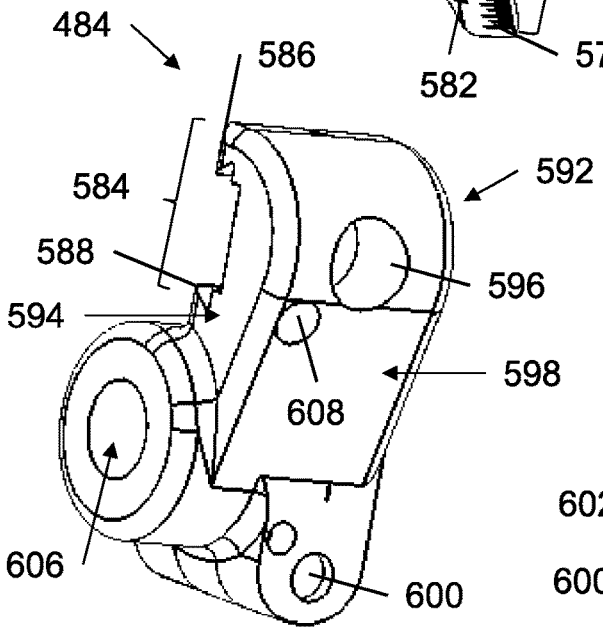
FIG. 54*a* is an isometric view of an embodiment of a second adjustment body of the arrow rest mounting system of FIGS. 47-49.
Figure 54B:
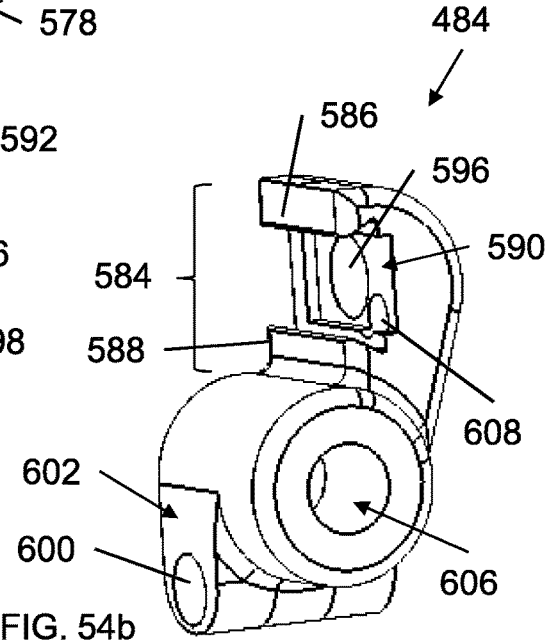
FIG. 54*b* is another isometric view of the second adjustment body of FIG. 54*a*.
Figure 55:
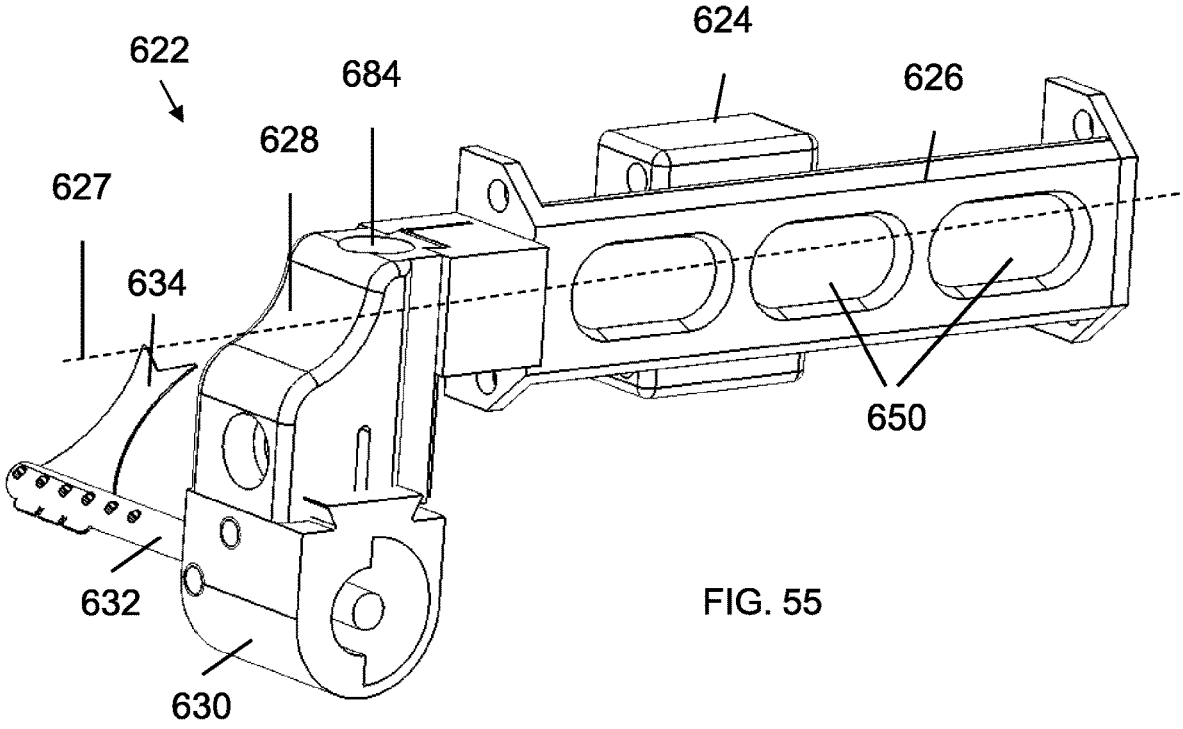
FIG. 55 is an isometric view of an embodiment of an arrow rest mounting system.

Referring to FIGS. 54*a*-54*b*, the second adjustment structure 484 includes a fore-aft adjustment surface 584. The fore-aft adjustment surface 584 includes a first lip 586 and a second lip 588 that define a female dovetail shape. A channel 590 extends through the second adjustment structure 484 from side surface 592 to side surface 594 between the first lip 586 and the second lip 588. A bore 596 extends through the second adjustment structure 484 from the rear surface 598 to the channel 590. A second bore 600 extends through the second adjustment structure 484 from the front surface 602 to the rear surface 598 along the bottom 604 of the second adjustment structure 484. A third 606 bore extends through the second adjustment structure 484 from side surface 592 to side surface 594, extending below the fore-aft adjustment surface 584 and above the second bore 600. A fourth bore 608 extends through the second adjustment body parallel to the bore 596.

Referring again to FIGS. 47-50, the arrow rest 488 is coupled to the arrow rest support 486, which extends through the bore 606. The fore-aft adjustment surface 584 of the second adjustment structure 484 slidably engages the fore-aft adjustment surface 558 of the first adjustment structure 482. The vertical adjustment surface 546 of the first adjustment structure 482 slidably engages the vertical adjustment surface 502 of the arm 480 and the body engagement surface 492 of the arm 480 slidably engages the arm engagement surface 516 of the body 478.

Figure 47:
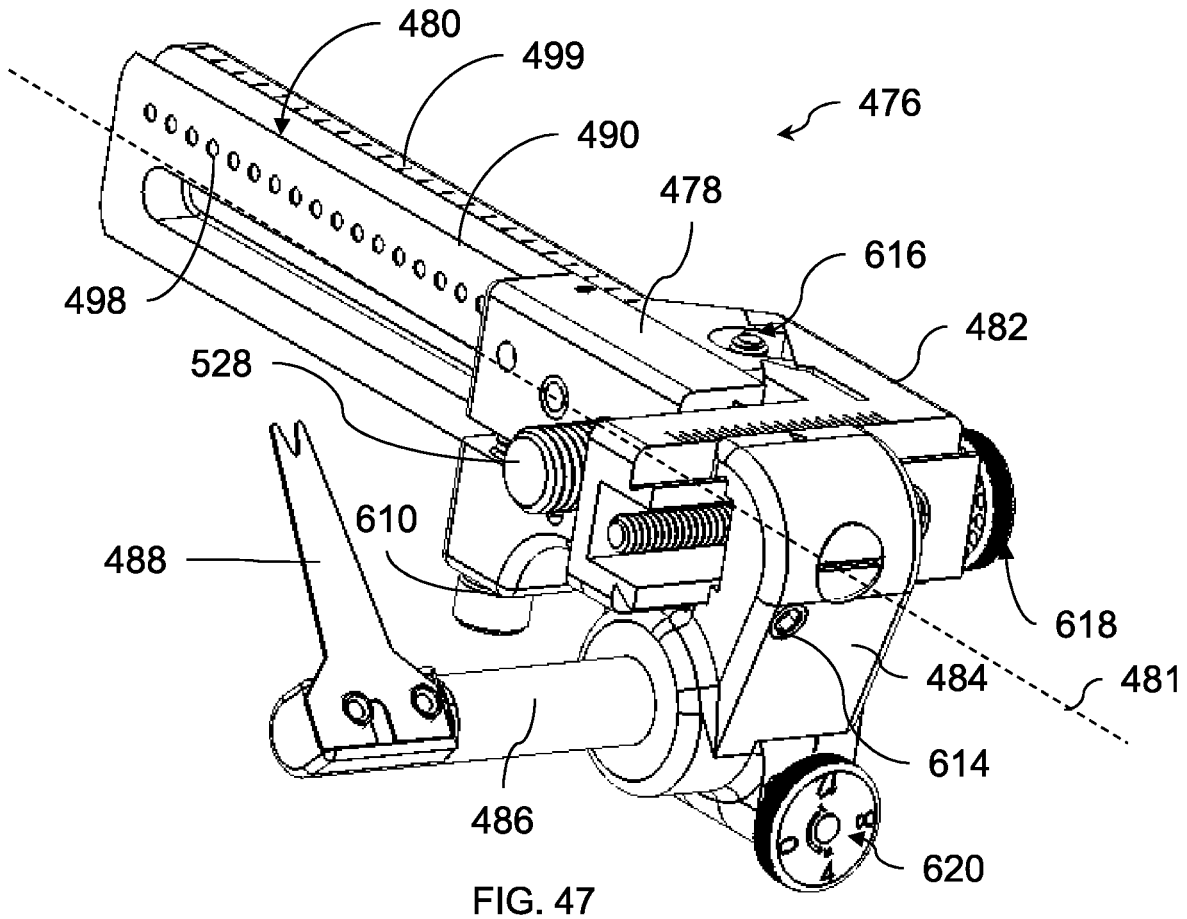
FIG. 47 is an isometric view of an embodiment of an arrow rest mounting system.
Figure 48:
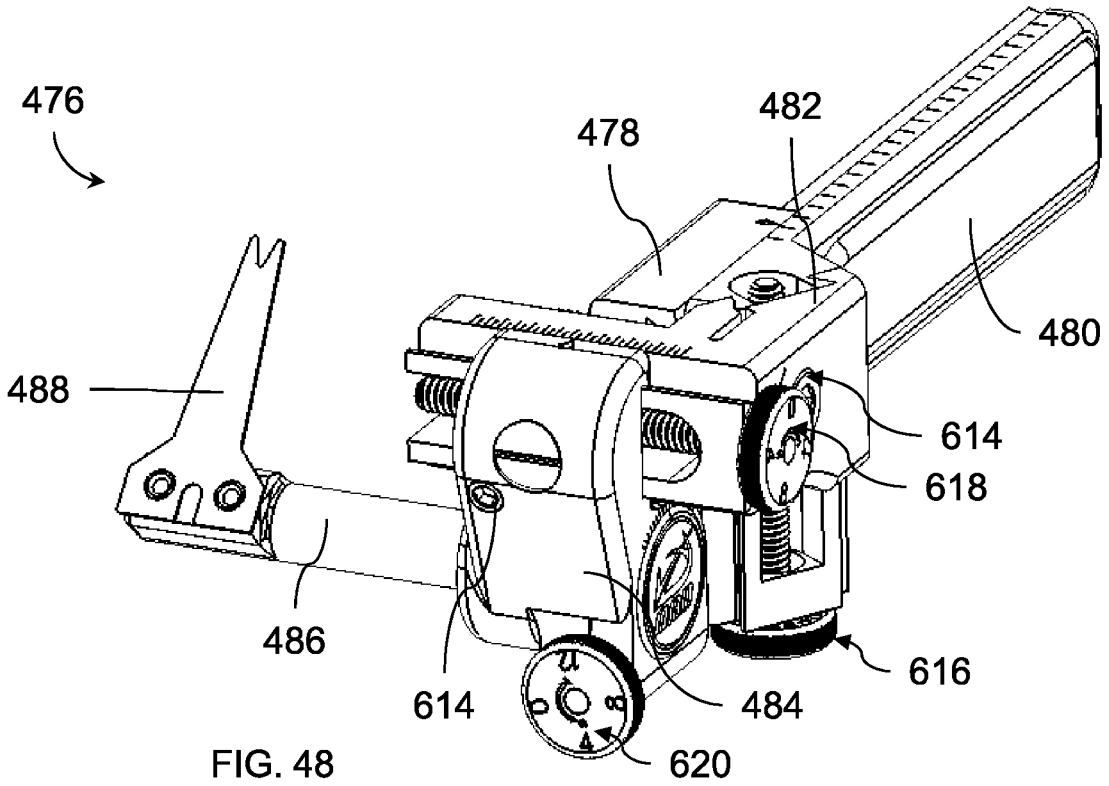
FIG. 48 is an isometric view of the arrow rest mounting system of FIG. 47.
Figure 49:
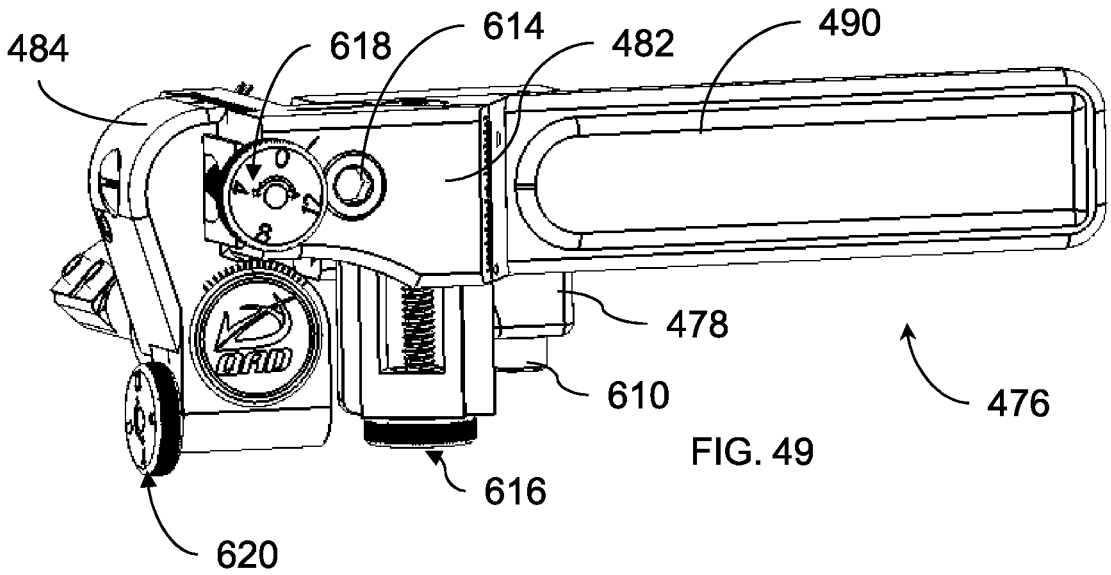
FIG. 49 is a side view of the arrow rest mounting system of FIGS. 47-48.
Figure 50:
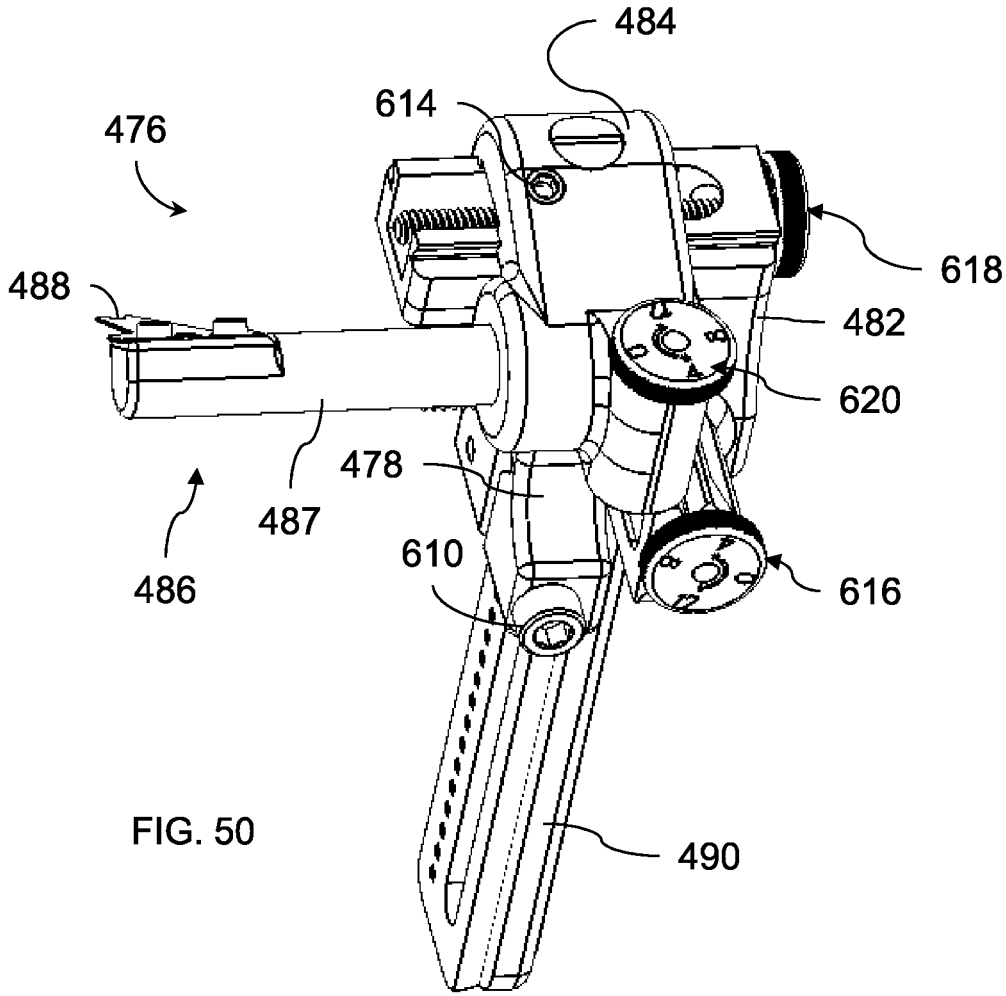
FIG. 50 is a bottom isometric view of the arrow rest mounting system of FIGS. 47-49.
Figure 51A:
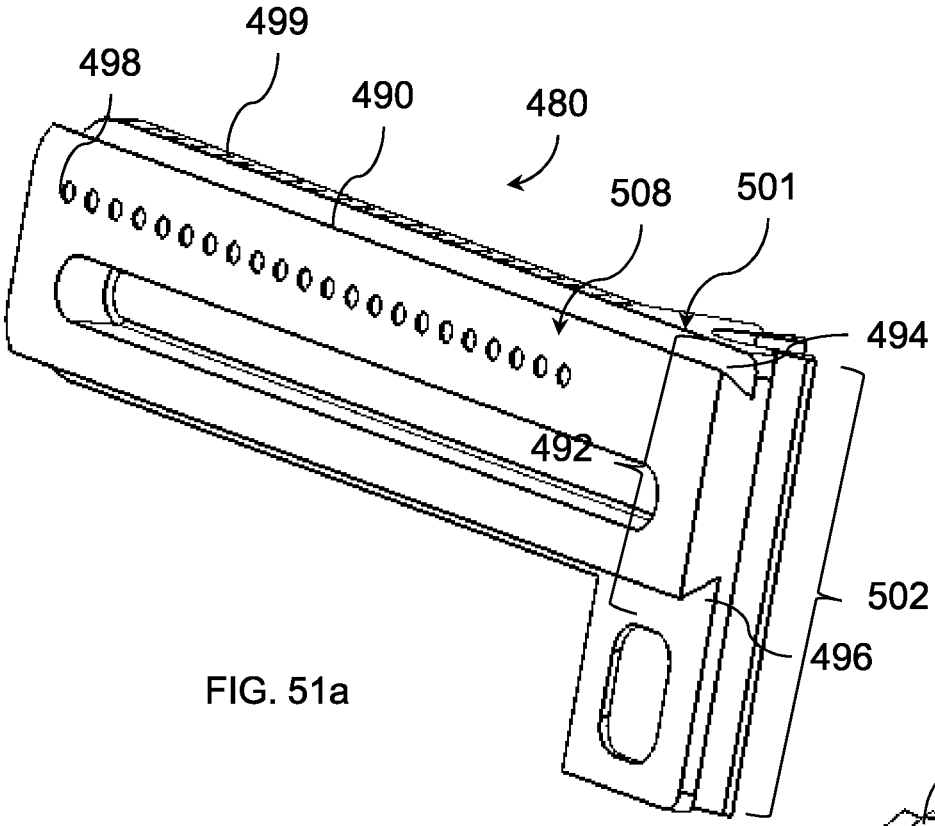
FIG. 51*a* is an isometric view of an embodiment of an arm of the arrow rest mounting system of FIGS. 47-49.
Figure 51B:
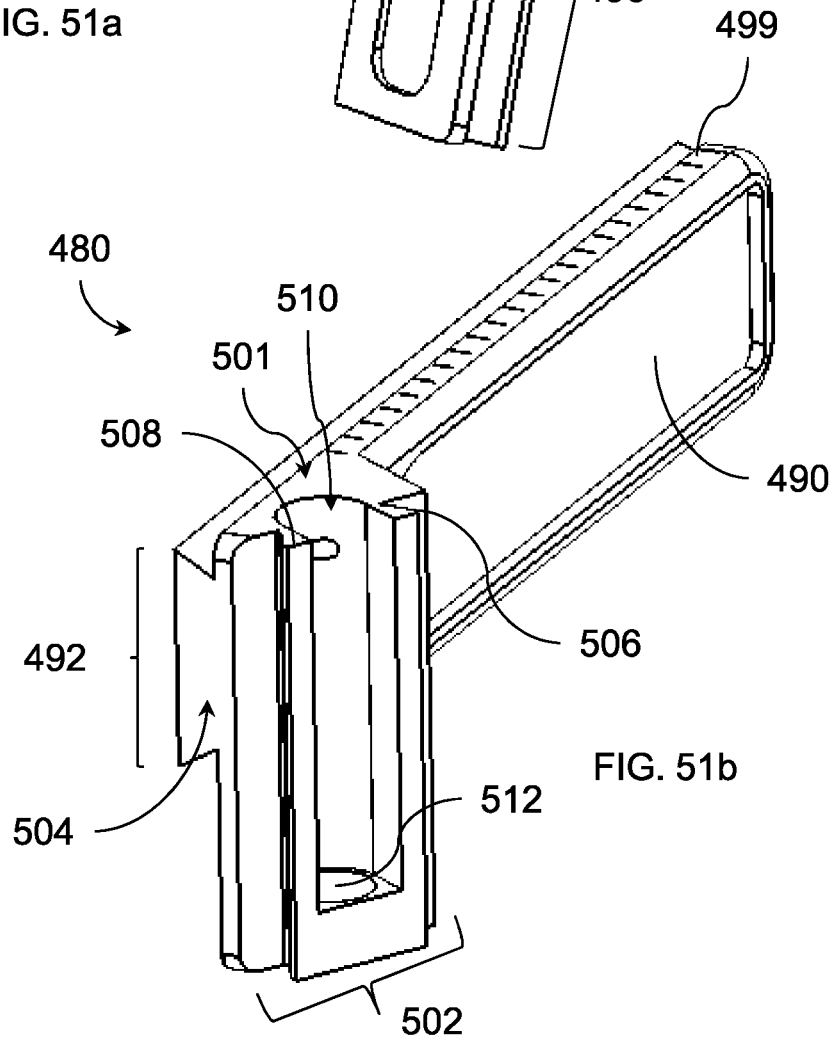
FIG. 51*b* is another isometric view of the arm of FIG. 51*a*.

A position lock 610 is inserted in the bore 530 and is configured to narrow the groove 536, bringing the lips 518 and 520 closer together and locking the position of the arm 480 relative to the body 478. A second position lock 612 is positioned in the bore 555 of the first adjustment structure 482 and configured to lock the vertical position of the first adjustment structure 482 relative to the arm 480. A third position lock 614 is positioned in the bore 608 and configured to lock the fore-aft position of the second adjustment structure 484 relative to the first adjustment structure 482. A first driver 616 is positioned in the bore 512 (FIG. 51*b*) and rotation of the first driver 616 drives the arm 480 fore-aft relative to the body 478 along arm axis 481 (FIG. 47). A second driver 618 is positioned in the bore 574 (FIG. 53*b*) and configured to drive the first adjustment structure 482 laterally (e.g., along axis 309 shown in FIG. 13) relative to the arm 480. A third driver 620 is positioned in the bore 600 (FIG. 54*a*) and configured to rotate the arrow rest shaft (FIG. 50) so as to change the angle of the arrow rest 488. Thus, the arrow rest 488 can be adjusted fore-aft, vertically, laterally and angularly.

FIGS. 55-60 illustrate yet another embodiment of an arrow rest mounting system 622. The mounting system 622 includes a body 624, an arm 626, a first adjustment structure 628, a second adjustment structure 630, an arrow rest support 632, and an arrow rest 634. Referring to FIGS. 57*a*-57*b*, the body 624 includes an arm engager or arm engagement surface 636. The arm engagement surface 636 includes a first tapered lip or slide guide 638 and a second tapered lip or slide guide 640. The body 624 also includes a bow engagement surface 642, shown here as a bore extending through the body 624 and configured to receive a bow coupler (not shown).

Figure 56:
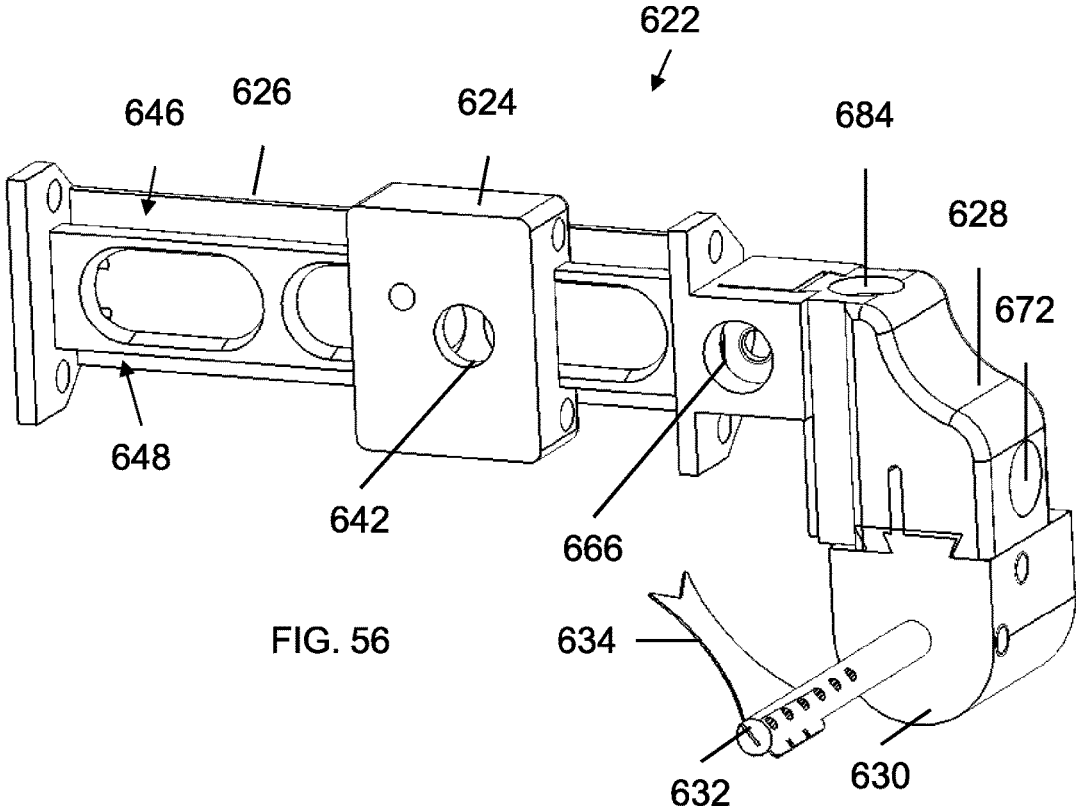
FIG. 56 is another isometric view of the arrow rest mounting system of FIG. 55.
Figure 57A:
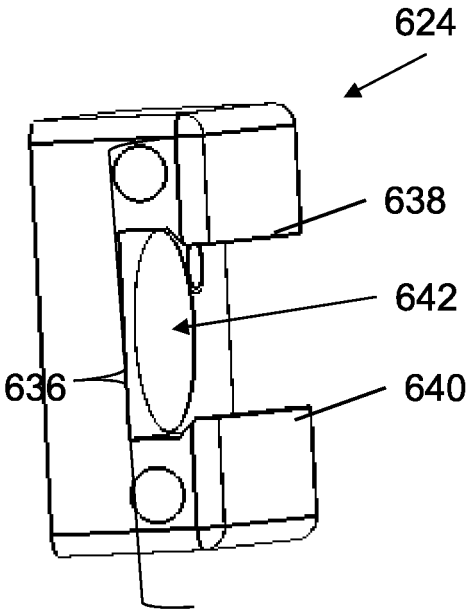
FIG. 57*a* is an isometric view of an embodiment of a body of the arrow rest mounting system of FIGS. 54-55.
Figure 57B:
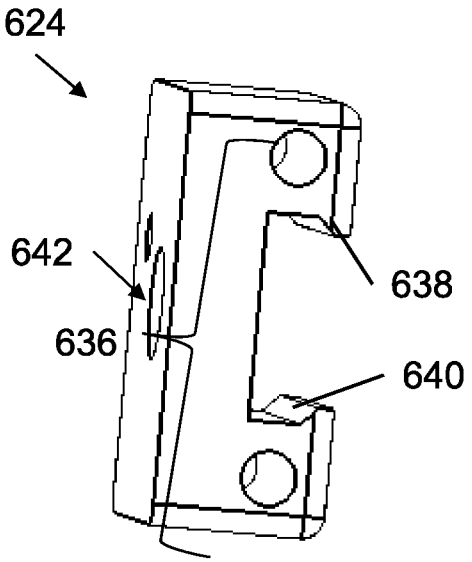
FIG. 57*b* is another isometric view of the body of FIG. 57*a*.
Figure 58:
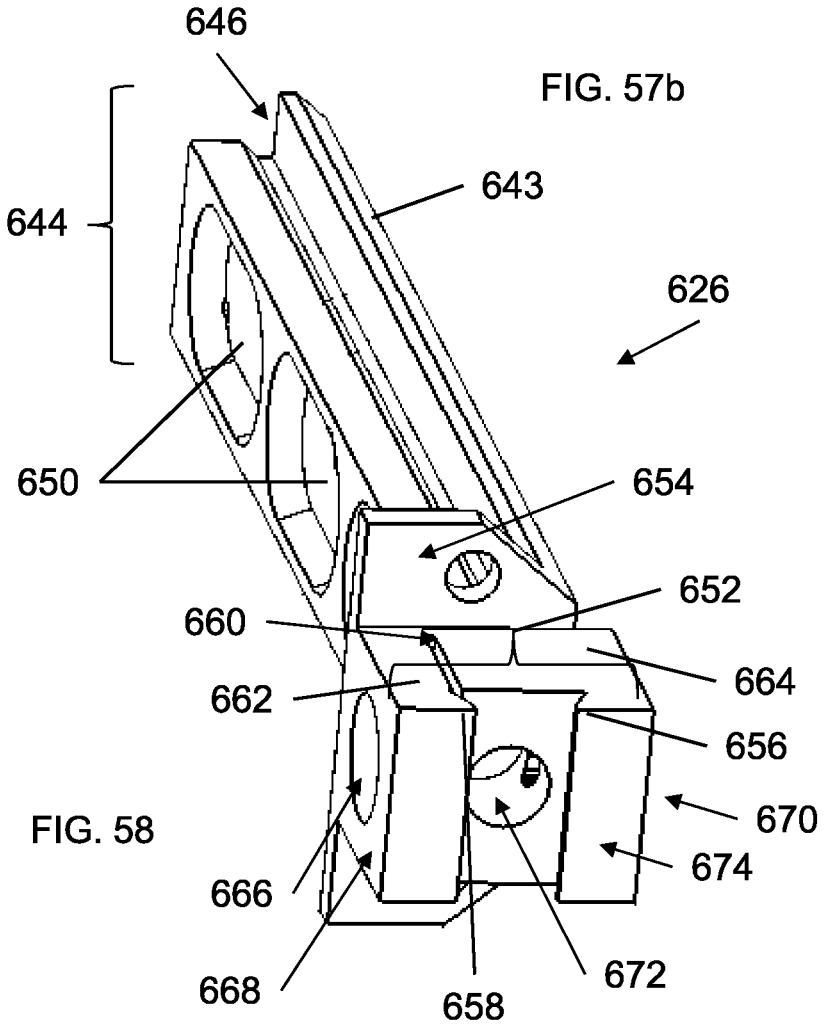
FIG. 58 is an isometric view of an embodiment of an arm of the arrow rest mounting system of FIGS. 54-55.

Referring to FIG. 58, the arm 626 includes an arm structure 643. The arm structure 643 includes a body engagement surface 644 having a first valley 646 and a second valley 648 (FIG. 56). In the illustrated embodiment, the arm structure 643 includes a plurality of cutouts or windows 650 extending through the arm structure 643. The windows 650 decrease the weight of the arm structure and provide visibility.

A vertical adjustment surface 652 extends from a rear surface 654 of the arm structure 643. The vertical adjustment surface 652 includes a first lip or slide guide 656 and a second lip or slide guide 658. A groove 660 extends through the vertical adjustment surface 652 between and along the first and second slide guides 656, 658, defining a first portion 662 and a second portion 664. A first bore 666 extends through the vertical adjustment surface 652 from side surface 668 to side surface 670. A second bore 672 extends into the vertical adjustment surface 652 from a rear surface 674 of the vertical adjustment surface 652.

Figure 59:
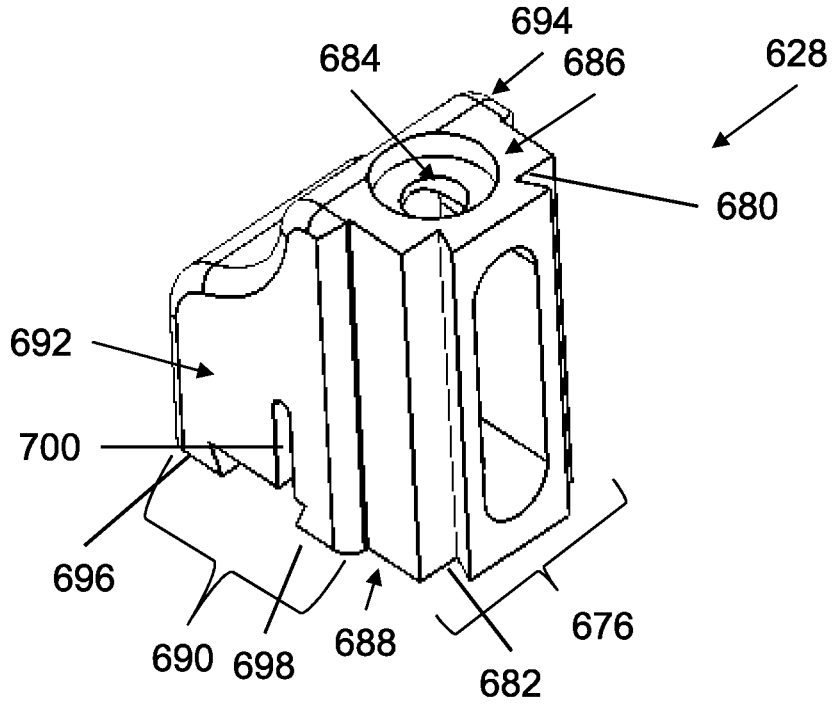
FIG. 59 is an isometric view of an embodiment of a first adjustment body of the arrow rest mounting system of FIGS. 54-55.

Referring to FIG. 59, the first adjustment structure 628 includes a vertical adjustment surface 676 extending along a front surface 678 of the first adjustment structure 628. The vertical adjustment surface 676 includes a first valley 680 and a second valley 682 defining a male dovetail shape. A bore 684 extends through the first adjustment structure 628 from top surface 686 to bottom surface 688 along the vertical adjustment surface 676. A lateral adjustment surface 690 extends from side surface 692 to side surface 694 across the bottom surface 688 of the first adjustment structure 628. The lateral adjustment surface 690 includes a first lip or slide guide 696 and second lip or slide guide 698, which together define a female dovetail shape. A groove 700 extends partially into the first adjustment structure 628 between and along the first slide guide 696 and second slide guide 698.

Figure 60:
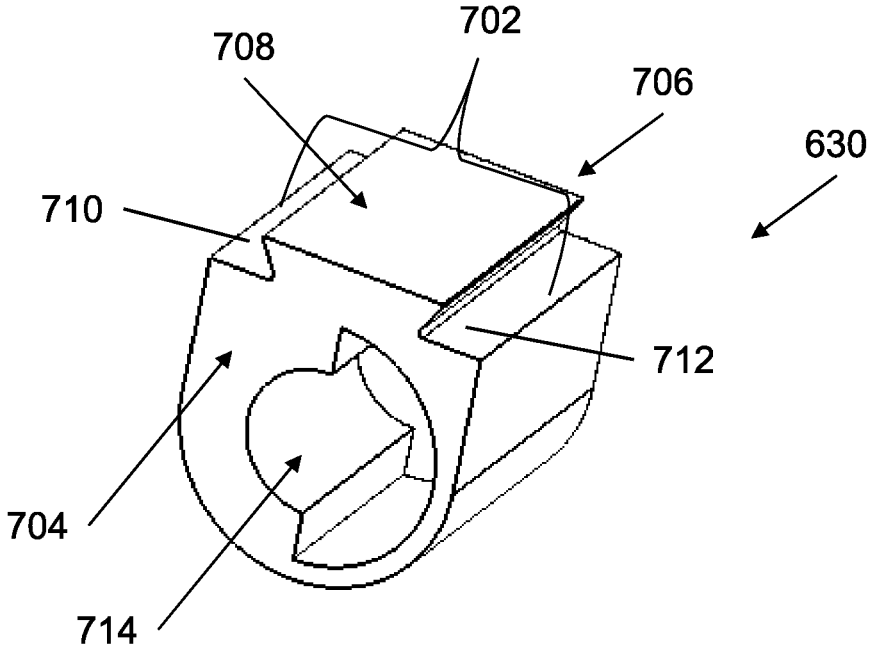
FIG. 60 is an isometric view of an embodiment of a second adjustment body of the arrow rest mounting system of FIGS. 54-55.
Figure 61:
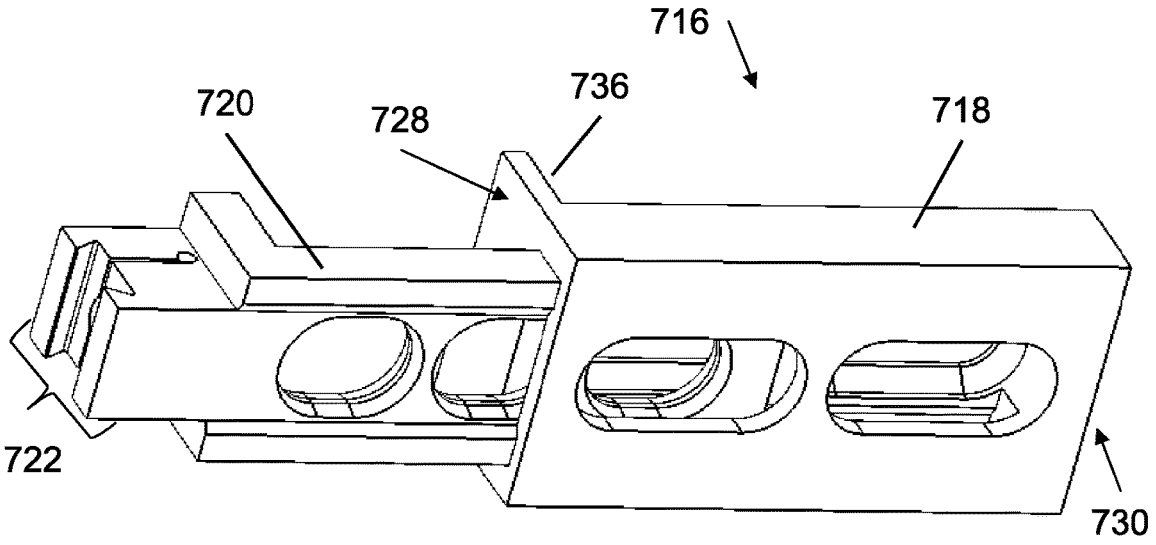
FIG. 61 is isometric view of an embodiment of a body arm assembly.
Figure 62:
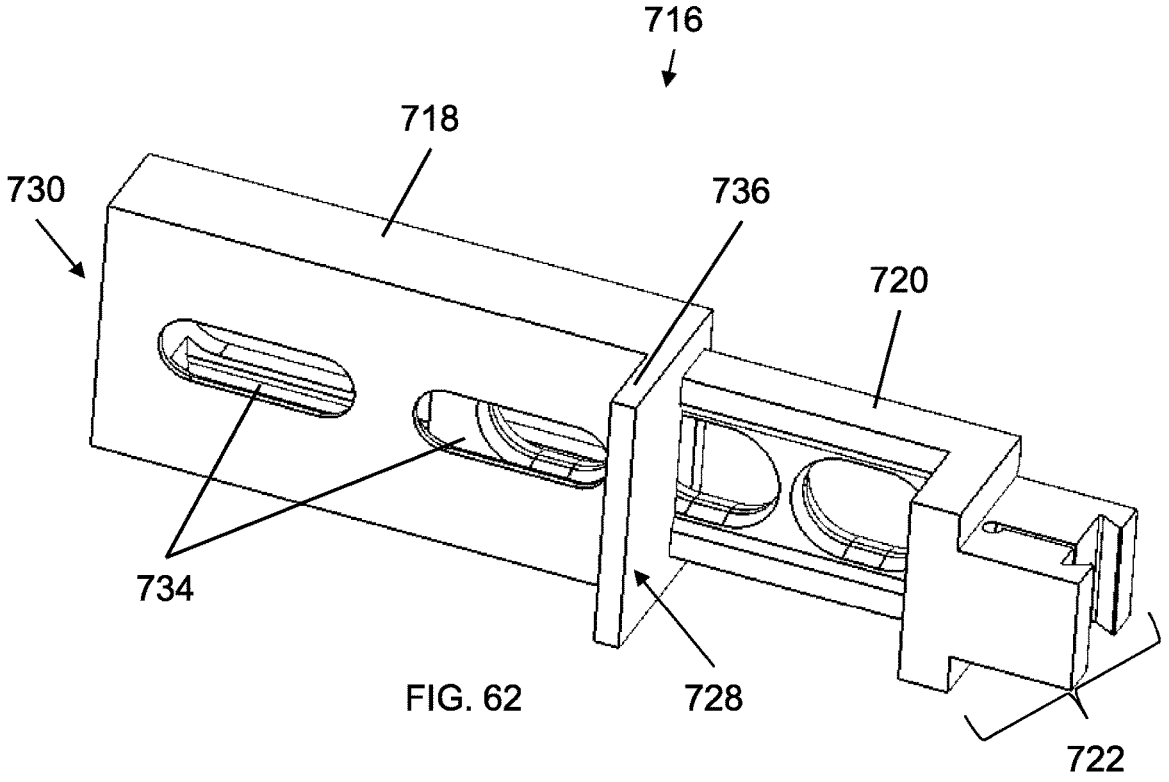
FIG. 62 is another isometric view of the body arm assembly of FIG. 61.
Figure 63:
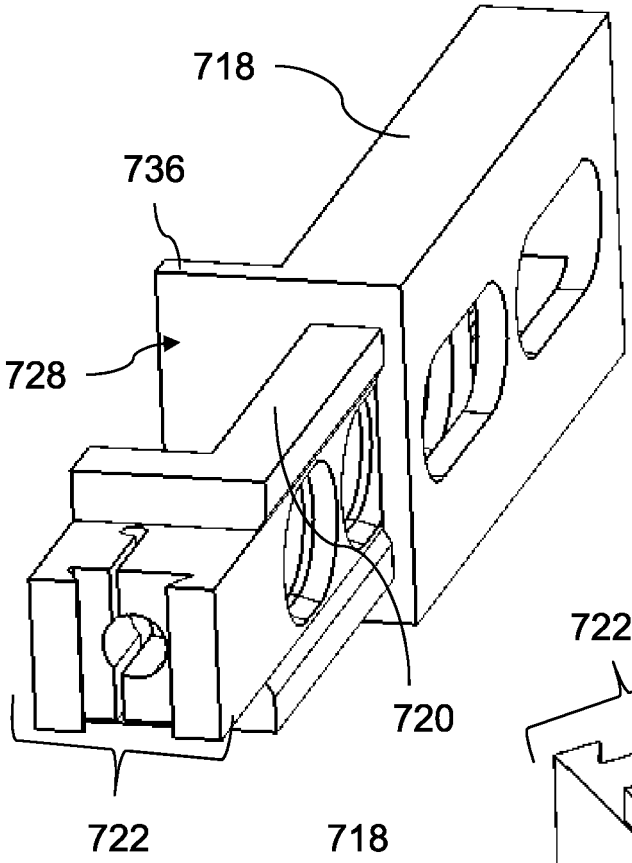
FIG. 63 is another isometric view of the body arm assembly of FIGS. 61-62.
Figure 65:
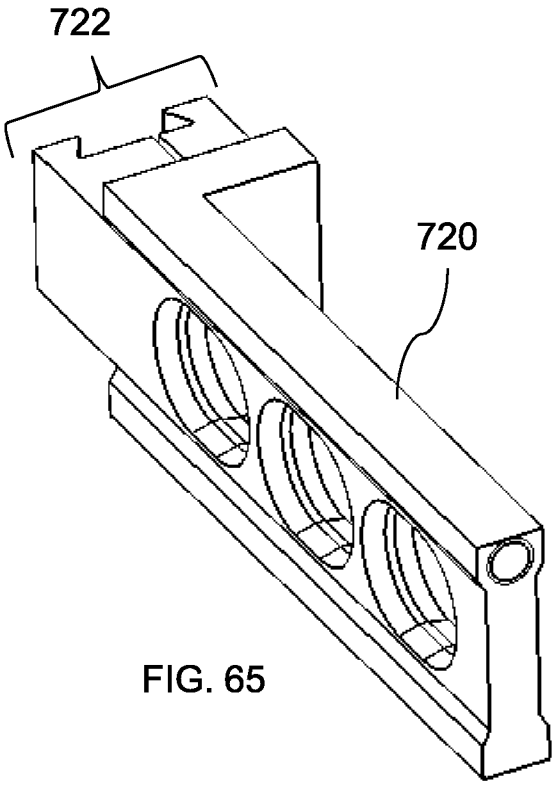
FIG. 65 is an isometric view of an embodiment of an arm of the body arm assembly of FIGS. 61-63.
Figure 64:
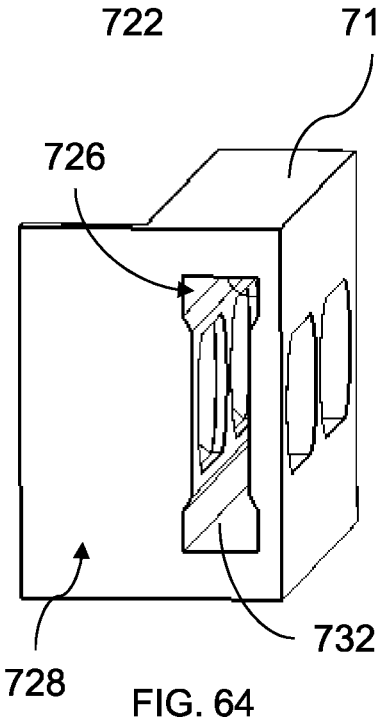
FIG. 64 is an isometric view of an embodiment of a body of the body arm assembly of FIGS. 61-63.
Figure 66:
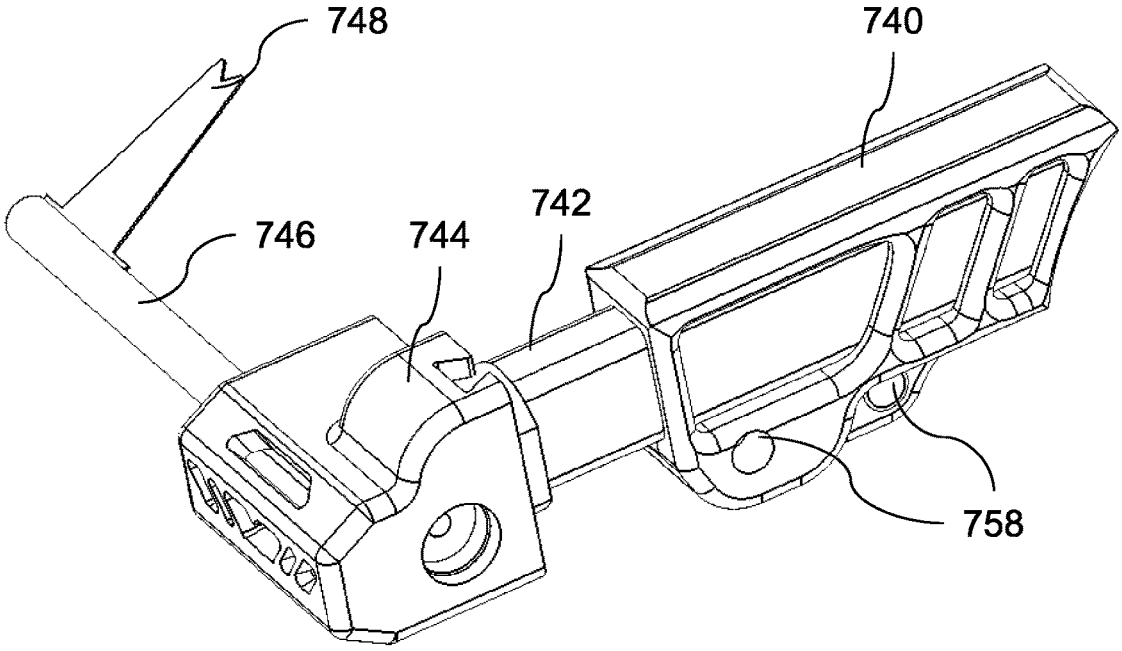
FIG. 66 is an isometric view of an embodiment of an arrow rest mounting system.

Referring to FIG. 60, the second adjustment structure 630 includes a lateral adjustment surface 702 extending from side surface 704 to side surface 706 across the top surface 708 of the second adjustment structure 630. The lateral adjustment surface 702 includes a first valley 710 and a second valley 712, together defining a male dovetail shape. A bore 714 extends from side surface 704 to side surface 706 through the second adjustment structure 630.

Referring again to FIGS. 55-56, the arm engagement surface 636 slidably engages the body engagement surface 644, permitting fore-aft movement of the arm 626 relative to the body 624 along arm axis 627 (FIG. 55). The vertical adjustment surface 652 of the arm 626 slidably engages the vertical adjustment surface 676 of the first adjustment structure 628, permitting vertical movement of the first adjustment structure 628 relative to the arm 626. The lateral adjustment surface 690 of the first adjustment structure 628 slidably engages the lateral surface 702 of the second adjustment structure 630, permitting lateral movement of the second adjustment structure 630 relative to the first adjustment structure 628 along axis 309 (FIG. 13). The arrow rest support 632, to which the arrow rest 634 is coupled, is received in the bore 714 of the second adjustment structure 630. Thus, the arrow rest 634 can ultimately be adjusted fore-aft, vertically and laterally. Positions locks (not shown) can be positioned in the bores 666, 684 to compress the grooves 660, 700 and lock the vertical and fore-aft positions, respectively.

FIGS. 61-65 illustrate another embodiment of a body arm assembly 716 employing an arm 720, having a vertical adjustment surface 722, similar to the arm 626 described above with regard to the mounting system 622. The body 718, in contrast to the previously described external arm engagement surfaces, has an internal arm engagement surface 732 (FIG. 64) defining an elongated cavity 726. In this embodiment, the cavity 726 extends through the body 718 from the rear surface 728 toward the front surface 730 of the body 718 and defines a track for the arm 720. The body 718 has a bow engagement surface 734 and a stabilizer or ledge 736 extending from the body 718 and configured to prevent rotation of the body 718 relative to a bow riser.

FIGS. 66-70 illustrate another embodiment of an arrow rest mounting system 738. The mounting system 738 includes a body 740, an arm 742, an adjustment body 744, and arrow rest support 746, and an arrow rest 748. Similar to the body arm assembly 716 described above, the body 740 includes an internal arm engagement surface 750 defining an elongated slot or cavity 751 (FIGS. 68*a*-68*b*). The cavity 751 extends through the body 740 from a rear surface 752 to a front surface 754 and defines a guide track 756 for the arm 742. The body 740 includes one or more bores 758 extending through the body 740 and configured to receive a bow coupler (not shown), such as a fastener to couple the body 740 to a bow riser.

Figure 67:
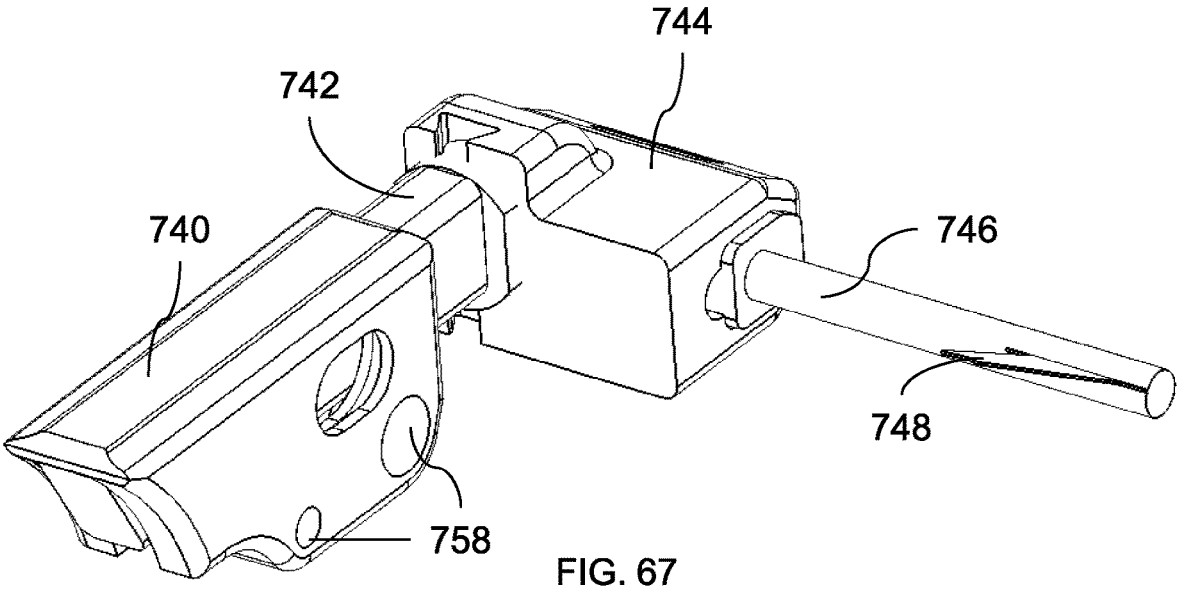
FIG. 67 is another isometric view of the arrow rest mounting system of FIG. 66.
Figure 68A:
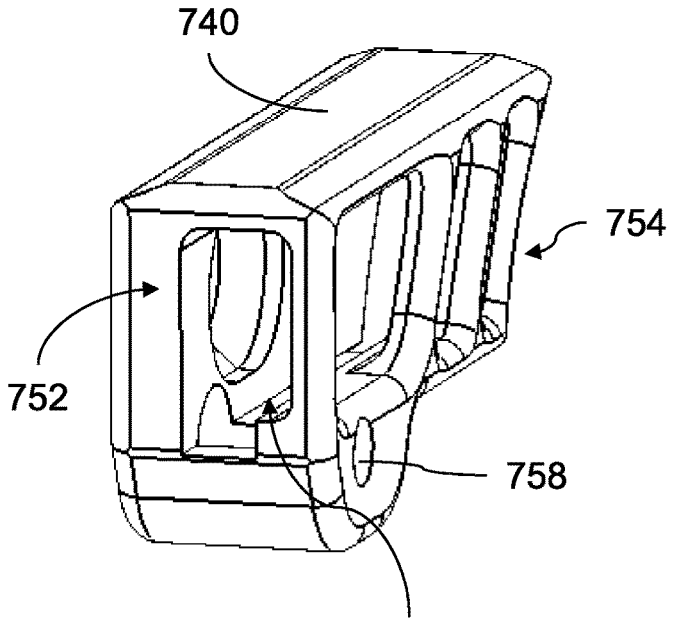
FIG. 68*a* is an isometric view of an embodiment of a body of the arrow rest mounting system of FIGS. 66-67.
Figure 68B:
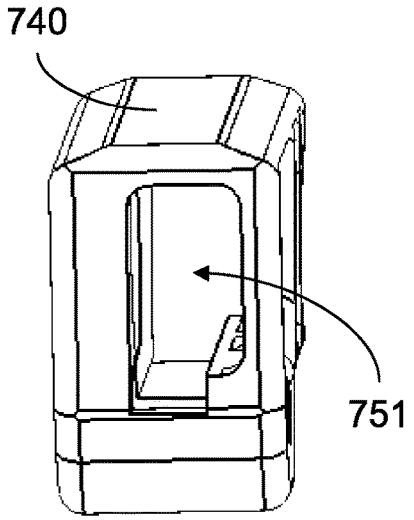
FIG. 68*b* is another isometric view of the body of FIG. 68.
Figure 69:
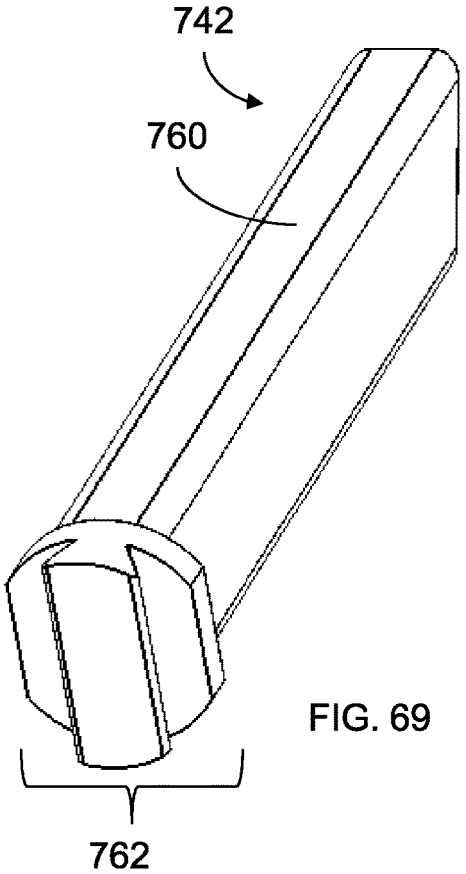
FIG. 69 is an isometric view of an embodiment of an arm of the arrow rest mounting system of FIGS. 66-67.
Figure 70:
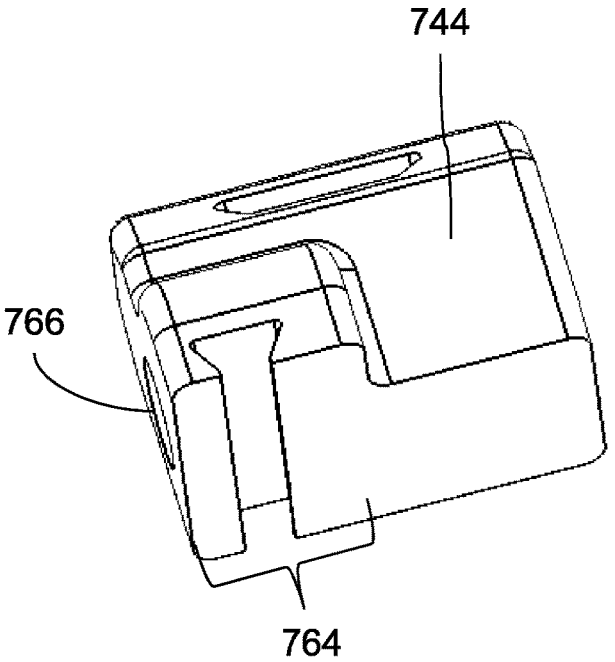
FIG. 70 is an isometric view of an embodiment of a first adjustment body of the arrow rest mounting system of FIGS. 66-67.

Referring to FIG. 69, the arm 742 includes an arm structure 760 having a vertical adjustment surface 762. Referring to FIG. 70, the adjustment body 744 includes a vertical adjustment surface 764 configured to slidably engage the vertical adjustment surface 762 of the arm 742. A bore 766 extends through the adjustment body 744 and is configured to receive the arrow rest support 746 (FIG. 67).

Figure 71:
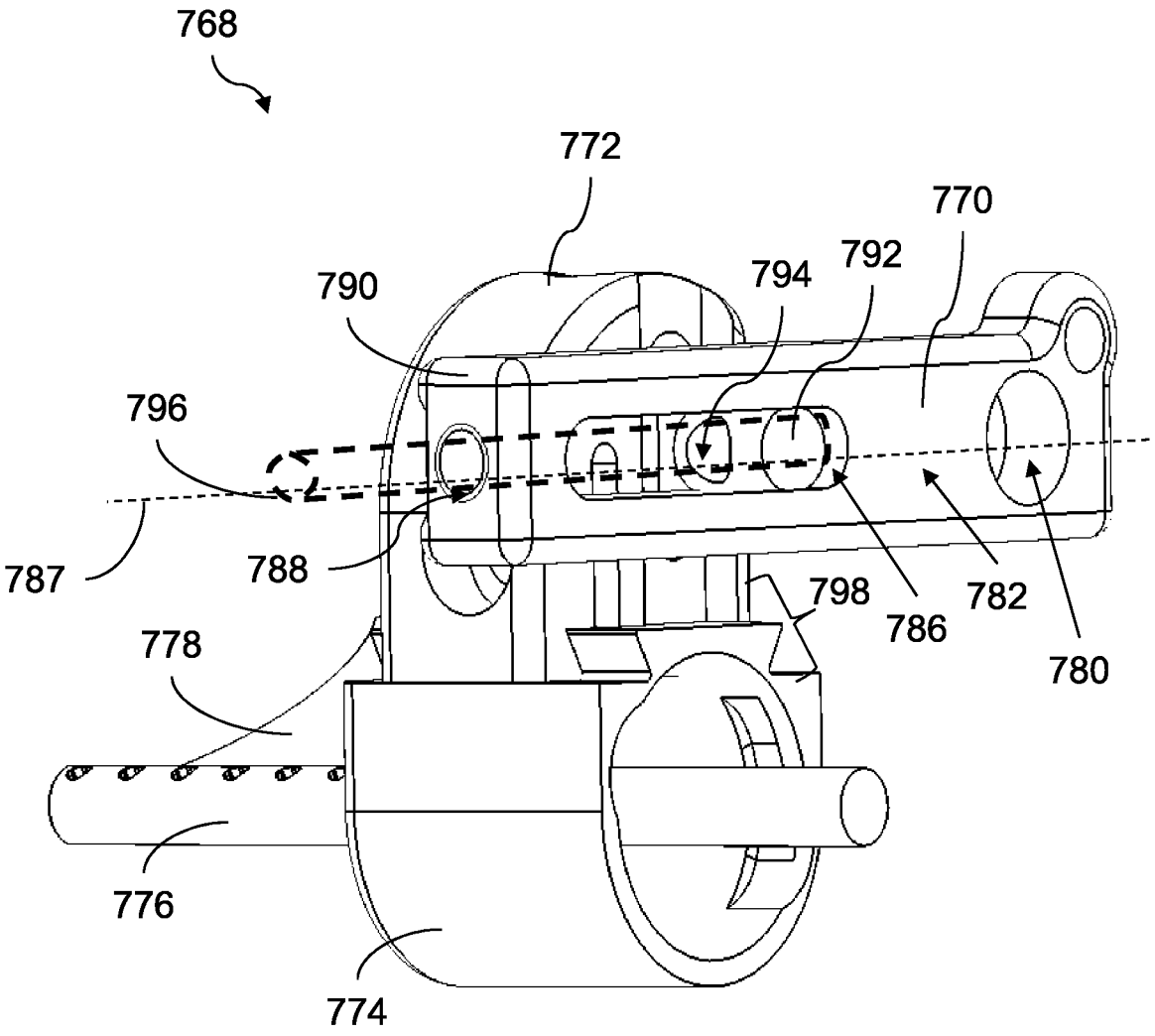
FIG. 71 is an isometric view of an embodiment of an arrow rest mounting system.
Figure 72:
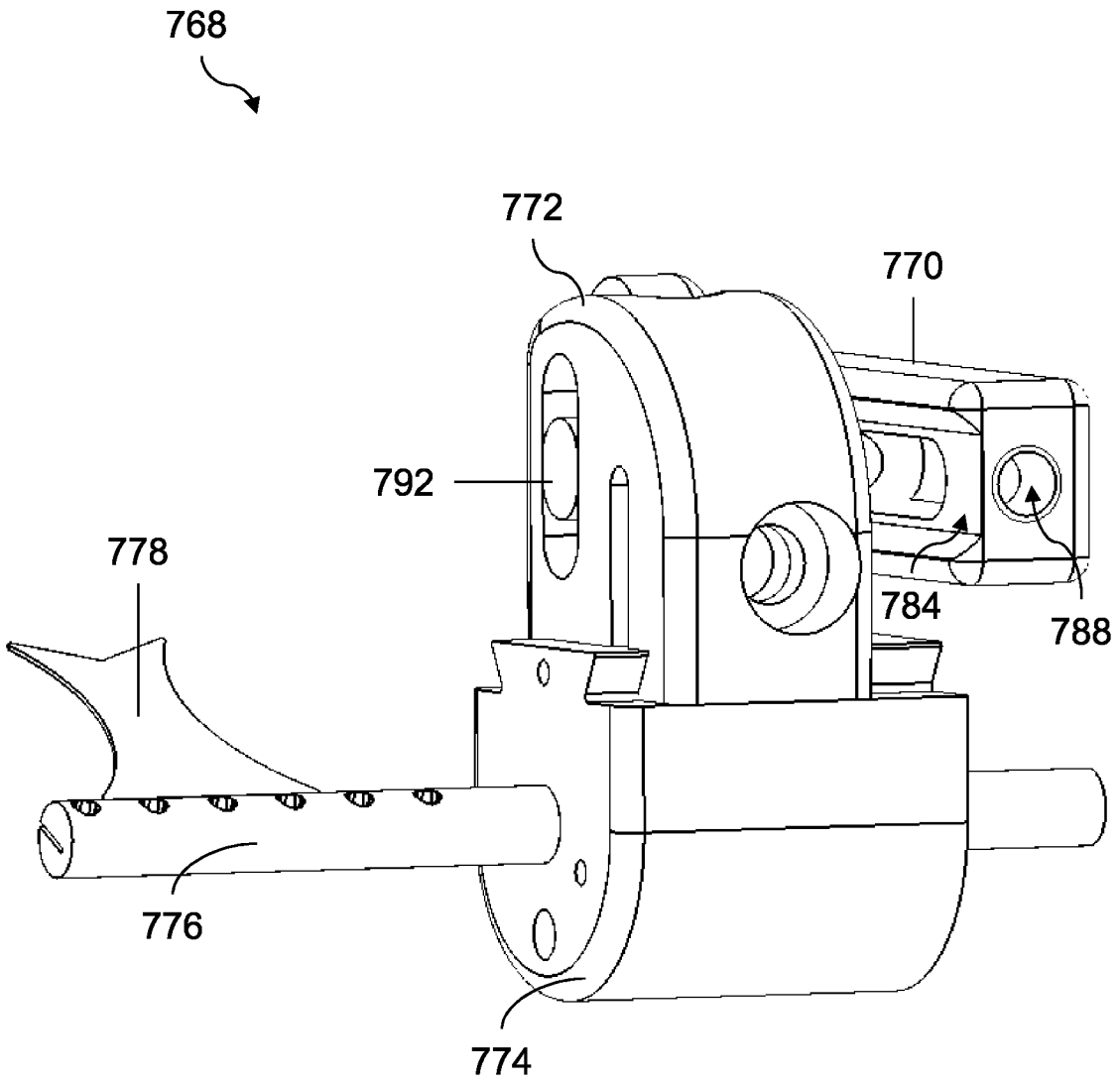
FIG. 72 is another isometric view of the arrow rest mounting system of FIG. 71.

FIGS. 71-72 illustrate another embodiment of an arrow rest mounting system 768. The mounting system 768 includes an arm 770, a first body 772, a second body 774, an arrow rest support 776, and an arrow rest 778. The arm 770 includes a bore 780 extending from side surface 782 to side surface 784 through the arm 770 and is configured to receive a bow engager (not shown), such as a fastener. An oblong track 786 extends from side surface 782 to side surface 784 through the arm 770 along the arm axis 787. An opening or bore 788 extends through the front surface 790 of the arm 770 into the track 786. The first body 772 includes a body extension 792 protruding from the first body 772 into the track 786. An opening or bore 794 extends through the body extension along the arm axis 787. A guide rod 796 extends into the track 786 through the opening 788 and the bore 794. The guide rod 796 holds the body extension 792 within the track 786 while permitting fore-aft movement of the first body 772 relative to the arm 770. The first body 772 and second body 774 define a lateral adjustment section 798 for adjustment along axis 309 (FIG. 13).

Figure 73:
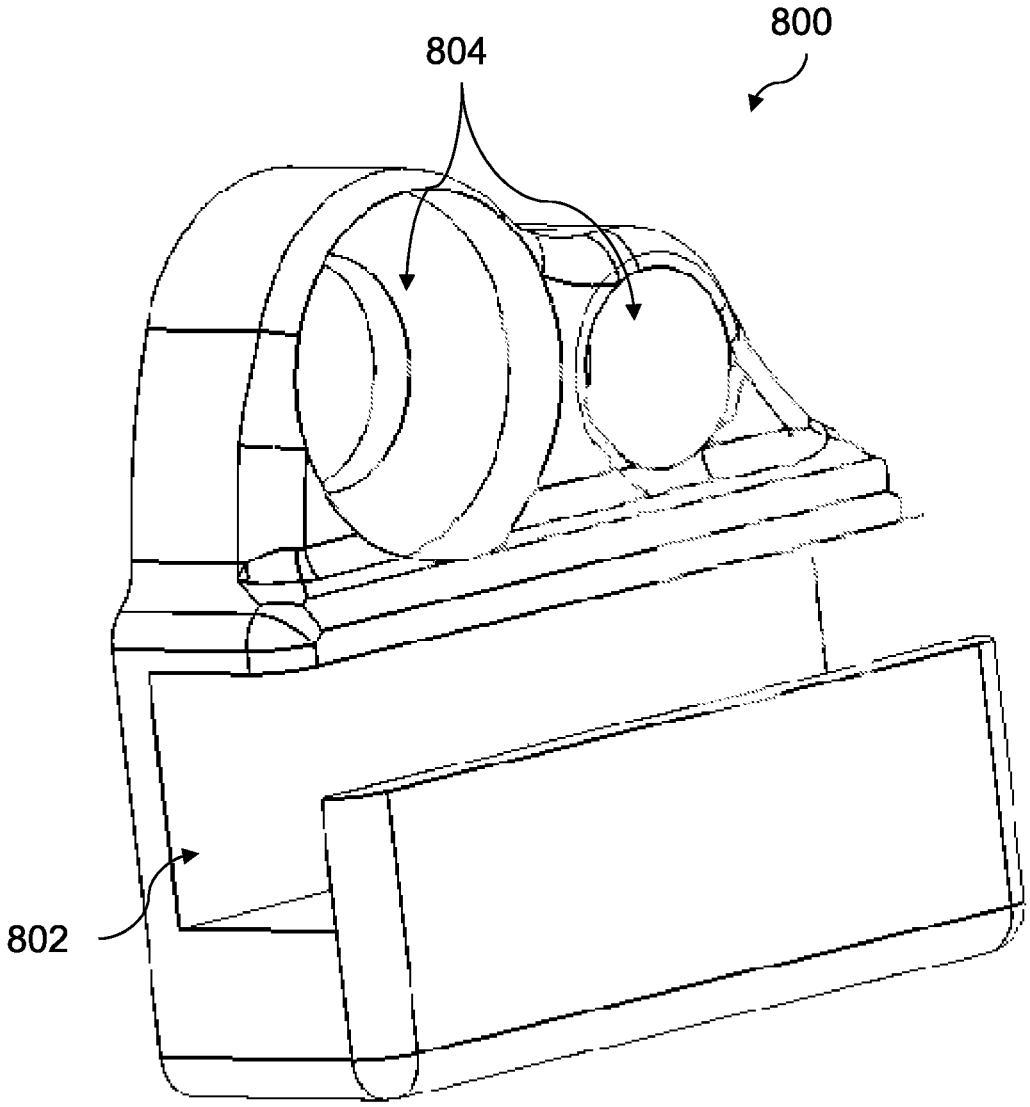
FIG. 73 is an isometric view of an embodiment of a body.

FIG. 73 illustrates an alternative embodiment of a body 800. The body 800 includes a partially enclosed arm engagement surface 802 and one or more bores 804 positioned above the arm engagement surface 802 and configured to receive a bow engager (not shown) such as a fastener to couple the body 800 to a bow riser.

It is to be understood that while the previous embodiments have been described in the context of arrow rest mounting systems, the above described mounting systems can be used to mount any suitable type of bow accessory to the riser of a bow, such as a sight device. For example, each one of the mounting systems described above can exclude the arrow rest support 132, 318, 486, 632, 746 or 776 and, instead, include a sight support, flash light support or any other bow accessory support.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An arrow rest mounting system comprising:

a main body configured to be coupled to a side surface of an archery bow and extend along a main body axis; and an arm extending along an arm axis that extends in a same direction as the main body axis, wherein the arm comprises, a plurality of main body engagement surfaces configured to engage the main body to support and retain the arm on the main body, and an arrow rest support configured to support an arrow rest and move relative to the arm along an axis that intersects the arm axis, wherein the plurality of main body engagement surfaces of the arm are configured to direct a slide movement of the arm relative to the main body along the arm axis and inhibit rotation of the arm relative to the main body.

2. The arrow rest mounting system of claim 1, wherein the archery bow extends along an archery bow axis, and wherein the main body axis intersects the archery bow axis.

3. The arrow rest mounting system of claim 1, further comprising a first adjustment structure movably coupled to the arm.

4. The arrow rest mounting system of claim 3, wherein the first adjustment structure is configured to move the arrow rest support in a vertical direction relative to the arm axis when the archery bow is oriented upright.

5. The arrow rest mounting system of claim 4, further comprising a second adjustment structure movably coupled to the first adjustment structure.

6. The arrow rest mounting system of claim 5, wherein the second adjustment structure is configured to move along an axis that intersects with a plane in which a portion of a bowstring travels when the bowstring is coupled the archery bow.

7. The arrow rest mounting system of claim 5, wherein the second adjustment structure is configured to move angularly relative to the first adjustment structure.

8. The arrow rest mounting system of claim 7, further comprising a second position adjuster operatively coupled to the second adjustment structure and configured to drive movement of the second adjustment structure.

9. An arrow rest mounting system comprising:

a main body extending along a main body axis and configured to be coupled to a side surface of an archery bow; and an arm extending along an arm axis and configured to engage the main body to inhibit rotation of the arm relative to the main body, the arm comprising an arrow rest support configured to support an arrow rest and move relative to the arm along an axis that intersects the arm axis, wherein the arm is configured to slide relative to the main body along the main body axis.

10. The arrow rest mounting system of claim 9, wherein the archery bow extends along an archery bow axis, and wherein the main body axis intersects the archery bow axis.

11. The arrow rest mounting system of claim 9, wherein the arm further comprises a plurality of main body engagement surfaces configured to engage the main body.

12. The arrow rest mounting system of claim 9, further comprising a first adjustment structure movably coupled to the arm.

13. The arrow rest mounting system of claim 12, wherein the first adjustment structure is configured to move in a vertical direction relative to the arm axis when the archery bow is oriented upright.

14. The arrow rest mounting system of claim 13, further comprising a second adjustment structure movably coupled to the first adjustment structure.

15. The arrow rest mounting system of claim 14, wherein the second adjustment structure is configured to move along an axis that intersects with a plane in which a portion of a bowstring travels when the bowstring is coupled the archery bow.

16. The arrow rest mounting system of claim 14, wherein the second adjustment structure is configured to move angularly relative to the first adjustment structure.

17. The arrow rest mounting system of claim 16, further comprising a second position adjuster operatively coupled to the second adjustment structure and configured to drive movement of the second adjustment structure.

18. A method for manufacturing an arrow rest mounting system, the method comprising:

structuring a main body to extend along a main body axis and to be coupled to an archery bow; and structuring an arm to, extends along an arm axis in a same direction as the main body axis, engage the main body to inhibit rotation of the arm relative to the main body, support an arrow rest support supporting an arrow rest, wherein the arrow rest support is configured to move relative to the arm along an axis that intersects the arm axis, and slide relative to the main body along the arm axis.

19. The method of claim 18, further comprising structuring a locking device configured to lock the arm in place relative to the main body.

20. The method of claim 19, wherein the structuring of the main body comprises structuring a stabilizer so that the stabilizer extends from a surface of the body and is configured to engage the archery bow to inhibit rotation of the main body relative to the archery bow.

* * * * *